US011974704B2

(12) United States Patent
Berman et al.

(10) Patent No.: US 11,974,704 B2
(45) Date of Patent: May 7, 2024

(54) CUSTOMIZABLE SHOWER CADDY

(71) Applicant: House of Atlas, LLC, Evanston, IL (US)

(72) Inventors: Matthew Berman, Chicago, IL (US); Alan Arthur Ford, Sturgis, MI (US); Jason Moss, Libertyville, IL (US)

(73) Assignee: House of Atlas LLC, Evanston, IL (US)

( * ) Notice: Subject to any disclaimer, the term of this patent is extended or adjusted under 35 U.S.C. 154(b) by 0 days.

(21) Appl. No.: 17/685,545

(22) Filed: Mar. 3, 2022

(65) Prior Publication Data

US 2023/0277012 A1 Sep. 7, 2023

(51) Int. Cl.
*A47K 3/28* (2006.01)
*A47B 49/00* (2006.01)

(52) U.S. Cl.
CPC ..... *A47K 3/281* (2013.01); *A47B 49/004* (2013.01)

(58) Field of Classification Search
CPC ..... A47B 49/004; A47B 57/26; A47B 81/00; A47B 96/1425; A47K 3/281; A47K 2201/00; A47F 5/08
See application file for complete search history.

(56) References Cited

U.S. PATENT DOCUMENTS 424,610 A 4/1890 Laurence
453,631 A 6/1891 Farley
468,987 A 2/1892 Henry
519,840 A 5/1894 Edsall
666,467 A 1/1901 Clark
938,883 A 11/1909 Maier
961,352 A 6/1910 Walters
1,062,478 A 5/1913 Kroder
1,374,026 A 4/1921 Nelson
1,401,727 A 12/1921 Pimlott
1,425,247 A 8/1922 Galbreath
1,679,881 A 10/1925 Simpson
1,639,551 A 8/1927 Booth
1,742,164 A 12/1929 Berke
1,756,716 A 4/1930 Whitney
(Continued)

FOREIGN PATENT DOCUMENTS

CH 625601 9/1981
DE 327136 10/1920
(Continued)

OTHER PUBLICATIONS

Artika Shower Caddy—Odyssey 2 Instruction Manual (PO-22046), Publicly available for purchase before May 18, 2020, 5 pages.
(Continued)

*Primary Examiner* — Ko H Chan
(74) *Attorney, Agent, or Firm* — Fitch, Even, Tabin & Flannery LLP

(57) ABSTRACT

There is provided an endcap, connector, sleeve, and rod system lock designs that can be used to form a customizable shower caddy. The endcap can freely spin without axial movement. The connectors can support product holders at different positions along an extendable rod system. The sleeve can securely connect two rods together. The rod system lock provides a more secure connection between rods of the rod system to easily and reliably lock the rods to their desired combined length.

11 Claims, 67 Drawing Sheets

(56) References Cited

U.S. PATENT DOCUMENTS 1,837,340 A 12/1931 Schwartz
1,910,555 A 5/1933 Marlowe
1,951,660 A 3/1934 Klaudt
2,032,842 A 3/1936 Gould
2,199,851 A 5/1940 Culver
2,275,330 A 3/1942 Tveten
2,293,168 A 8/1942 Pirone
2,355,489 A 8/1944 Waddell
2,490,369 A 12/1949 Neuwirth
2,508,039 A 5/1950 Neuwirth
2,542,967 A * 2/1951 Waechter ..... F16B 7/1445 403/368
2,637,555 A 5/1953 Klaudt
2,643,143 A 6/1953 Bergqvist
2,661,850 A 12/1953 Fowler et al.
2,695,800 A 11/1954 Soucy
2,696,963 A * 12/1954 Shepherd ..... A61M 5/1417 24/339
2,716,533 A 8/1955 Freeman
2,840,402 A 6/1958 Hassel
2,903,141 A 9/1959 Seewack
2,935,299 A * 5/1960 Jansen ..... E04C 5/122 411/262
2,947,556 A 8/1960 Wenger
2,974,806 A 3/1961 Seewack
2,999,706 A 9/1961 Wilcox
3,004,743 A 10/1961 Wenger
3,031,215 A * 4/1962 Vance ..... F21V 21/14 248/124.2
3,040,902 A 6/1962 Dunn
3,083,041 A * 3/1963 Owenmark ..... F16L 27/1274 285/302
3,098,669 A 7/1963 Fortin
3,227,113 A 1/1966 Kupski
3,333,808 A 8/1967 Du Boff
3,424,111 A 1/1969 Maslow
3,515,417 A * 6/1970 Bowman ..... F16C 27/02 403/372
3,559,352 A 2/1971 Magnuson
3,560,032 A 2/1971 Cohen et al.
3,572,511 A * 3/1971 Triplett ..... F16B 9/054 211/105.6
3,633,862 A 1/1972 Breen
3,674,294 A 7/1972 Kirkham
3,788,489 A 1/1974 Levinthal
3,809,142 A 5/1974 Bleeker
3,851,601 A 12/1974 Davis
3,932,048 A * 1/1976 DuPont ..... F16B 12/40 403/295
3,951,269 A 4/1976 Anderson
3,961,822 A * 6/1976 Daniel ..... A47C 16/025 211/105.6
4,024,686 A 5/1977 Gronert
4,128,064 A 12/1978 Chung
4,134,703 A 1/1979 Hinners
4,248,418 A 2/1981 Friedberg
4,390,099 A 6/1983 Trautlein
4,405,111 A 9/1983 Lennon
4,419,026 A 12/1983 Leto
4,422,794 A 12/1983 Deken
4,506,477 A 3/1985 Castle
4,629,207 A 12/1986 Shiflet
4,636,106 A * 1/1987 Waisbrod ..... F16C 27/02 403/228
4,653,714 A 3/1987 Andrasko, Jr.
4,700,918 A 10/1987 Andrasko, Jr.
4,757,641 A * 7/1988 Penrod ..... A47G 7/044 248/315
4,765,001 A 8/1988 Smith
4,856,929 A 8/1989 Smahlik
4,895,471 A 1/1990 Geltz
4,991,344 A * 2/1991 Carney ..... F16M 11/42 248/188.1
4,998,731 A 3/1991 Bowen
5,022,104 A 6/1991 Miller
5,054,624 A 10/1991 Camp
D324,328 S 3/1992 Pagan
5,094,418 A * 3/1992 McBarnes, Jr. ..... A61G 7/0503 248/308
D327,421 S 6/1992 Pagan
5,156,281 A 10/1992 Schwartz
5,242,065 A 9/1993 Hoban
5,259,520 A 11/1993 Roggio
5,303,832 A 4/1994 Tu
5,317,855 A 6/1994 De Leeuw
5,330,061 A 7/1994 Geltz
5,333,665 A 8/1994 Safar
5,433,551 A 7/1995 Gordon
5,549,407 A 8/1996 Levi
5,615,721 A 4/1997 Winter
5,653,057 A 8/1997 Gary
5,678,703 A 10/1997 Sawyer
5,681,017 A * 10/1997 Clausen ..... F16M 11/2014 248/200.1
5,702,010 A 12/1997 Liang
5,758,545 A * 6/1998 Fevre ..... F16C 29/002 384/42
D398,468 S 9/1998 Yemini
5,803,643 A 9/1998 Patelli
5,826,847 A 10/1998 Warner
5,881,653 A 3/1999 Pfister
5,894,610 A 4/1999 Winter
5,964,444 A 10/1999 Guertler
5,996,674 A 12/1999 Gatewood
5,996,791 A 12/1999 Bibby
6,010,017 A 1/2000 Michaelis
D421,692 S 3/2000 Wojtowicz
6,062,149 A 5/2000 Duvivier
D429,934 S 8/2000 Hofman
6,213,437 B1 4/2001 Robbins
D443,162 S 6/2001 Winter
D443,813 S 6/2001 Harwanko
6,250,839 B1 6/2001 Lenhart
6,286,282 B1 9/2001 Castano
D450,947 S 11/2001 Walker
6,354,629 B1 * 3/2002 McNeal ..... A63C 11/221 280/820
D456,167 S 4/2002 Harwanko
6,443,207 B1 9/2002 Cheng
6,467,989 B1 * 10/2002 Finkelstein ..... F16B 21/20 403/368
D466,798 S 12/2002 Rebman
D466,799 S 12/2002 Suero, Jr.
D470,332 S 2/2003 Clucas
6,520,351 B1 2/2003 Zadro
D472,453 S 4/2003 Rebman
6,543,629 B1 4/2003 Samelson
D475,551 S 6/2003 Kelso
D475,561 S 6/2003 Suero, Jr.
D475,562 S 6/2003 Suero, Jr.
6,575,316 B2 6/2003 Lin
6,581,790 B1 6/2003 Zadro
6,637,364 B1 10/2003 Campeau
6,640,867 B1 11/2003 Pallotta
6,651,831 B2 11/2003 Samelson
D483,251 S 12/2003 Suero, Jr.
6,681,831 B1 1/2004 Cheng
D491,448 S 6/2004 Rebman
6,761,202 B1 7/2004 Cheng
D494,052 S 8/2004 Winter
D494,455 S 8/2004 Winter
D494,845 S 8/2004 Winter
6,823,925 B2 11/2004 Militello
6,824,000 B2 11/2004 Samelson
D499,329 S 12/2004 Suero, Jr.
D500,670 S 1/2005 Rebman
6,845,955 B1 1/2005 Hsu
D501,737 S 2/2005 Clucas
D501,738 S 2/2005 Clucas
6,862,776 B2 3/2005 Chen
6,865,817 B2 3/2005 Militello
D504,310 S 4/2005 Harwanko
D504,807 S 5/2005 Harwanko

(56) References Cited

U.S. PATENT DOCUMENTS

D505,062 S 5/2005 Suero, Jr.
D505,317 S 5/2005 Harwanko
D507,129 S 7/2005 Harwanko
6,948,545 B1 9/2005 Cheng
6,959,752 B2 11/2005 Huang
6,962,186 B2 11/2005 Hsu
6,966,353 B2 11/2005 Hsu
D513,142 S 12/2005 Suero, Jr.
D513,373 S 1/2006 Harwanko
6,994,143 B2 2/2006 McCarty
7,000,521 B1 2/2006 Cheng
7,000,787 B2 2/2006 Felsenthal
D516,902 S 3/2006 Harwanko
D522,844 S 6/2006 Harwanko
D522,845 S 6/2006 Suero, Jr.
D522,846 S 6/2006 Suero, Jr.
D522,847 S 6/2006 Suero, Jr.
D525,115 S 7/2006 Harwanko
D525,813 S 8/2006 Beasley
D526,520 S 8/2006 Clucas
D527,246 S 8/2006 Clucas
7,128,124 B2 10/2006 Bibby
D534,793 S 1/2007 Suero, Jr.
D538,571 S 3/2007 Militello
D539,064 S 3/2007 Militello
7,194,811 B2 3/2007 Militello
7,195,051 B2 3/2007 Nien
D542,897 S 5/2007 Harwanko
D543,747 S 6/2007 Harwanko
D543,748 S 6/2007 Harwanko
D544,786 S 6/2007 Barrese
D545,180 S 6/2007 Harwanko
7,225,850 B2 6/2007 McCarty
D547,165 S 7/2007 Barrese
D547,166 S 7/2007 Barrese
D547,167 S 7/2007 Barrese
D548,574 S 8/2007 Harwanko
7,255,149 B2 8/2007 Rossato
7,255,312 B2 8/2007 Melic
7,264,035 B2 9/2007 Rossato
D562,608 S 2/2008 Kramer
D562,609 S 2/2008 Kramer
7,331,370 B1 2/2008 Militello
D563,136 S 3/2008 Kramer
D563,138 S 3/2008 Kramer
7,341,230 B2 3/2008 Beaudry
7,346,940 B1 3/2008 Liao
D566,991 S 4/2008 Harwanko
D568,656 S 5/2008 Kramer
D569,149 S 5/2008 Walker
D569,668 S 5/2008 Kramer
D571,136 S 6/2008 Kramer
D573,386 S 7/2008 Clucas
D573,387 S 7/2008 Walker
D576,475 S 9/2008 Didehvar
D576,476 S 9/2008 Didehvar
D586,647 S 2/2009 Didehvar
7,510,152 B2 3/2009 Melic
D591,142 S 4/2009 Cittadino
7,549,615 B2 6/2009 Shevick
7,562,689 B1 7/2009 Militello
7,600,549 B2 10/2009 Cheng
7,641,161 B2 1/2010 Bauer
7,658,154 B2 2/2010 Yankello
7,665,500 B2 2/2010 Rossato
7,699,276 B2 4/2010 Melic
7,726,898 B2 6/2010 Lenhart
7,819,166 B2 10/2010 Militello
D628,000 S 11/2010 Lindo
7,857,151 B2 12/2010 Barrese
D632,513 S 2/2011 Cittadino
D632,514 S 2/2011 Didehvar
D632,515 S 2/2011 Cittadino
7,877,824 B2 2/2011 Grant
D633,780 S 3/2011 Barrese
D635,807 S 4/2011 Lindo
7,926,127 B2 4/2011 Barrese
7,931,160 B2 4/2011 Newbouild
D640,488 S 6/2011 Didehvar
D641,190 S 7/2011 Cittadino
D641,191 S 7/2011 Walker
D641,193 S 7/2011 Vaccaro
D641,194 S 7/2011 Vaccaro
7,984,814 B2 7/2011 Didehvar
D643,236 S 8/2011 Cittadino
D643,657 S 8/2011 Cittadino
D644,050 S 8/2011 Cittadino
7,997,428 B2 8/2011 Goldstein
D647,391 S 10/2011 Barrese
D648,969 S 11/2011 Cittadino
D649,352 S 11/2011 Cittadino
8,056,873 B1 11/2011 Hanely
D650,263 S 12/2011 Barrese
8,069,507 B2 12/2011 Didehvar
8,069,632 B2 12/2011 Li
8,069,999 B2 12/2011 Didehvar
D652,236 S 1/2012 Walker
D652,237 S 1/2012 Cittadino
D653,067 S 1/2012 Cittadino
8,104,729 B2 * 1/2012 Walke ..... A61G 12/002 248/580
8,113,361 B2 2/2012 Winter
8,152,118 B2 * 4/2012 Melic ..... E04G 21/3233 248/200.1
8,157,111 B2 4/2012 Didehvar
D660,064 S 5/2012 Webb
D660,065 S 5/2012 Webb
D660,066 S 5/2012 Webb
8,166,583 B1 5/2012 Liang
8,185,981 B2 5/2012 Didehvar
D661,529 S 6/2012 Cittadino
D661,927 S 6/2012 Cittadino
D664,423 S 7/2012 Cittadino
D664,424 S 7/2012 Cittadino
8,214,938 B2 7/2012 Hanley
8,215,501 B2 7/2012 Trettin
8,215,863 B2 7/2012 Sohn
8,225,946 B2 7/2012 Yang
D666,012 S 8/2012 Walker
D667,246 S 9/2012 Cittadino
D667,295 S 9/2012 Harwanko
8,297,870 B2 10/2012 Lenhart
D670,521 S 11/2012 Cittadino
D670,522 S 11/2012 Cittadino
D670,944 S 11/2012 Cittadino
D671,347 S 11/2012 Cittadino
D671,348 S 11/2012 Cittadino
D671,395 S 11/2012 Harwanko
8,302,919 B1 * 11/2012 McGrath ..... F16M 11/24 248/398
D672,178 S 12/2012 Walker
D672,990 S 12/2012 Lindo
D672,991 S 12/2012 Cittadino
8,341,775 B2 1/2013 Didehvar
8,347,936 B2 1/2013 Martin
8,348,072 B2 1/2013 Whitehall
8,403,430 B2 * 3/2013 Atkins ..... A47F 10/06 312/137
8,408,405 B2 4/2013 Yang
D681,422 S 5/2013 Lindo
D681,423 S 5/2013 Walker
D684,037 S 6/2013 Harwanko
8,479,932 B2 7/2013 Carney
8,491,568 B2 7/2013 Schertiger
8,500,357 B2 8/2013 Stahle
8,505,129 B2 8/2013 Parker
D691,029 S 10/2013 Didehvar
D691,030 S 10/2013 Lindo
D691,031 S 10/2013 Harwanko
8,544,661 B1 10/2013 Melino, Sr.
8,561,667 B1 10/2013 Hanley
D693,209 S 11/2013 Walker
8,573,416 B2 11/2013 Didehvar
8,578,995 B2 11/2013 Nelson

(56) References Cited

U.S. PATENT DOCUMENTS

| | | | | |
|---|---|---|---|---|
| 8,585,160 | B2 * | 11/2013 | Atkins | A47F 10/06 312/137 |
| D696,573 | S | 12/2013 | Didehvar | |
| 8,616,138 | B1 | 12/2013 | Fu | |
| D702,112 | S | 4/2014 | Cittadino | |
| 8,696,229 | B2 | 4/2014 | Tran | |
| 8,763,821 | B2 | 7/2014 | Yang | |
| 8,763,822 | B2 | 7/2014 | Didehvar | |
| 8,807,513 | B2 | 8/2014 | Volin | |
| 8,814,114 | B2 | 8/2014 | Baines | |
| 8,827,587 | B2 | 9/2014 | Didehvar | |
| 8,839,980 | B2 | 9/2014 | Baines | |
| D714,571 | S | 10/2014 | Walker | |
| 8,851,305 | B2 | 10/2014 | Didehvar | |
| 8,851,435 | B1 | 10/2014 | Bastien | |
| 8,869,999 | B2 | 10/2014 | Lindo | |
| 8,875,770 | B1 | 11/2014 | Martin | |
| 8,960,456 | B2 | 2/2015 | Didehvar | |
| 8,978,228 | B2 | 3/2015 | Didehvar | |
| 9,009,878 | B2 | 4/2015 | Baines | |
| 9,021,627 | B2 | 5/2015 | Parker | |
| 9,033,163 | B2 | 5/2015 | Hsu | |
| 9,066,637 | B2 | 6/2015 | Zeng | |
| 9,107,495 | B2 | 8/2015 | Lindo | |
| 9,107,496 | B2 | 8/2015 | Lindo | |
| 9,107,529 | B2 | 8/2015 | Didehvar | |
| 9,107,544 | B2 | 8/2015 | Cittadino | |
| 9,131,795 | B2 | 9/2015 | Didehvar | |
| 9,161,664 | B2 | 10/2015 | Zeng | |
| 9,181,967 | B2 | 11/2015 | Lim | |
| 9,194,415 | B2 | 11/2015 | Ou | |
| 9,204,764 | B1 | 12/2015 | Hanley | |
| D746,667 | S | 1/2016 | Vaccaro | |
| 9,271,592 | B2 | 3/2016 | Didehvar | |
| 9,339,151 | B2 | 5/2016 | Yang | |
| 9,357,860 | B1 | 6/2016 | Klowan | |
| 9,388,837 | B1 | 7/2016 | Hanley | |
| 9,468,294 | B2 | 10/2016 | Fu | |
| 9,474,421 | B2 | 10/2016 | Baines | |
| 9,480,314 | B2 | 11/2016 | Heim | |
| 9,578,995 | B2 | 2/2017 | Hanley | |
| 9,693,660 | B1 | 7/2017 | Stelmarski | |
| 9,770,138 | B2 | 9/2017 | Engell | |
| 9,808,125 | B2 | 11/2017 | Jepson | |
| 9,883,742 | B2 | 2/2018 | Yang | |
| 9,943,192 | B2 | 4/2018 | Yang | |
| 9,999,322 | B2 | 6/2018 | Hain | |
| 10,016,077 | B1 * | 7/2018 | Carney | A47G 7/044 |
| 10,034,587 | B1 | 7/2018 | Elliot | |
| 10,047,787 | B2 | 8/2018 | Cheng | |
| 10,064,523 | B2 | 9/2018 | Engell | |
| 10,070,748 | B2 | 9/2018 | Hanley | |
| 10,092,126 | B2 | 10/2018 | Baines | |
| 10,278,529 | B2 | 5/2019 | Baines | |
| 10,422,470 | B2 | 9/2019 | Cote | |
| 10,426,287 | B1 | 10/2019 | Tsai | |
| 10,463,199 | B2 | 11/2019 | Coratolo | |
| 10,485,383 | B2 | 11/2019 | Worden, IV | |
| 10,595,683 | B1 | 3/2020 | Stelmarski | |
| 10,612,576 | B2 | 4/2020 | Hanley | |
| 10,758,091 | B2 | 9/2020 | Engell | |
| 10,786,105 | B2 | 9/2020 | Scanlon | |
| 10,844,890 | B2 | 11/2020 | Daniels | |
| 10,925,403 | B1 | 2/2021 | Su | |
| 10,959,559 | B2 | 3/2021 | Moss | |
| 10,995,786 | B2 | 5/2021 | Didehvar | |
| 11,116,324 | B2 * | 9/2021 | Leng | A47C 19/028 |
| 11,382,447 | B2 | 7/2022 | Berman | |
| 2002/0158033 | A1 | 10/2002 | Chen | |
| 2003/0209509 | A1 | 11/2003 | Felsenthal | |
| 2004/0182806 | A1 | 9/2004 | Figueroa | |
| 2004/0228704 | A1 | 11/2004 | Rotshtain | |
| 2005/0263655 | A1 | 12/2005 | Bauer | |
| 2006/0156465 | A1 | 7/2006 | Lavi | |
| 2006/0204322 | A1 | 9/2006 | Roiser | |
| 2007/0170134 | A1 | 7/2007 | Bishop | |
| 2008/0163418 | A1 | 7/2008 | Barrese | |
| 2009/0184078 | A1 | 7/2009 | Lee | |
| 2009/0223642 | A1 | 9/2009 | Militello | |
| 2009/0223917 | A1 | 9/2009 | Grant | |
| 2010/0206492 | A1 | 8/2010 | Shevick | |
| 2010/0310306 | A1 | 12/2010 | Wright | |
| 2010/0316438 | A1 | 12/2010 | Sohn | |
| 2011/0226925 | A1 | 9/2011 | Tsai | |
| 2011/0284484 | A1 | 11/2011 | Lin | |
| 2011/0297632 | A1 | 12/2011 | Goldstein | |
| 2012/0005823 | A1 | 1/2012 | Baines | |
| 2012/0017366 | A1 | 1/2012 | Barrese | |
| 2012/0103924 | A1 | 5/2012 | Chuang | |
| 2012/0152872 | A1 | 6/2012 | Didehvar | |
| 2012/0152873 | A1 | 6/2012 | Didehvar | |
| 2012/0152874 | A1 | 6/2012 | Didehvar | |
| 2012/0217215 | A1 | 8/2012 | Emery | |
| 2012/0241399 | A1 | 9/2012 | Trettin | |
| 2012/0284914 | A1 | 11/2012 | Bauer | |
| 2012/0285914 | A1 | 11/2012 | Carney | |
| 2013/0045041 | A1 | 2/2013 | Sohn | |
| 2013/0047331 | A1 | 2/2013 | Parker | |
| 2013/0112639 | A1 | 5/2013 | Baines | |
| 2013/0198948 | A1 | 8/2013 | Zeng | |
| 2013/0198949 | A1 | 8/2013 | Hai | |
| 2013/0200024 | A1 | 8/2013 | Lindo | |
| 2013/0306828 | A1 | 11/2013 | Volin | |
| 2013/0334156 | A1 | 12/2013 | Baines | |
| 2013/0341474 | A1 | 12/2013 | Baines | |
| 2014/0124598 | A1 | 5/2014 | Vaccaro | |
| 2014/0130331 | A1 | 5/2014 | Didehvar | |
| 2014/0131298 | A1 | 5/2014 | Didehvar | |
| 2014/0131299 | A1 | 5/2014 | Didehvar | |
| 2014/0166603 | A1 | 6/2014 | Baines | |
| 2014/0224754 | A1 | 8/2014 | Baines | |
| 2014/0263123 | A1 | 9/2014 | Ford | |
| 2014/0360959 | A1 | 12/2014 | Didehvar | |
| 2014/0360960 | A1 | 12/2014 | Didehvar | |
| 2015/0034581 | A1 | 2/2015 | Hsu | |
| 2015/0265086 | A1 | 9/2015 | Hanley | |
| 2015/0285286 | A1 | 10/2015 | Sanford | |
| 2015/0297038 | A1 | 10/2015 | Vaccaro | |
| 2016/0113447 | A1 | 4/2016 | Walker | |
| 2016/0206126 | A1 | 7/2016 | Ford | |
| 2016/0374518 | A1 | 12/2016 | Baines | |
| 2017/0360261 | A1 | 12/2017 | Coratolo | |
| 2018/0008101 | A1 | 1/2018 | Engell | |
| 2018/0014680 | A1 | 1/2018 | Hanley | |
| 2018/0020880 | A1 | 1/2018 | Patterson | |
| 2018/0051739 | A1 | 2/2018 | Cheng | |
| 2018/0064279 | A1 | 3/2018 | Hanley | |
| 2018/0098656 | A1 | 4/2018 | Baines | |
| 2018/0296018 | A1 | 10/2018 | Baines | |
| 2018/0306219 | A1 | 10/2018 | Hanley | |
| 2019/0082875 | A1 | 3/2019 | Scanlon | |
| 2019/0099034 | A1 | 4/2019 | Hanley | |
| 2020/0281389 | A1 | 9/2020 | Moss | |
| 2021/0030187 | A1 | 2/2021 | Berman | |
| 2021/0177183 | A1 | 6/2021 | Moss | |
| 2021/0244200 | A1 | 8/2021 | Webb | |
| 2021/0353053 | A1 | 11/2021 | Berman | |
| 2022/0160158 | A1 | 5/2022 | Scanlon | |
| 2022/0225762 | A1 | 7/2022 | Berman | |
| 2022/0265075 | A1 | 8/2022 | Berman | |
| 2023/0337846 | A1 | 10/2023 | Moss | |
| 2023/0404310 | A1 | 12/2023 | Berman | |

FOREIGN PATENT DOCUMENTS

| | | |
|---|---|---|
| DE | 1046998 | 12/1958 |
| DE | 3518106 | 11/1986 |
| DE | 29720821 | 2/1998 |
| DE | 29807681 | 7/1998 |
| DE | 102008036149 | 6/2010 |
| DE | 202019106467 | 12/2019 |
| EP | 0314357 | 5/1989 |
| EP | 2113674 | 11/2009 |
| FR | 382527 | 2/1908 |

(56) References Cited

FOREIGN PATENT DOCUMENTS

| | | |
|---|---|---|
| FR | 474169 | 2/1915 |
| FR | 718486 | 1/1932 |
| WO | 2016122378 | 8/2016 |

OTHER PUBLICATIONS

Artika Tension Shower Caddy with Mirror in Aluminum, <https://www.homedepot.com/p/ARTIKA-Tension-Shower-Caddy-with-Mirror-in-Aluminum-ATL58-C1/302023780>, Publicly available for purchase before May 18, 2020, 2 pages.
Better Homes & Gardens Tension Pole Shower Caddy, <https://www.walmart.com/ip/Better-Homes-Gardens-Tension-Pole-Shower-Caddy-Oil-Rubbed-Bronze/900634206>, Publicly available for purchase before May 18, 2020, 3 pages.
Better Homes & Gardens, Model 2147HBWM (Oil Rubbed Bronze) Instruction Manual, Dec. 13, 2017, 10 pages.
Glacier Bay L Style Tension Pole Shower Caddy in Bronze with 4-Shelves (1002928650), <https://www.homedepot.com/p/Glacier-Bay-L-Style-Tension-Pole-Shower-Caddy-in-Bronze-with-4-Shelves-2130HBHD/303838532?NCNI-5>, Publicly available for purchase before May 18, 2020, 3 pages.
Glacier Bay Rustproof Tension Pole Shower Caddy in Satin Chrome (1002928717), <https://www.homedepot.com/p/Glacier-Bay-Rustproof-Tension-Pole-Shower-Caddy-in-Satin-Chrome-2141ALHD/303880494>, Publicly available for purchase before May 18, 2020, 2 pages.
InterDesign 4 Tier Tension Caddy, <https://www.kohls.com/product/prd-3451054/interdesign-4-tier-tension-caddy.jsp>, Publicly available for purchase before May 18, 2020, 1 page.
Kenney Gray 4-Tier Tension Pole Shower Caddy, <https://www.biglots.com/product/gray-4-tier-tension-pole-shower-caddy/p810196875>, Publicly available for purchase before May 18, 2020, 2 pages.
Kenney Instruction Manual, Kenney Manufacturing Company, Publicly available for purchase before May 18, 2020, 4 pages.
Made by Design (Target) Pole Caddy Instruction Manual, Style #91830 (Aluminum), 2019, 17 pages.
Made by Design L-Shaped Tension Pole Caddy Chrome, <https://www.target.com/p/steel-l-shaped-tension-pole-caddy-chrome-made-by-design-8482/-/A-54154453#lnk=sametab>, Publicly available for purchase before May 18, 2020, 3 pages.
Made by Design Rustproof Aluminum Tension Pole Caddy Chrome, <https://www.target.com/p/rustproof-aluminum-tension-pole-caddy-chrome-made-by-design-8482/-/A-54154994#lnk=sametab>, Publicly available for purchase before May 18, 2020, 3 pages.
Made by Design Steel Corner Pole Caddy, <https://www.target.com/p/steel-corner-pole-caddy-made-by-design-153/-/A-54513380?preselect=54149567#lnk=sametab>, Publicly available for purchase before May 18, 2020, 3 pages.
Mainstays Tension Pole Shower Caddy, <https://www.walmart.com/ip/Mainstays-Tension-Pole-Shower-Caddy-Chrome/700323962>, Publicly available for purchase before May 18, 2020, 2 pages.
Mainstays, 3-Tier Tension Pole Shower Caddy, <https://www.walmart.com/ip/Mainstays-3-Tier-Tension-Pole-Shower-Caddy-Satin-Nickel/634266997>, Publicly available for purchase before May 18, 2020, 3 pages.
Org 3-Tier Pole Caddy, <https://www.bedbathandbeyond.com/store/product/org-3-tier-pole-caddy/3317048?keyword=org-shower-caddy>, Publicly available for purchase before May 18, 2020, 2 pages.
Oxo 4-Tier Anodized Aluminum Tension Pole Shower Caddy, <https://www.bedbathandbeyond.com/store/product/oxo-4-tier-anodized-aluminum-tension-pole-shower-caddy/5193005>, Publicly available for purchase before May 18, 2020, 2 pages.
Oxo Good Grips Quick-Extend Aluminum Pole Caddy (13241500) Instruction Manual, Oxo Good Grips, Publicly available for purchase before May 18, 2020, 2 pages.
Photographs of end cap by Zenith Products Corporation, publicly available before Mar. 8, 2019 (5 pages).
Pictures of Better Homes & Gardens, Smart Rods Ball Adjustable Drapery Rod, Oil-Rubbed Bronze Finish and Instructions (with English translation), known to be publicly available before Mar. 15, 2018 but not before Sep. 16, 2015, 18 pages.
Product 1—Pictures of an Adjustable Rod, publicly available before Mar. 8, 2019, 1 page.
Product 2—Pictures of an Adjustable Rod, publicly available before Mar. 8, 2019, 1 page.
Product 3—Pictures of an Adjustable Rod, publicly available before Mar. 8, 2019, 1 page.
Product 4—Pictures of an Adjustable Rod, publicly available before Mar. 8, 2019, 2 pages.
Product 5—Pictures of an Adjustable Rod, publicly available before Mar. 8, 2019, 1 page.
Product 6—Pictures of an Adjustable Rod, publicly available before Mar. 8, 2019, 1 page.
Product 7—Pictures of an Adjustable Rod, publicly available before Mar. 8, 2019, 2 pages.
Salt Steel 3-Tier Pole Shower Caddy in Sterling, <https://www.bedbathandbeyond.com/store/product/salt-steel-3-tier-pole-shower-caddy-in-sterling/5023377?keyword=salt-shower-caddy>, Publicly available for purchase before May 18, 2020, 2 pages.
SimpleHuman Stainless Steel Tension Pole Shower Caddy, <https://www.containerstore.com/s/bath/shower-bathtub/simplehuman-stainless-steel-tension-pole-shower-caddy/12d?productId=10028454&gclid=CjwKCAiAgc-ABhA7EiwAjev-j2IPg4hrYl4NADnrmdkklYKinu_0IYYHUbHezs4dVsjeVL2-kaSQSBoCjdcQAvD_BWE>, Publicly available for purchase before May 18, 2020, 1 pages.
Titan Never Rust Premium Aluminum Tension Caddy in Satin Chrome, <https://www.bedbathandbeyond.com/store/product/titan-reg-never-rust-reg-premium-aluminum-tension-caddy-in-satin-chrome/5049773> Publicly available for purchase before May 18, 2020, 2 pages.
U.S. Appl. No. 16/877,084, entitled "Customizable Shower Caddy," filed Jun. 11, 2020.
Zenna Home Corner Pole Caddy Nickel, <https://www.target.com/p/corner-pole-caddy-nickel-zenna-home/-/A-79196668#Ilnk=sametab>, Publicly available for purchase before May 18, 2020, 5 pages.
Zenna Home L-Shaped Pole Caddy Nickel, <https://www.target.com/p/l-shaped-pole-caddy-nickel-zenna-home/-/A-79196669#lnk=sametab>, Publicly available for purchase before May 18, 2020, 2 pages.
Zenna Model 2149PC (Chrome) Instruction Manual, Zenith Products, Dec. 6, 2017, 10 pages.
Ikea Botaren Shower Curtain Tension rod Assembly Manual, Publically available for purchase before Jun. 15, 2023, 4 pages.
Picture of Ikea Botaren Shower Curtain Tension rod, Publically available for purchase before Jun. 15, 2023.
U.S. Appl. No. 18/389,502 entitled "Spring-Biased End Caps For Rod Assembly and Methods of Use," filed Dec. 13, 2023.

* cited by examiner

FIG. 21C
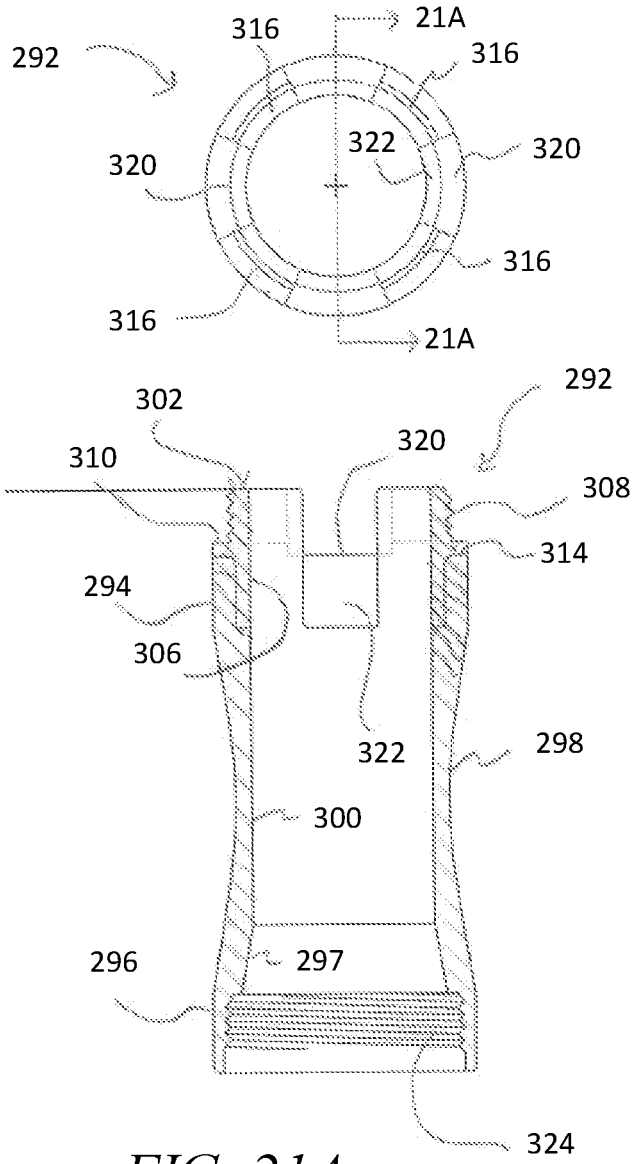
FIG. 21A
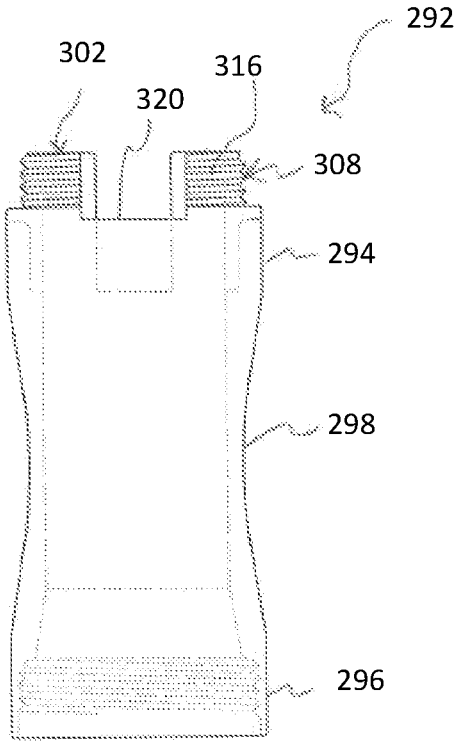
FIG. 21B

CUSTOMIZABLE SHOWER CADDY

FIELD

The subject matter relates to organizational units and, more particularly, to vertical standing organizational units.

BACKGROUND

Shower caddies are often used in showers to provide organized shelving for personal hygiene products, such as shampoo, conditioner and soap. Common shower caddies include a rod or rods that extend from the shower basin to the ceiling and are fixed in position by applying pressure on the basin and the ceiling. The rods support shelves along their extent. The shelving is used to support personal hygiene products for easy access.

One known shortcoming of common shower caddies is that they are not adjustable such that they can be placed in either a corner, along a side wall, or in the center of the shower enclosure. Another known shortcoming is that the shelves tend to slide down the rods and their position along the rods needs to be reset. As a result, the amount of weight the shelves are able to hold is limited without increasing the tendency of the shelves to slide down the rods.

Another known shortcoming with common tension poles, such as those used in shower caddies, is that the rods forming the tension pole are not connected tightly together and tend to become disconnected when moving the assembled pole to set it in a desired position. Common tension poles also tend to wobble due to the loose connection between the rods forming the tension pole.

BRIEF DESCRIPTION OF THE DRAWINGS

FIG. 21A is a cross-section view of a barrel body of the customizable shower caddy of FIG. 1 taken along line 21A-21A of FIG. 21C;

FIG. 21B is a side view of the barrel body of FIG. 21A;

FIG. 21C is a top plan view of the barrel body of FIG. 21A;

FIG. 39A top perspective view of a shelf according to another embodiment attached to the barrel connector of FIG. 36A;

DETAILED DESCRIPTION

Figure 1:
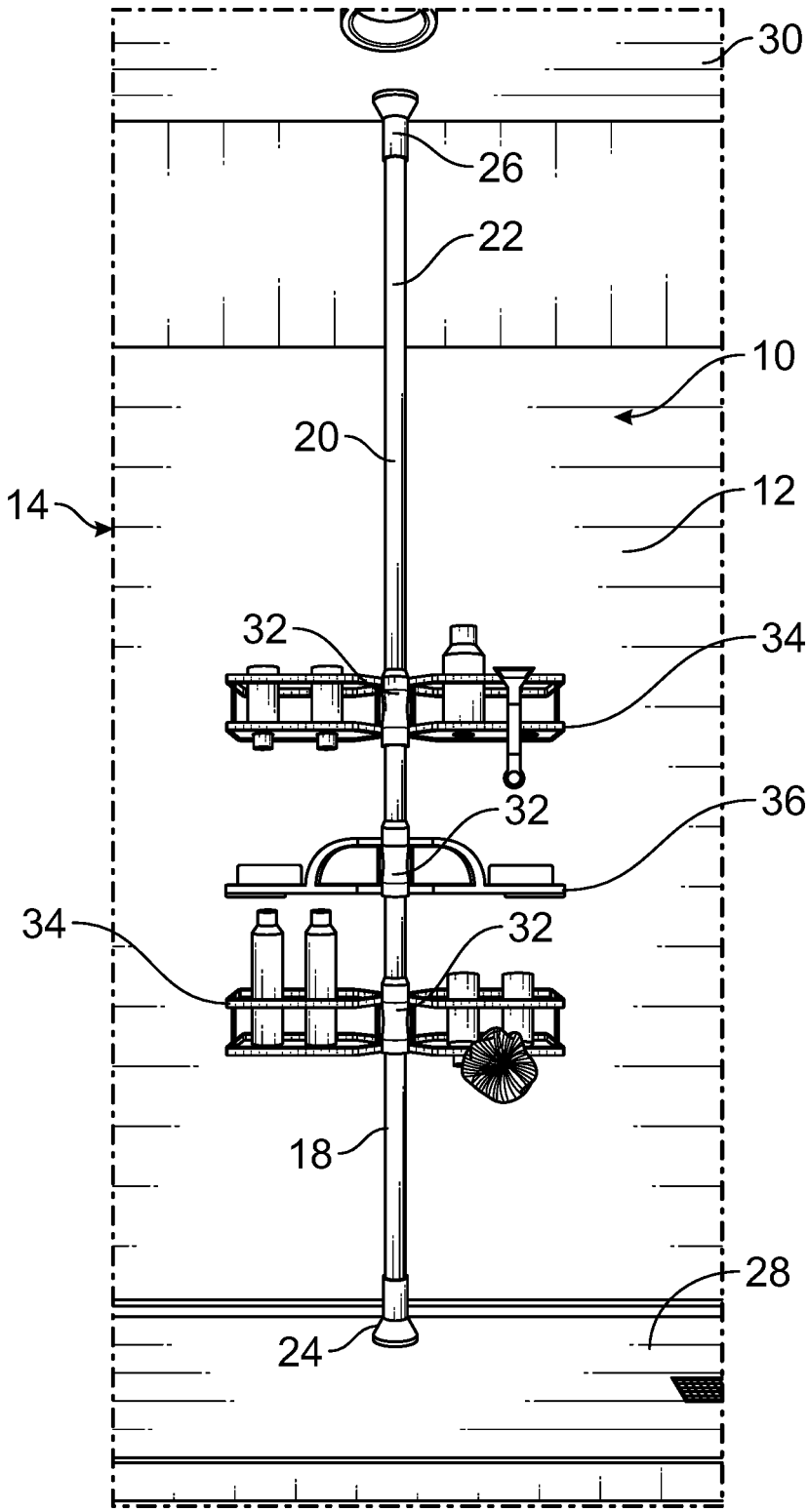
FIG. 1 is a perspective view of a customizable shower caddy shown in a first arrangement.
Figure 2:
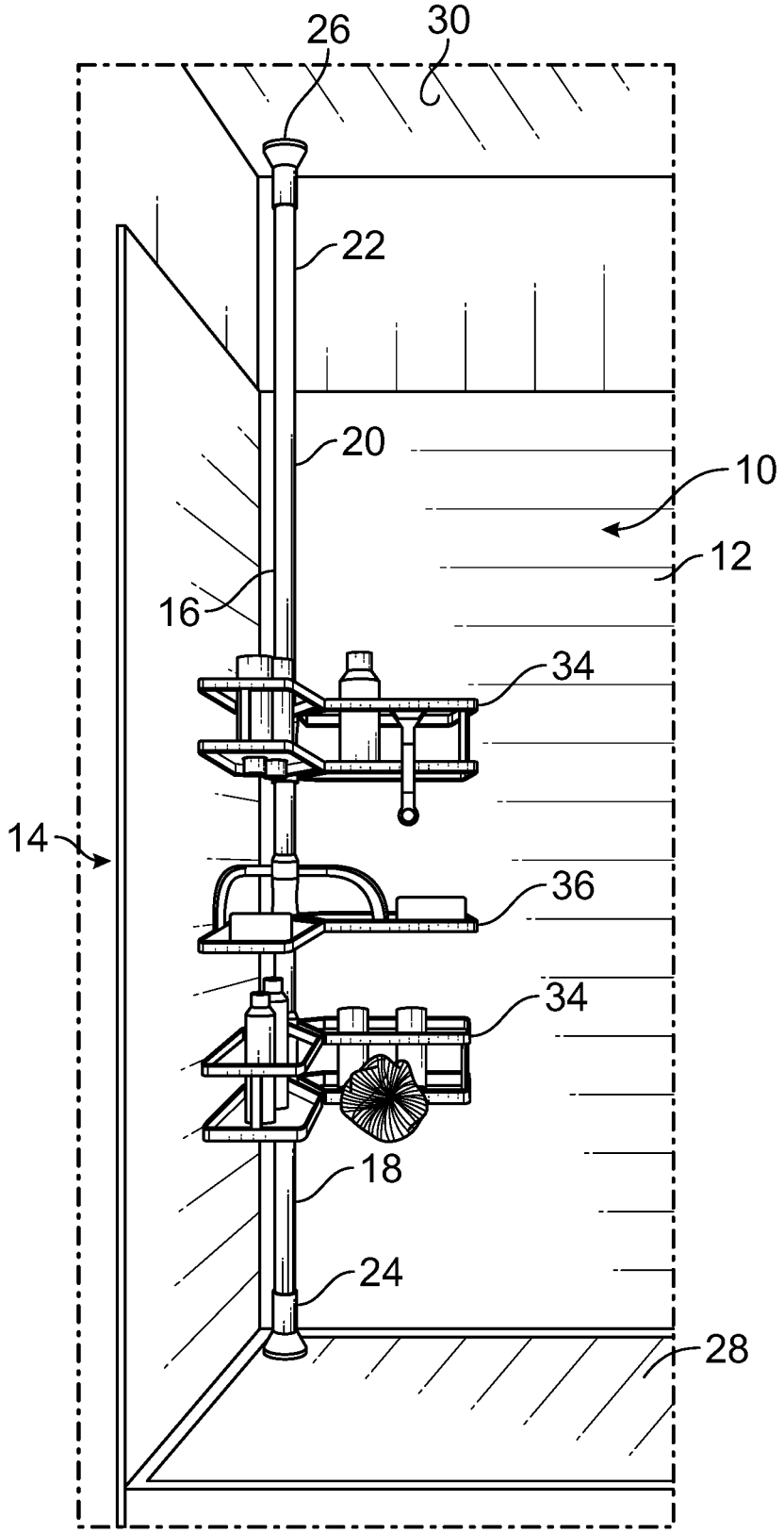
FIG. 2 is a perspective view of the customizable shower caddy of FIG. 1 shown in a second arrangement.
Figure 3:
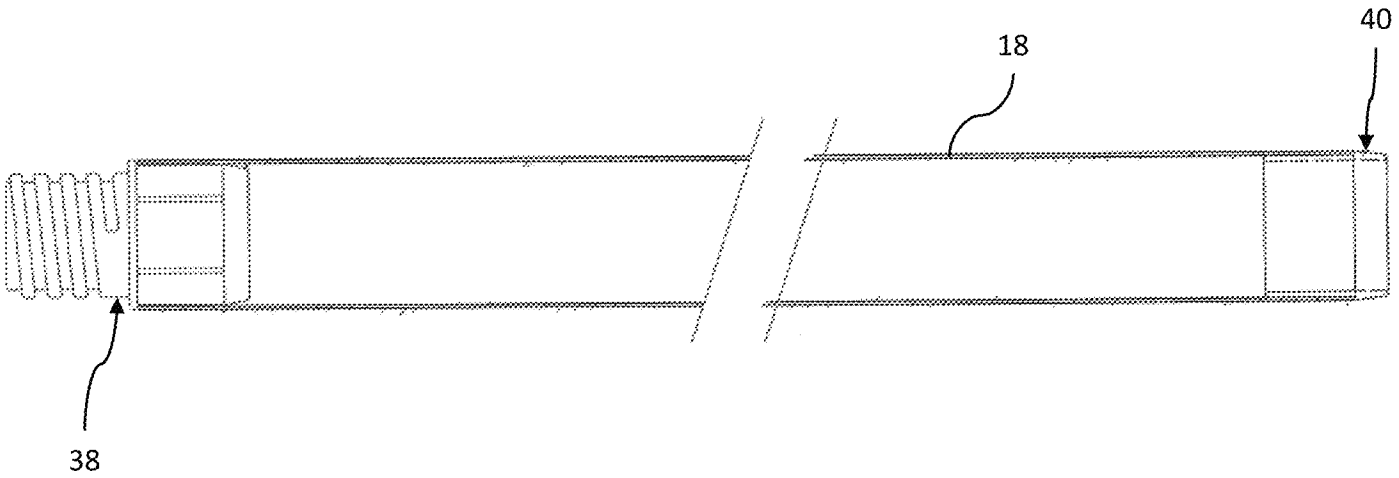
FIG. 3 is an elevational view of a main rod of the customizable shower caddy of FIG. 1.
Figure 4A:
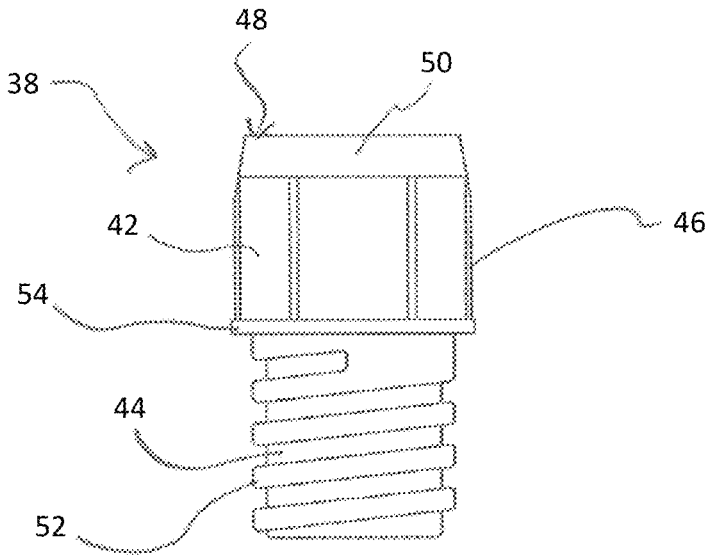
FIG. 4A is an side elevational view of an insert of the main rod of FIG. 3.
Figure 4B:
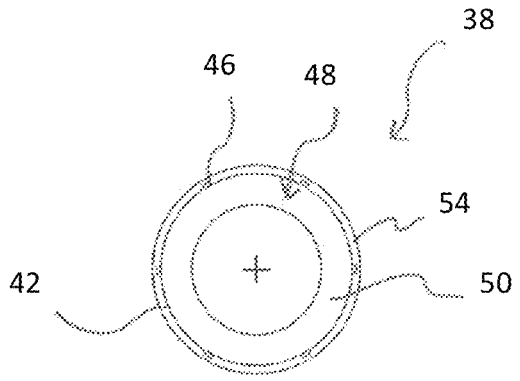
FIG. 4B is a top plan view of the insert of FIG. 4A.
Figure 5A:
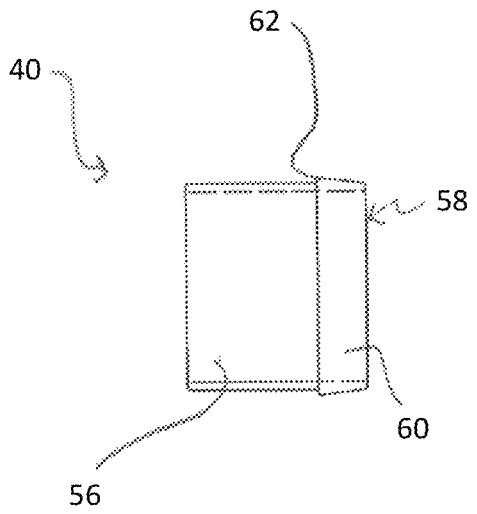
FIG. 5A is a side elevational view of a rod collar of the main rod of FIG. 3.
Figure 5B:
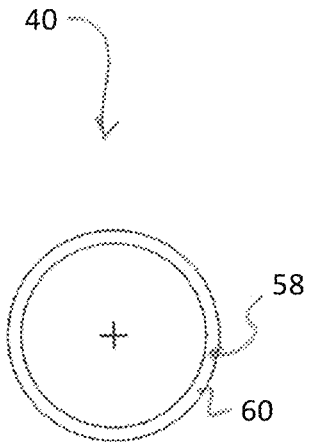
FIG. 5B is a top plan view of the rod collar of FIG. 5A.
Figure 6A:
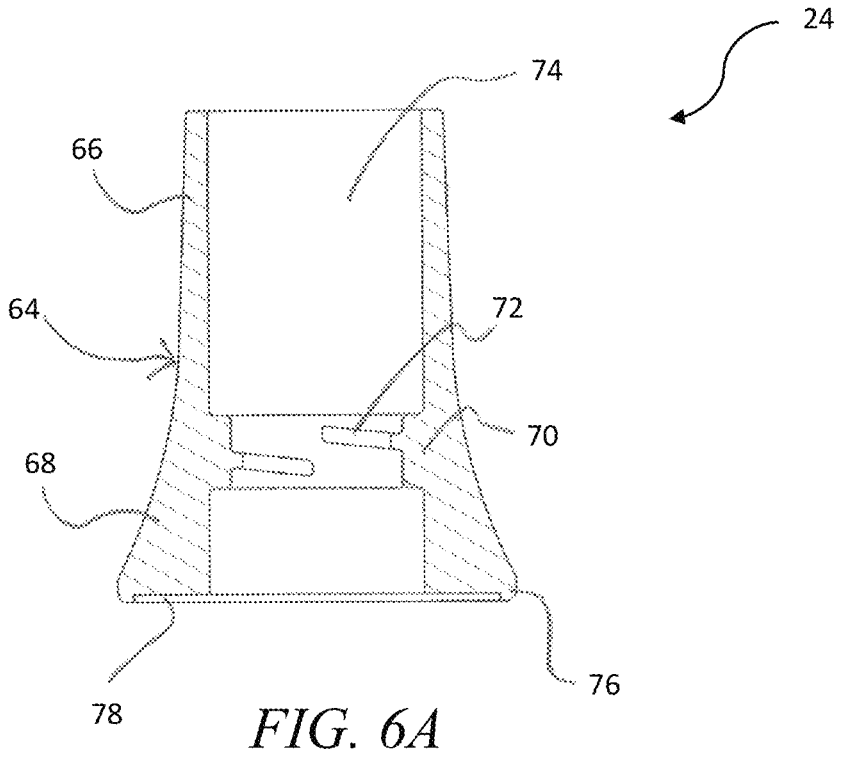
FIG. 6A is a cross-section view of a bottom end cap of the customizable shower caddy of FIG. 1 taken along 6A-6A of FIG. 6B.
Figure 6B:
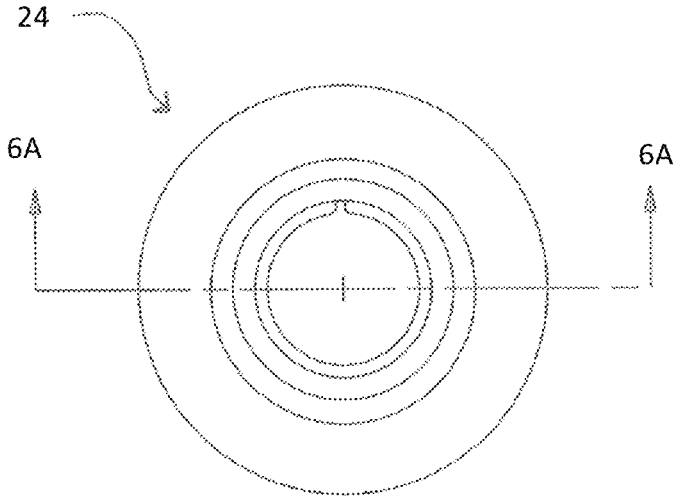
FIG. 6B is a top plan view of the bottom end cap of FIG. 6A.
Figure 7A:
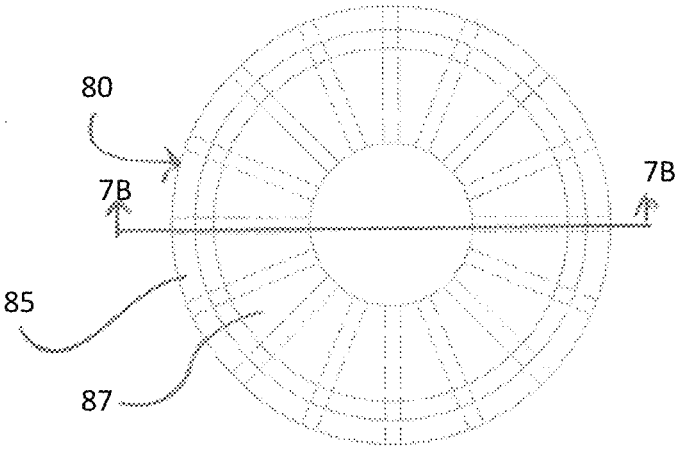
FIG. 7A is a top plan view of a rubber pad of the customizable shower caddy of FIG. 1.
Figure 7B:
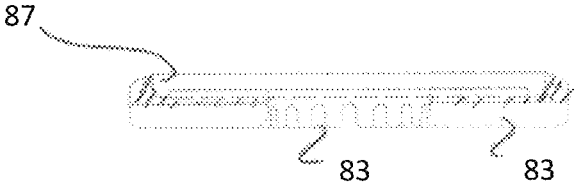
FIG. 7B is a cross-section of the rubber pad of FIG. 7A taken along line 7B-7B of FIG. 7A.
Figure 7C:
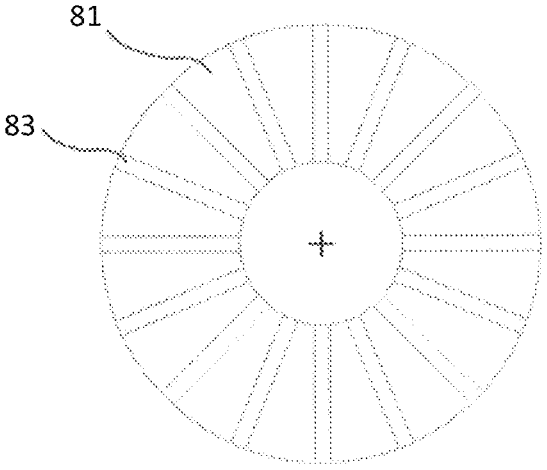
FIG. 7C is a bottom plan view of the rubber pad of FIG. 7A.
Figure 8A:
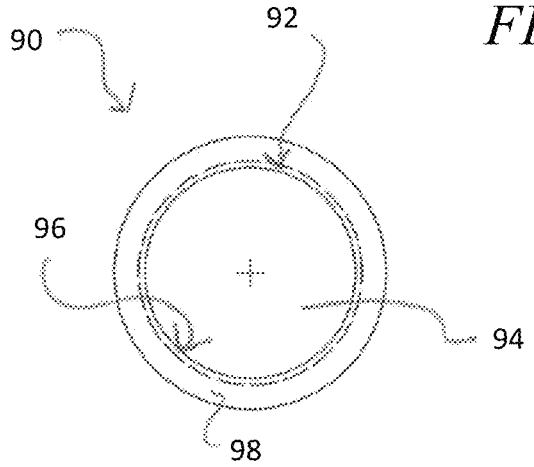
FIG. 8A is a top plan view of an end cap seal of the customizable shower caddy of FIG. 1.
Figure 8B:
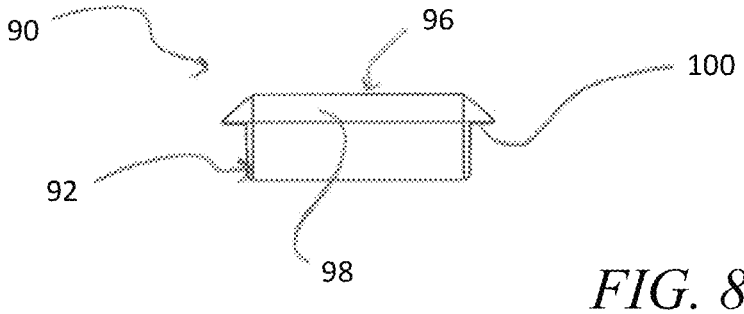
FIG. 8B is a side elevational view of the end cap seal of FIG. 8A.

Referring to FIGS. 1 and 2, there is illustrated a customizable shower caddy 10. The caddy 10, for example, is adjustable so it can stand along a side wall 12 (FIG. 1) of a shower enclosure 14 or in a corner 16 (FIG. 2) of the shower enclosure 14. The shower caddy 10 also can be adjusted to stand in the center of a shower enclosure 14.

The shower caddy includes a main rod 18, a secondary rod 20 and an optional secondary rod 22. The assembled rods 18, 20 (and optionally rod 22) include a bottom end cap 24 and a top end cap 26 that engage a shower basin 28 and a ceiling 30, respectively. Barrels 32 are adjustable along the rods 18, 20 (and optionally rod 22) to a preferred height. The barrels 32 support baskets 34 and shelves 36. The caddy 10 is more stable due to fewer rod sections when compared to other caddies. The barrels 32 provided enhanced gripping so that the baskets 34 and shelves 36 may support more weight than other caddies. The rods 18, 20 and 22 may be made of metal, such as steel or aluminum. The baskets 34 and shelves 36 may be made of metal, such as aluminum.

Turning to FIGS. 3-5B, the main rod 18 is fitted at one end with an insert 38 and at the other end with a rod collar 40. The insert 38 and the rod collar 40 are press fitted into the main rod 18. The insert 38 cooperates with the bottom end cap 24 for adjustment. The rod collar 40 seals an annular gap between the main rod 18 and the secondary rod 20. By way of example only, the main rod 18 may have a length of 52 inches and a diameter of 1 inch.

The insert 38 is generally cylindrical in shape and includes a ribbed portion 42 for insertion into the main rod 18 and a threaded portion 44 that threads into the bottom end cap 24. The ribbed portion 42 includes longitudinally extending ribs 46 equally spaced from one another. As illustrated, there may be six ribs. The ribs 46 engage an inner sidewall of the main rod 18 to provide a friction fit with the main rod 18. A terminal end 48 of the ribbed portion 42 includes an annular chamfer 50 to assist in the insertion process. The threaded portion 44 includes right-hand threading 52. The ribbed portion 42 and the threaded portion 44 are separated by an annular flange 54 that engages the end of the main rod 18 to limit insertion into the main rod 18 to only the length of the ribbed portion 42. By way of example only, the insert 38 may have a length of 1.654 inches, the flange 54 may have an outer diameter of 1.010 inches, and the threading 52 may have an outer diameter of 0.830 inches.

The rod collar 40 has a generally cylindrical shape with a tubular body 56 and a terminal end 58 with an annular chamfer 60 and a step 62 that extends radially outward. The step 62 stops insertion of the rod collar 40 into the main rod 18 when the main rod 18 abuts step 62. By way of example only, the step 62 may have an outer diameter of 1.0 inches, the tubular body 56 may have an outer diameter of 0.875 inches, and annular chamfer 60 may have a longitudinal length of 0.220 inches. The collar 40 may be made of plastic, such as polyproplylene.

With reference to FIGS. 6A-8B, the bottom end cap 24 has a bell-shaped body 64 with an upper portion 66 and a bottom portion 68. An internal flange 70 includes internal threading 72 that mates with the external threading 52 of the insert 38 so that the main rod 18 and the bottom end cap 24 can be adjusted relative to one another. The adjustment may be used to put pressure on the shower basin 28 during installation of the shower caddy 10 or to release pressure on the shower basin 28 to uninstall the shower caddy 10. The upper portion 66 defines a cylindrical passage 74 that receives the end of the main rod 18 that is fitted with the insert 38 with a slight clearance to allow rotation of the main rod 18 relative to the bottom end cap 24.

A terminal end 76 of the bottom end cap 24 defines a recess 78. The recess 78 may receive a rubber pad or the terminal end 76 may fit into a rubber pad 80. The rubber pad 80 provides increased frictional engagement with the shower basin 28 to limit or prevent the shower caddy 10 from walking and/or sliding on the shower basin 28 during installation and provides a secure installation. The rubber pad 80 can be glued to the terminal end 76. A bottom 81 of the rubber pad 80 includes radially extending channels 83 to enable water and/or air to escape during the installation process and after being installed. A top 85 of the rubber pad 80 includes a circular recess 87 that receives the terminal end 76 of the bottom end cap 24. By way of example only, the rubber pad 80 may be 2.240 inches in diameter, the circular recess 87 may be 2.00 inches in diameter, and the thickness of the rubber pad 80 may be 0.275 inches.

An end cap seal 90 seals the clearance between the main rod 18 and the upper portion 66. The end cap seal 90 includes a cylindrical body 92 defining a central passage 94 and a terminal end 96 with a chamfer 98 and a step 100. The step 100 stops insertion of the seal 90 into the body 64 of the bottom end cap 24 when step 100 abuts the end the upper portion 66. By way of example only, the end cap seal 90 may have a height of 0.407 inches and an inner diameter of 1.0 inch. The chamfer 98 at the step 100 may have a diameter of 1.291 inches.

With reference to FIGS. 9A-9I, there is illustrated a lock assembly 102 to lock the position of the main rod 18 and the secondary rod 20 relative to one another at a desired combined length. For example, the secondary rod 20 is extended from the main rod 18 until the desired overall length is achieved, and then, the lock assembly 102 is activated to secure the main rod 18 and the secondary rod 20 together against any further longitudinal movement relative to one another.

The lock assembly 102 includes a lock ramp 104, a secondary rod insert 106, and a lock sleeve 108. The lock ramp 104 and the secondary rod insert 106 may be molded from any rigid material, including a rigid plastic material. The lock sleeve 108 also may be molded from any rigid material, including plastic, but must be flexible enough to expand as it moves along the lock ramp 104 and provide a sufficient frictional engagement with an inner surface of the main rod 18 to secure the rods 18, 20 against relative movement.

The lock ramp 104 includes a frusto-conical wedge portion 110 at one end and a threaded portion 112 with a right-hand thread 114. The wedge portion 110 includes a groove 116 extending longitudinally along the length of the wedge portion 110. A head 118 is at the other end of the lock ramp 104 and includes a stop 120 (see FIG. 9D) at the other end. The longitudinal groove 116 guides longitudinal movement of the lock sleeve 108 along the wedge portion 110. The stop 120 prevents rotation of the insert 106 relative to the threaded portion 112 of the lock ramp 104 so that the insert 106 does not overtighten against the head 118.

The secondary rod insert 106 has a generally hollow cylindrical shape and includes a male component 122 and a female component 124. When the male component 122 and the female component 124 are mated to form the insert 106, the components 122, 124 define a passage 126 through the insert 106. The insert 106 fits with a friction fit in one end of the secondary rod 20 (see, e.g., FIG. 9A). The insert 106 can further be captivated in the secondary rod 20 by one or more notches or detents formed in the inside wall of the secondary rod that penetrate the outer surface of the insert 106. The engagement between the insert 106 and the secondary rod 20 prevents rotation of the insert 106 relative to the secondary rod 20.

The male component 122 includes protrusions 128, a first circumferential flange 130, a second circumferential flange 132, an annular groove 134 formed between the first circumferential flange 130 and the second circumferential flange 132, a threaded portion 136 having left hand threads 138, and exterior longitudinally extending ribs 140, which aid in providing better friction fit between the insert 106 and the secondary rod 20.

The female component 124 includes recesses 142, a first circumferential flange 144, a second circumferential flange 146, an annular groove 148, a threaded portion 150, having left hand threads 152, exterior longitudinally extending ribs 154, which provide a friction fit between the insert 106 and the secondary rod 20, and a stop 156, which engages the stop 120 of the lock ramp 104 upon unlocking the lock assembly 102.

The recesses 142 of the female component 124 receive the protrusions 128 of the male component 122, such that the components 122, 124 may be combined to form the insert 106. The protrusions 128 may have a friction fit in the recesses 142 or may be glued or welded in the recesses 142. While four are shown, there may be less or additional protrusions 128 and recesses 142.

The second circumferential flanges 132, 146 combine to form a single annular flange that extends about a perimeter of one end of the insert 106 for engaging an end of the secondary rod 20, such as a bottom end 158 of the secondary rod 20 (see FIG. 9A) to prevent complete insertion therein. The left-hand threads 138, 152 combine to form a single thread, such that turning the insert 106 toward the user locks the assembly 102 and turning the insert 106 away from the user unlocks the assembly 102. The thread 114 of the threaded portion 112 of the lock ramp 102 meshes with the combined threads 138, 152 of the insert 106.

The first circumferential flanges 130, 144 combine to form a single annular flange. The lock sleeve 108 includes an annular groove 160 that receives the annular flange formed by the first circumferential flanges 130, 144 of the insert 106. The lock sleeve 108 includes an interior flange 162 which is received in a single annular groove formed by the annular grooves 134, 148 of the insert 106, thus connecting the insert 106 and the lock sleeve 108. As the threaded portion 112 of the lock ramp 104 is turned into the insert 106, the insert 106 moves closer to the wedge portion 110 of the lock ramp 104. This causes the lock sleeve 108 to move along the wedge portion 110, causing the lock sleeve to expand and thereby lock the rods 18, 20 against movement relative to one another. The expansion of the lock sleeve 108 is not to an extent that would cause the attachment between the lock sleeve 108 and the insert 106 to become disconnected.

The lock sleeve 108 has an elongated slot 164 along its entire axial length to form a split configuration. This enables the lock sleeve 108 to be expanded from a first state that allows relative movement of the rods 18, 20 to a second state to lock the rods 1, 20 against relative movement. The lock sleeve 108 includes a longitudinally extending rib 166 on its interior that is offset 180 degrees from the slot 164. The lock sleeve 108 receives the wedge portion 110 of the lock ramp 104 with the rib 166 in the groove 116 of the lock ramp 104.

The stop 156 is on the portion of the insert 106 facing the head 118 of the lock ramp 104. The stop 156 is configured as a ramp with a stepped surface 168 and a ramped surface 170. The stop 120 is on the head 118 of the lock ramp 104 at the end of the threaded portion 112. More specifically, the stop 120 is formed by a radial flange 172 about a portion of the head 118. The radial flange 172 may extend about 180 degrees around the head 118.

The insert 106 and the threaded portion 112 of the lock ramp 104 reside in the secondary rod 20, and when locking the main rod 18 and the secondary rod 20, the stop 156 of the insert 106 disengages the stop 120 of the lock ramp 104. If the locking assembly 102 is in the fully unlocked position, the radial flange 172 may slide along the ramped surface 170 during the first and/or additional twists of the threaded portion 112 in the locking direction so that the flange 172 does not get caught on the stop 156 as the stop 120 rotates away from the stop 156.

When the user loosens the main rod 18 and the secondary rod 20 by rotating the secondary rod 20 counterclockwise thereby operating the threads 138, 152 of the insert 106, the stop 156 of the insert 106 moves toward the head 118 of the lock ramp 104. The insert 106 rotates until the stop 156 engages the stop 120 of the head 118. The stops 120, 156 are rigid and prohibit further rotation of the insert 106 and the lock ramp 104 relative to one another. The relative circumferential location of the stop 120 and the lock ramp 104 may be positioned to leave a small gap 174 between the insert 106 and the head 118 when the insert 106 is rotated to its fully unlocked position. This ensures that the insert 106 and head 118 will not become stuck together and may resist or even prevent rotation in the locking direction.

Additional details of the lock assembly 102 are contained in U.S. application Ser. No. 16/297,357, filed Mar. 8, 2019, which is incorporated herein by reference in its entirety.

As shown in FIGS. 10-16, there is illustrated an alternative lock assembly 180 interconnecting the main rod 18 and the secondary rod 20. The lock assembly 180 includes a wedge shaft 182, a rod insert 184 and a wedge 186. The rod insert 184 is attached to the secondary rod 20 and extends into the main rod 18. Dimples 188 formed in the secondary rod 20 can bite into the rod insert 184 to hold the rod insert 184 against longitudinal and rotational movement relative to the secondary rod 20. The wedge 186 is positioned in the main rod 18, and the wedge shaft 186 operatively interconnects the rod insert 184 and the wedge 186.

Figure 10:
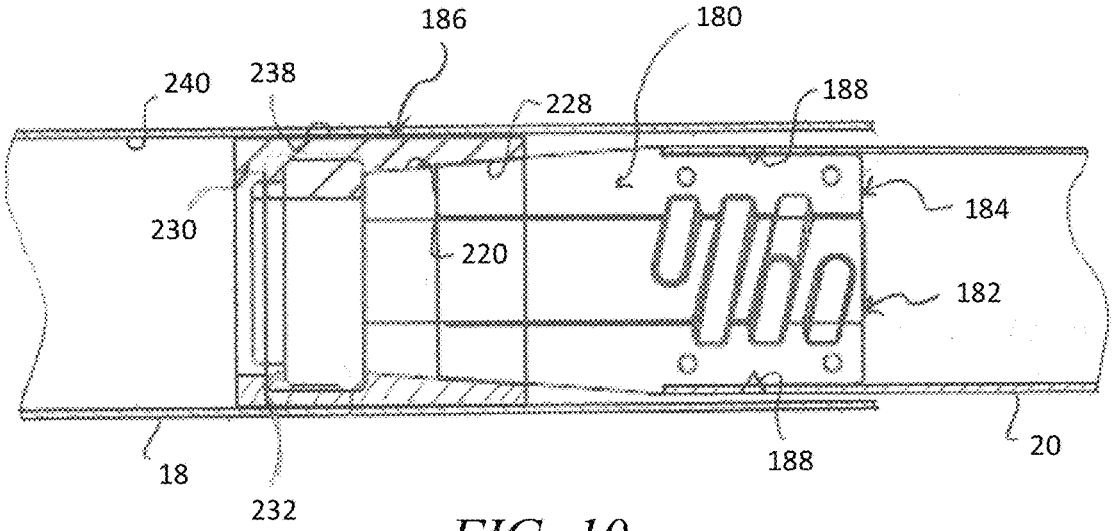
FIG. 10 is a partial, centrally taken cross-section view of an alternative lock assembly in an unlocked state for use with the customizable shower caddy of FIG. 1.
Figure 11:
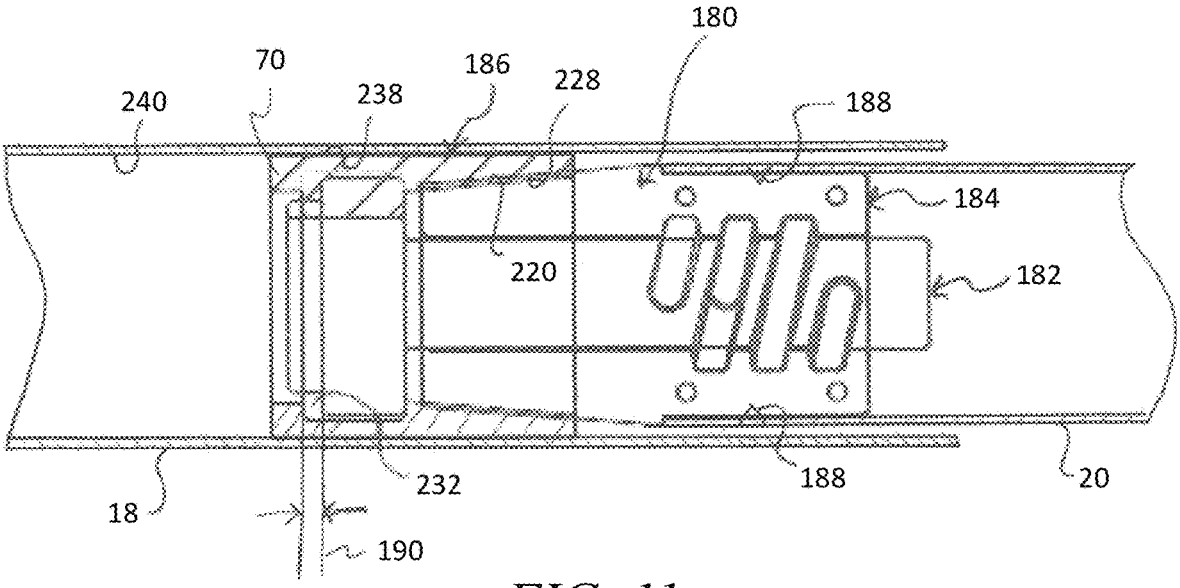
FIG. 11 is a partial, centrally taken cross-section view of the lock assembly of FIG. 10 in a locked state.
Figure 12:
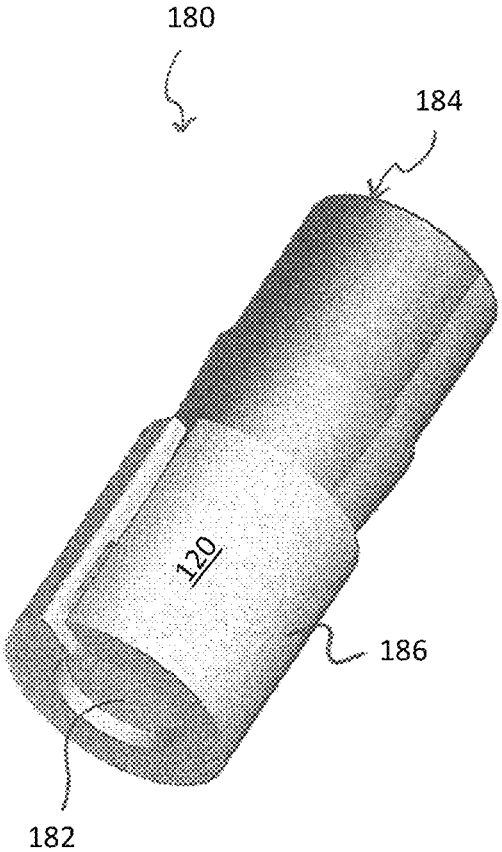
FIG. 12 is a bottom perspective of the lock assembly of FIG. 10.

To secure the lock assembly 180, the main and secondary rods 18, 20 may be turned in opposite directions which causes the wedge 186 to be tightly seated between the main rod 18 and the rod insert 184. In situations where the bottom and top end caps 24, 26 are adjustable, additional inward force on the main and secondary outer rods 18, 20 caused by the end caps 24, 26 during their adjustment can cause the main and secondary rods 18, 20 to inadvertently adjust relative to one another. FIG. 10 shows the lock assembly 180 in an unlocked state, and FIG. 11 shows the lock assembly 180 in a locked state. With reference to FIG. 11, the lock assembly 180 provides an adjustment gap 190 that enables the lock assembly 180 to tighten even further when the end caps 24, 26 are adjusted. The adjustment gap 190 allows the wedge 186 to move further towards the rod insert 184 to provide an even tighter seating of the wedge 186 between the main rod 18 and the rod insert 184 to prevent unintentional shifting of the main and secondary rods 18, 20 relative to one another.

Figure 13:
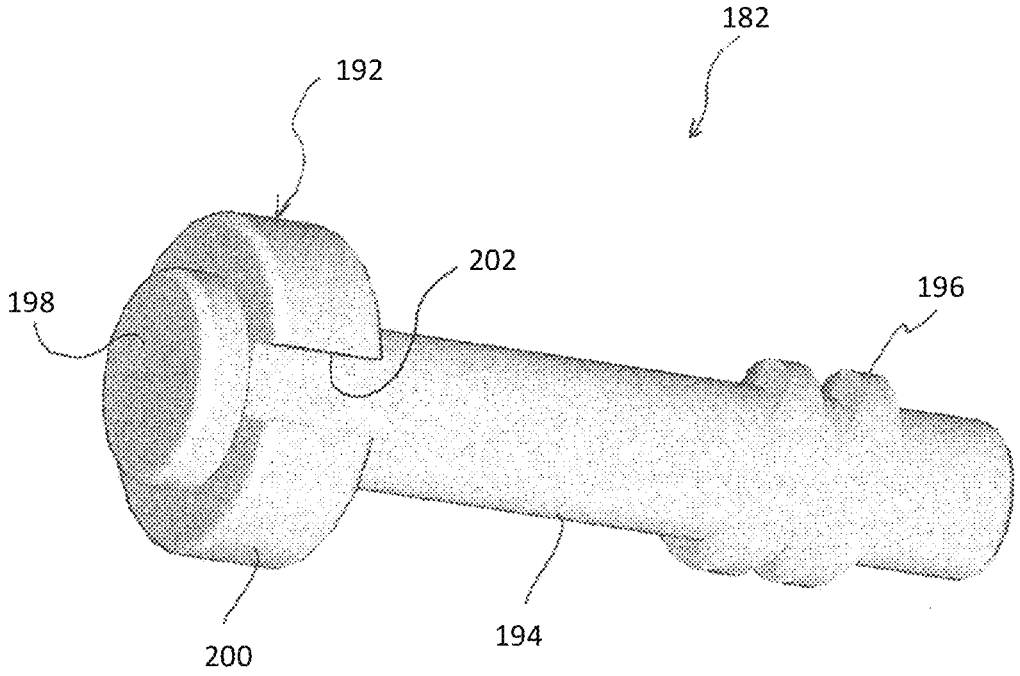
FIG. 13 is a bottom perspective view of a wedge shaft of the lock assembly of FIG. 10.

As shown in FIG. 13, the wedge shaft 182 includes a stepped head portion 192, a shaft 194 and threading 196 along at least a portion of the shaft 194. The stepped head portion 192 includes a terminal disc end 198 that rotates in the wedge 186. Immediately inward of the terminal disc end 198 is an annular flange 200 that moves the wedge 186 between the locked state and unlocked states (FIGS. 10 and 11). The flange 200 includes an axially extending slot 202.

Figure 14A:
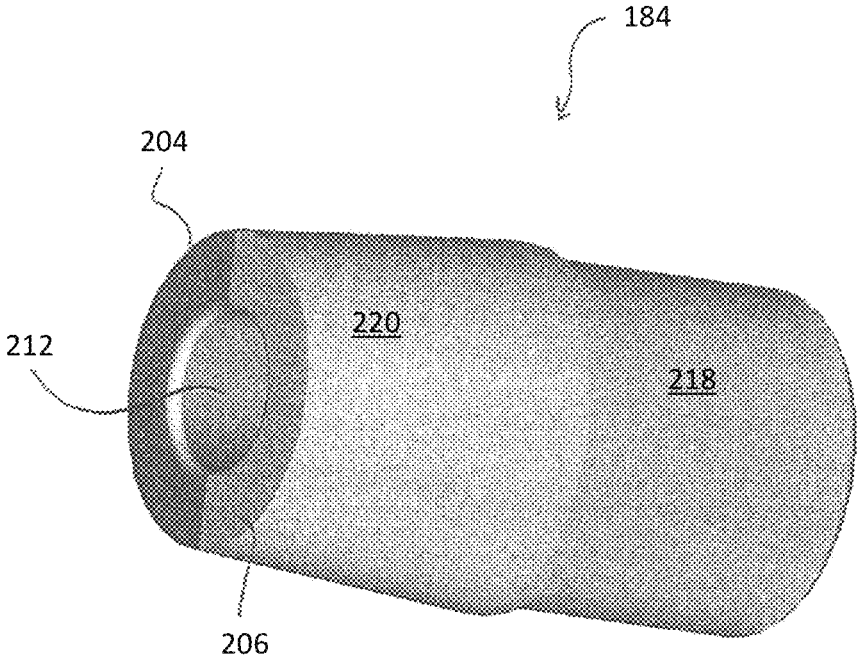
FIG. 14A is a bottom perspective view of a rod insert of the lock assembly of FIG. 10.
Figure 14B:
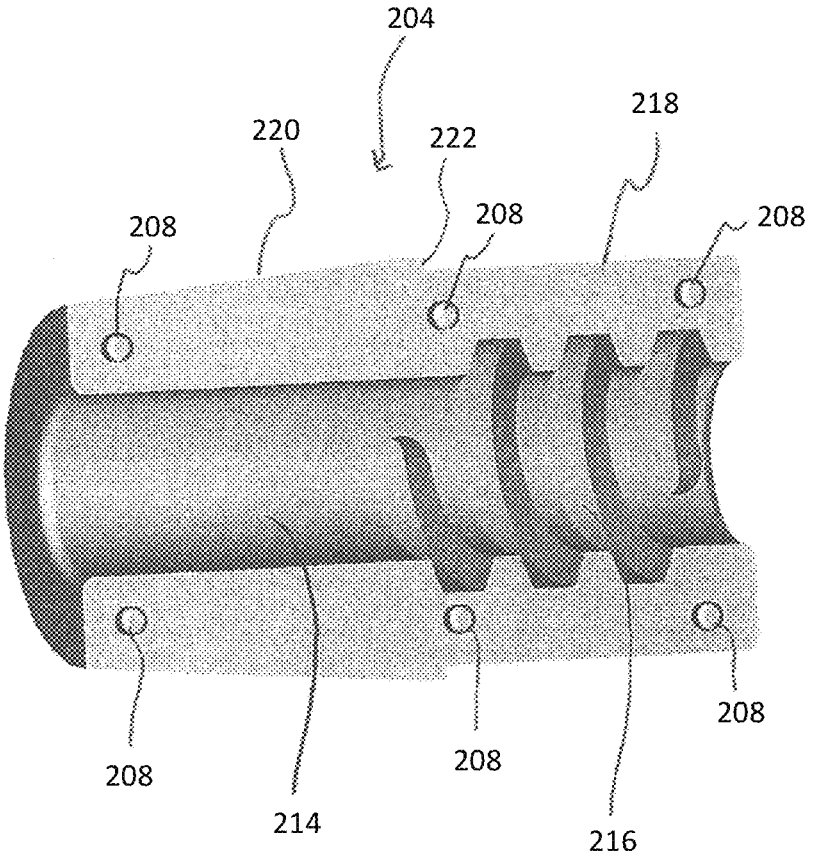
FIG. 14B is a side perspective view of a first component of the rod insert of FIG. 14A.
Figure 14C:
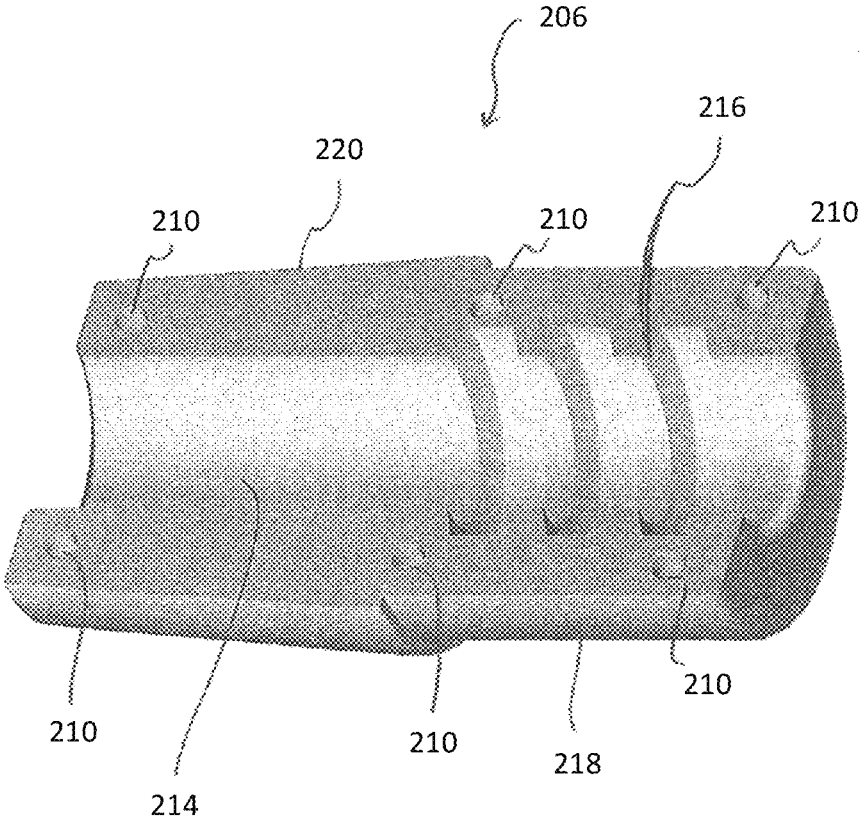
FIG. 14C is a side perspective view of a second component of the rod insert of FIG. 14A.

With reference to FIGS. 14A-C, the rod insert 184 may be a two part component with a first component 204 and a second component 206. The two components 204, 206 are mirror images of one another except that the first component 204 may include a number of pegs 208 and the second component 206 may include a number of complimentary sockets 210 for receiving the pegs 208 to align the components 204, 206. The rod insert 184 defines an internal passage 212 with a smooth portion 214 and a threaded portion 216.

The wedge shaft 182 extends through the internal passage 212, and the threading 196 of the wedge shaft 182 engages with the threaded portion 216 of the rod insert 204. An outer surface 218 of the threaded portion 216 is cylindrical, and the outer surface 220 of the smooth portion 214 is conical. An annular step 222 transitions the cylindrical outer surface 218 with the conical outer surface 220. The step 222 engages an end of the secondary rod 20 to limit insertion of the rod insert 204 into the secondary rod 20 beyond the cylindrical outer surface 218.

Figure 15:
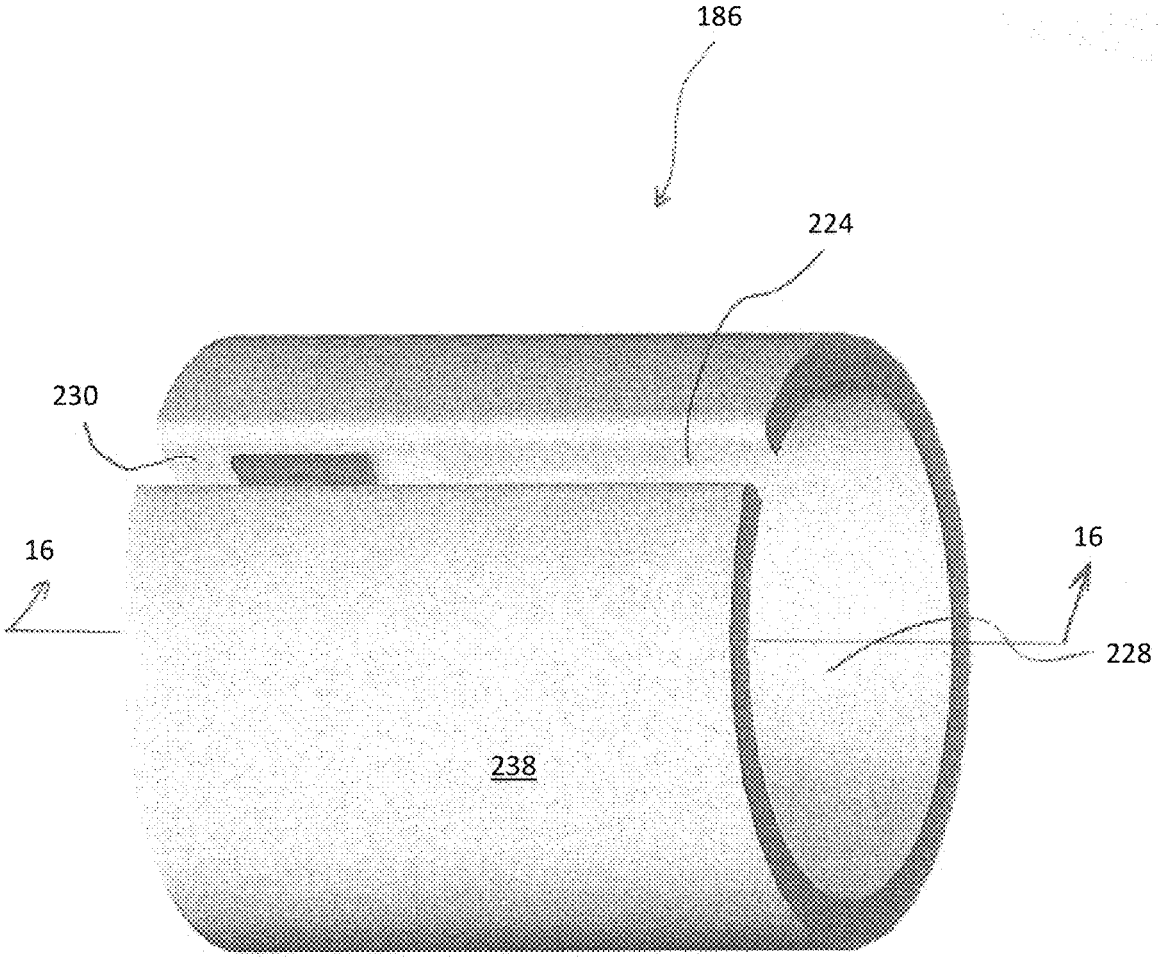
FIG. 15 is a top perspective view of a wedge of the lock assembly of FIG. 10.
Figure 16:
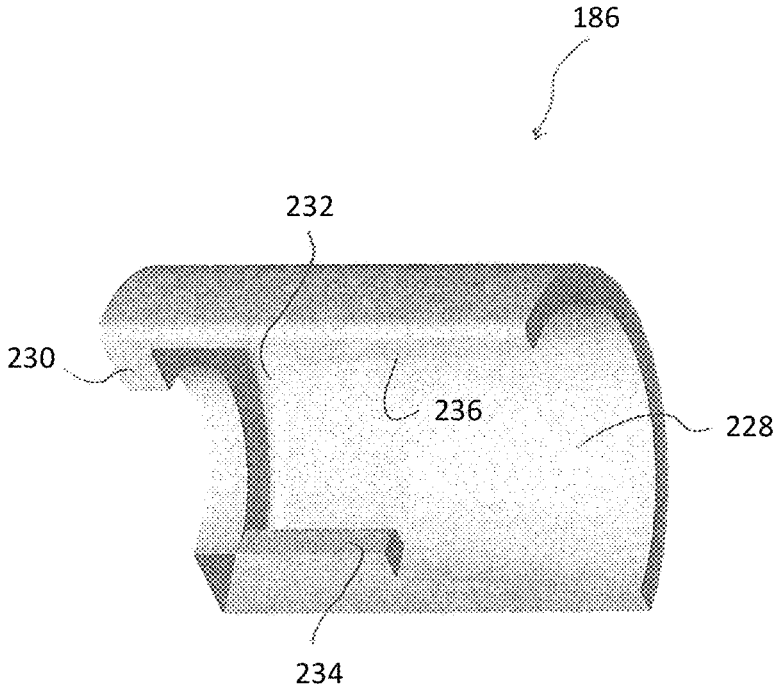
FIG. 16 is a cross-section view of the wedge of FIG. 15 taken along line 16-16 of FIG. 15.

As shown in FIGS. 15 and 16, the wedge 186 has a split configuration with an axially extending gap 224 and a conical inner surface 236 and a cylindrical outer surface 238. The wedge 186 defines a longitudinally extending passage 228 with an annular stop 230 at on end. Immediately adjacent the annular stop is an annular recess 232 that is intersected by an axially extending rib 234. Then, just inward of the annular recess 232 is an annular conical surface 236. The annular conical surface 236 slides against the outer conical surface 220 of the rod insert 184 when moving the wedge 186 between the locked and unlocked states.

The adjustment gap 190 of the lock assembly 180 is formed because the longitudinal length of the annular recess 232 of the wedge 186 is slightly larger than the thickness of the annular flange 200 of the wedge shaft 182. In one embodiment, the longitudinal length of the annular recess 232 may be 0.350 inches, and the thickness of the annular flange 200 may be 0.254 inches, creating an adjustment gap 190 of 0.096 inches. Overall, the adjustment gap 190 allows the compressive force to further move the rod insert 184 and the wedge 186 towards one another to increase the locking force of the lock assembly 180. This prevents the rods 18, 20 from unintentionally slipping relative to one another. This assists users that may not be strong enough to initially set the lock assembly 180.

More specifically, to set the lock assembly 180, the rods 18, 20 are pulled apart to set the desired length. Once the length is set, at least one of the rods 18, 20 is turned relative to the other to activate the lock assembly 180. For instance, the main rod 18 can be held stationary in one's left hand, while the secondary rod 20 can be turned with one's right hand towards the user's body. This causes the rod insert 184 to move closer towards the wedge 186 which prevents the wedge 186 from rotating because an outer surface 238 of the wedge 186 has a friction engagement with an inner surface 240 of the main rod 18. Alternatively, instead of holding the main rod 18 stationary, it also can be turned with one's left hand away from one's body simultaneously with turning the secondary rod 20. In either case, this will cause the rod insert 184 to turn and the threading 196 on the wedge shaft 182 to engage the threaded portion 216 of the rod insert 184. This, in turn, will cause the annular flange 200 of the wedge shaft 182 to shift to the inner side of the annular recess 232 to draw the wedge 186 toward the rod insert 184. The annular conical surface 236 of the wedge 186 will ride along the conical outer surface 220 of the rod insert 184. This forces the wedge 186 to lodge with a tight friction fit between the main rod 18 and the rod insert 184 to prevent the rods 18, 20 from moving relative to one another. The longitudinally extending gap 224 along the wedge 186 will widen as the wedge 186 moves along the rod insert 184.

The adjustment gap 190 will allow the use of adjustable end cap systems, such as assemblies 24, 26, to further drive the wedge 186 onto the conical outer surface 220 of the rod insert 184 to provide further locking force. More specifically, as the adjustable end assemblies 24, 26 are activated by turning the rods 18, 20 together in the same direction, such as towards the user, the end assemblies 24, 26 extend from the rods 18, 20 and will apply a compressive force on the rods 18, 20. This compressive force will cause the wedge 186 to automatically shift further along the conical outer surface 220 of the rod insert 184 to lodge even further between the main rod 18 and the rod insert 184 to provide an even tighter friction fit between the main rod 18 and the rod insert 184 to prevent the rods 18, 20 from moving relative to one another.

The rib 234 of the wedge 186 sits in the longitudinally extending gap 202 of the annular flange 200 of the wedge shaft 182. This keys the wedge shaft 182 to the wedge 186 to prevent rotational movement between the two.

To undo the locking assembly 180, the rods 18, 20 are turned in the direction opposite to the locking directions. In this operation, the annular flange 200 of the wedge shaft 182 engages the annular stop 230 at the other side of the annular recess 232 of the wedge 186 and drives the wedge 186 down the conical outer surface 220 of the rod insert 184.

Additional details of the lock assembly 180 are contained in U.S. Application No. 62/880,483, filed Jul. 30, 2019, which is incorporated herein by reference in its entirety.

Figure 9A:
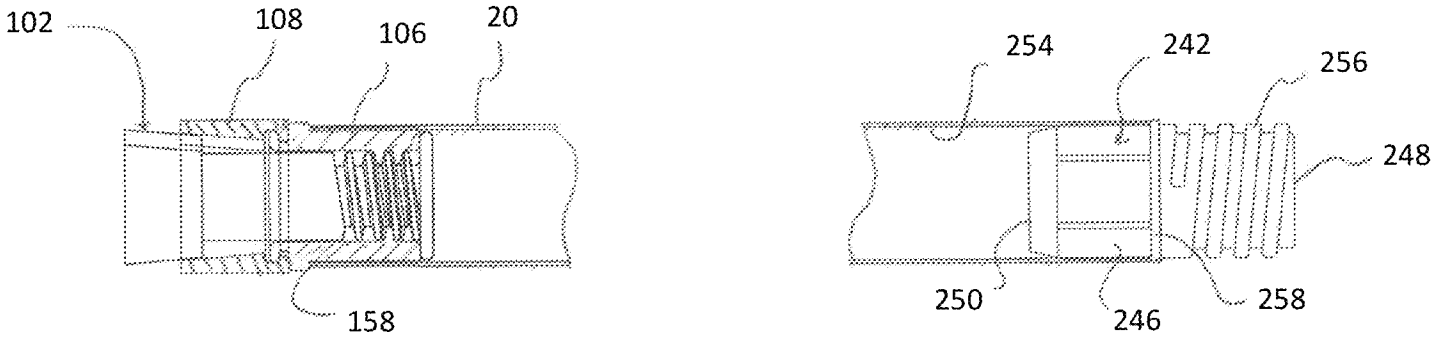
FIG. 9A is cross-section view of a secondary rod showing a partial cross-section of a lock assembly and an elevation view of a threaded insert for use for use with the customizable shower caddy of FIG. 1.
Figure 9B:
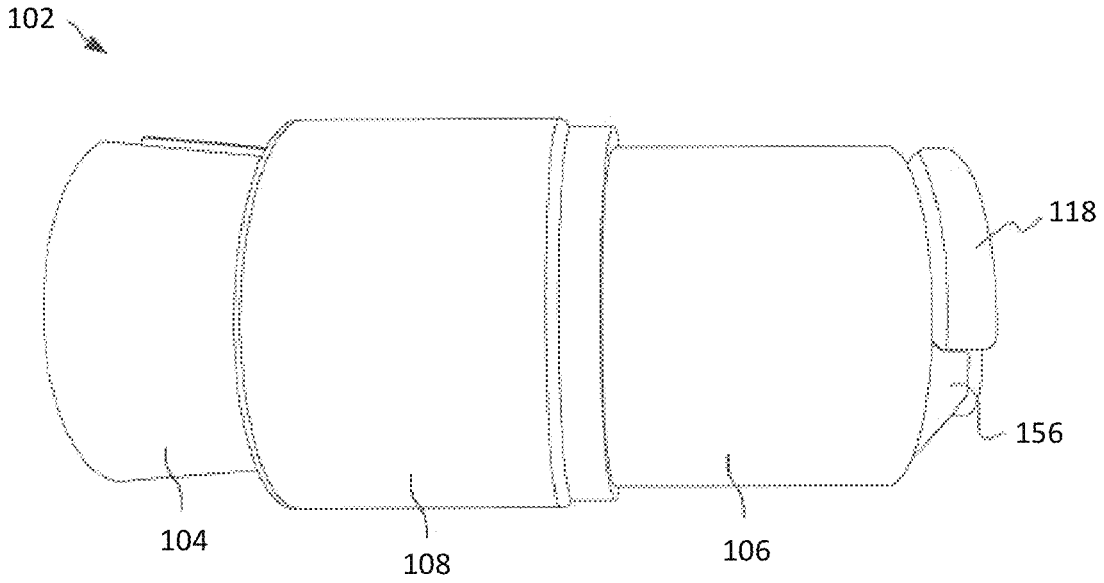
FIG. 9B is a side elevational view of the lock assembly of FIG. 9A.
Figure 9C:
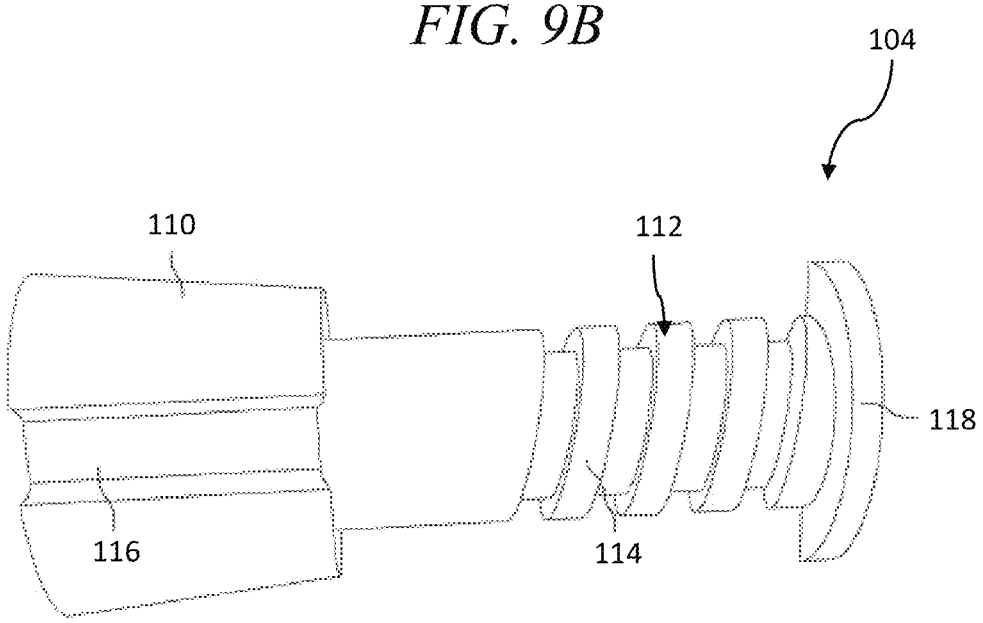
FIG. 9C is a side elevational view of the lock ramp of the lock assembly of FIG. 9A.
Figure 9D:
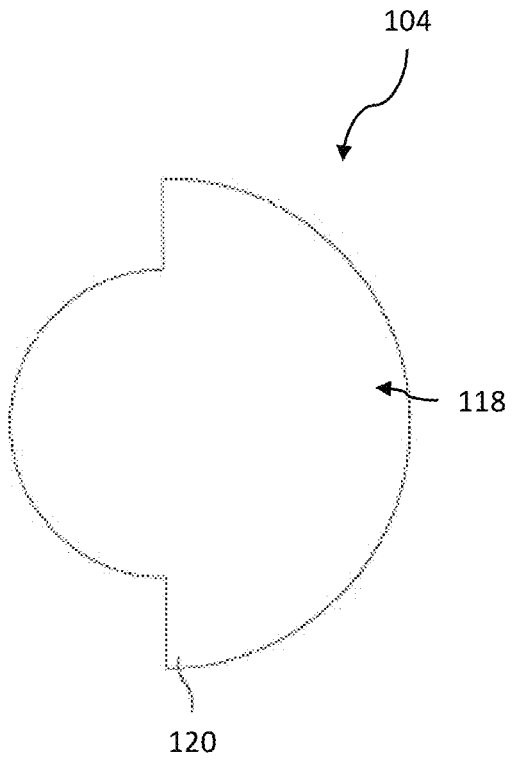
FIG. 9D is a top plan view of a head of the lock ramp of FIG. 9C.
Figure 9E:
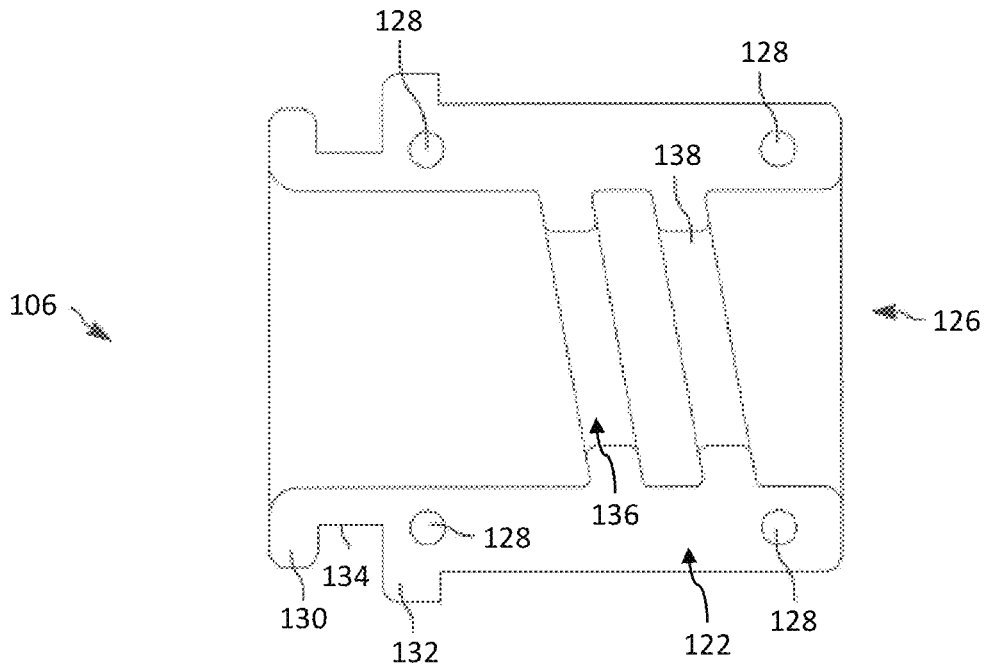
FIG. 9E is a side view of an interior side of a male component and a female component of a secondary rod insert of the lock assembly of FIG. 9A.
Figure 9E:
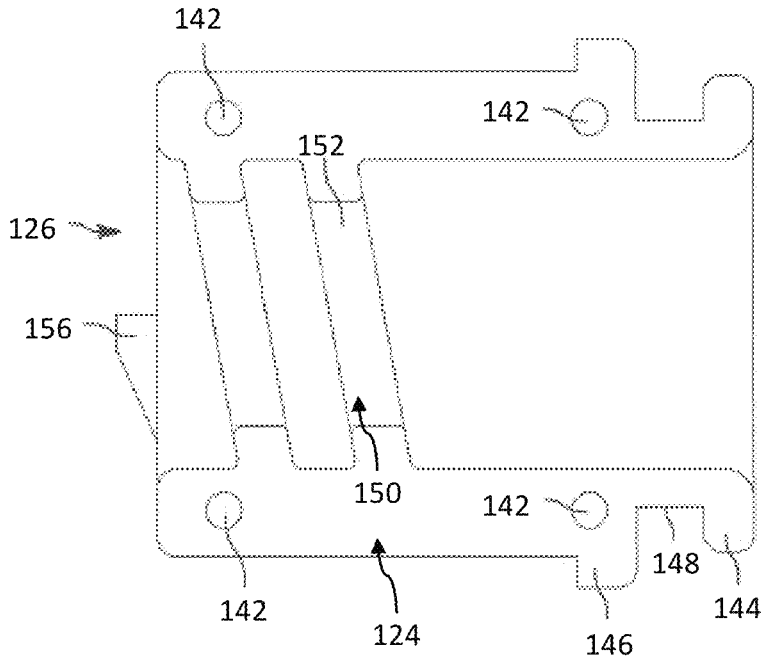
Figure 9F:
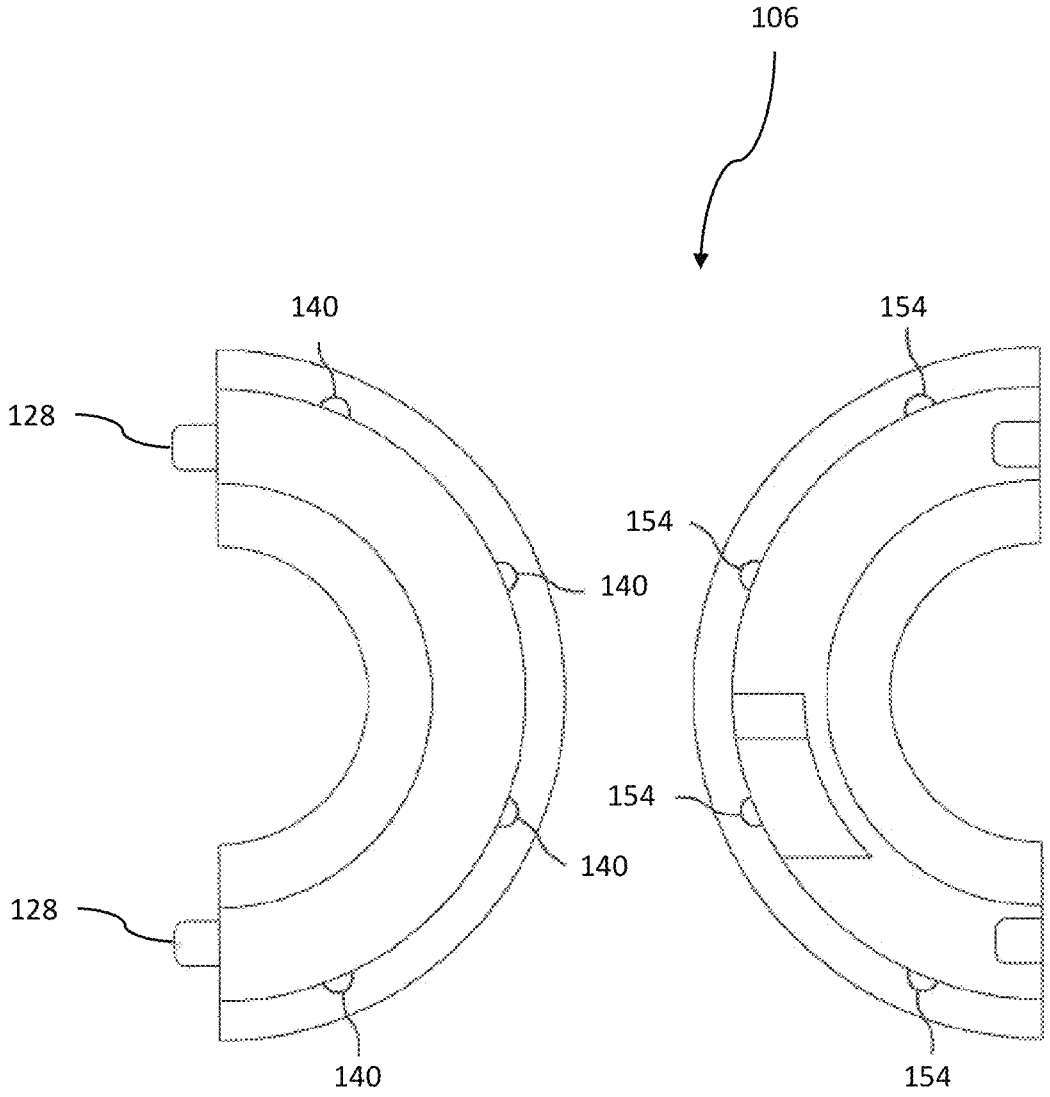
FIG. 9F is a top plan view of the male component and female component of the secondary rod insert of FIG. 9E.
Figure 9G:
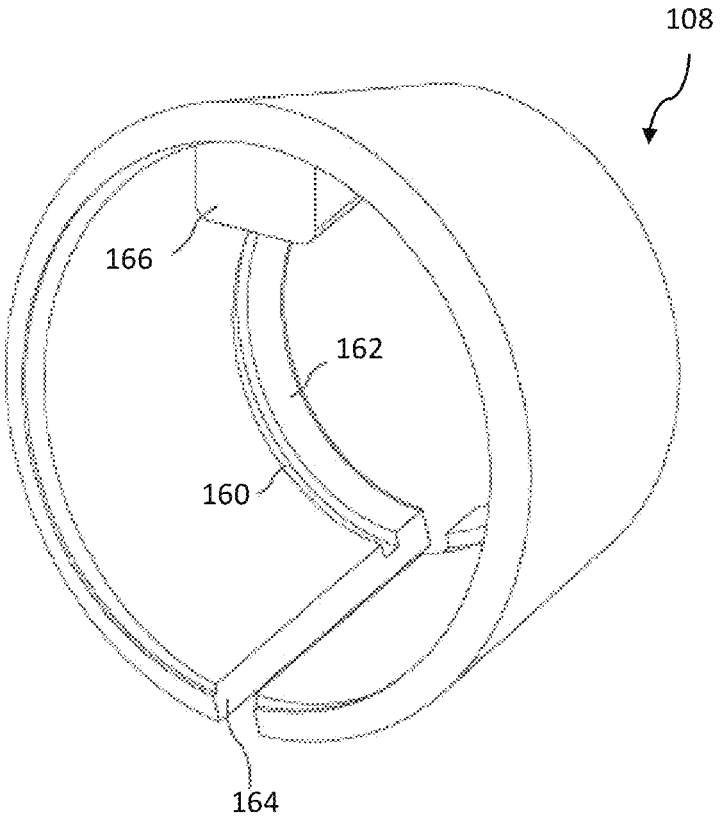
FIG. 9G is a bottom perspective view of a lock sleeve of the lock assembly of FIG. 9A.
Figure 9H:
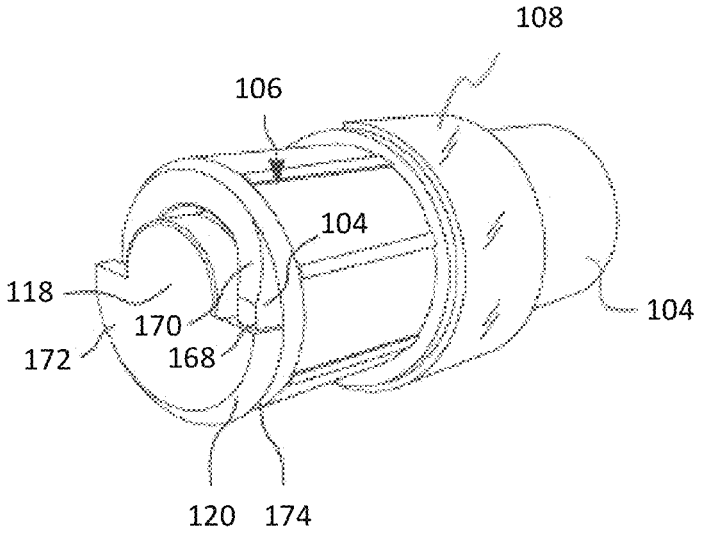
FIG. 9H is a bottom perspective view of the lock assembly of FIG. 9A.
Figure 9I:
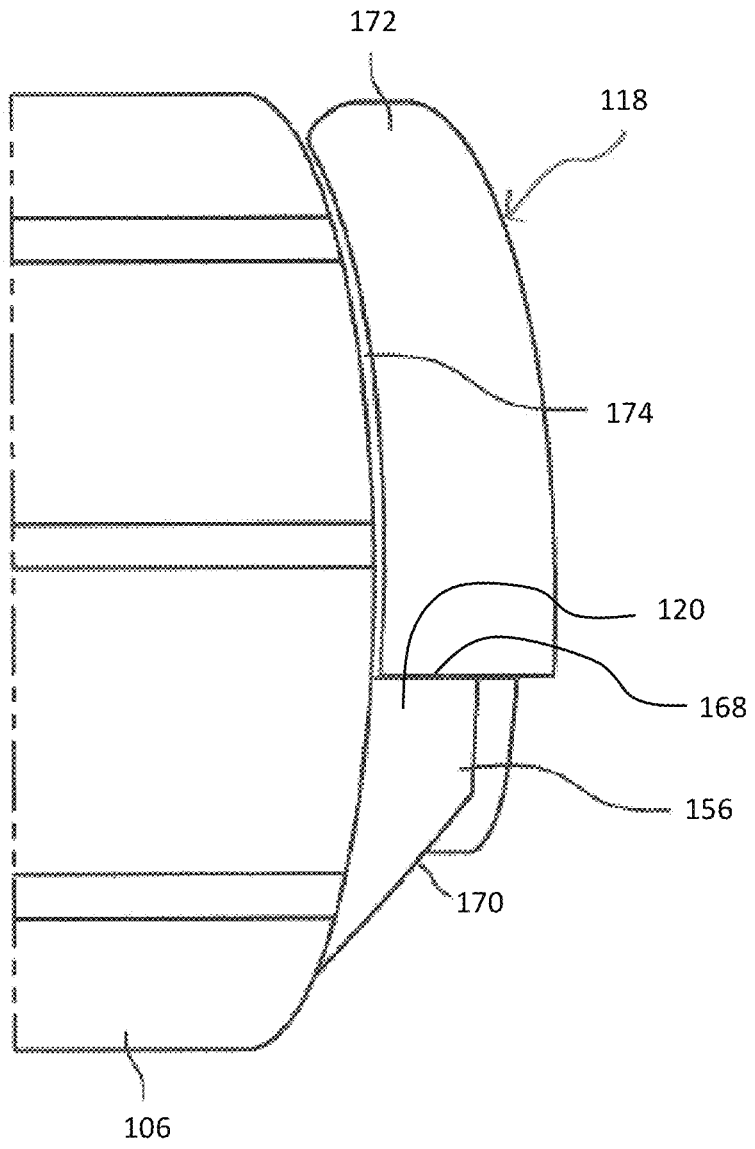
FIG. 9I is a partial side elevational view of the lock assembly of FIG. 9A.
Figure 17:
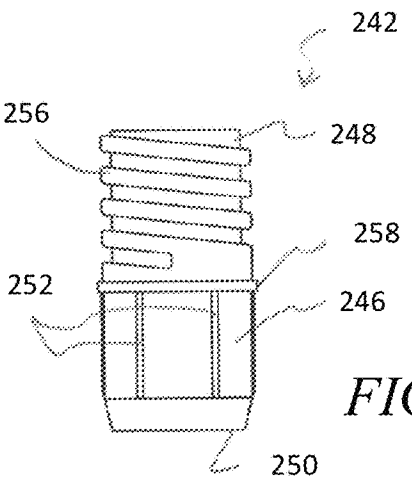
FIG. 17 is a side elevational view of a connection insert of the customizable shower caddy of FIG. 1.

Referring to FIGS. 9A and 17, an end of the secondary rod 20 opposite the lock assembly 106 (or 180) is fitted with a connection insert 242. The connection insert 242 attaches to the top end cap 26 or the optional extension rod 22 (discussed later). The connection insert 242 includes an insert portion 246 and a threaded portion 248. A terminal end 250 of the insert potion 246 is chamfered to aid with insertion into the secondary rod 20. The insert portion 246 includes longitudinally extending ribs 252 that engage an inside surface 254 of the secondary rod 20 with a friction fit that prevents rotation of the connection insert 242 relative to the secondary rod 20 and unintentional removal of the connection insert 242 from the secondary rod 20. The threaded portion 248 includes a left-hand thread 256. A stop flange 258 disposed between the insert portion 246 and the threaded portion 248 engages the end of the secondary rod 20 to prevent insertion of the connection insert 242 beyond the insert portion 246.

By way of example only, the secondary rod 20 may have a length of 52 inches and an outer diameter of 0.875 inches. The outside diameter of the threaded portion 248 of the connection insert 242 may be 0.875 inches.

Figure 18A:
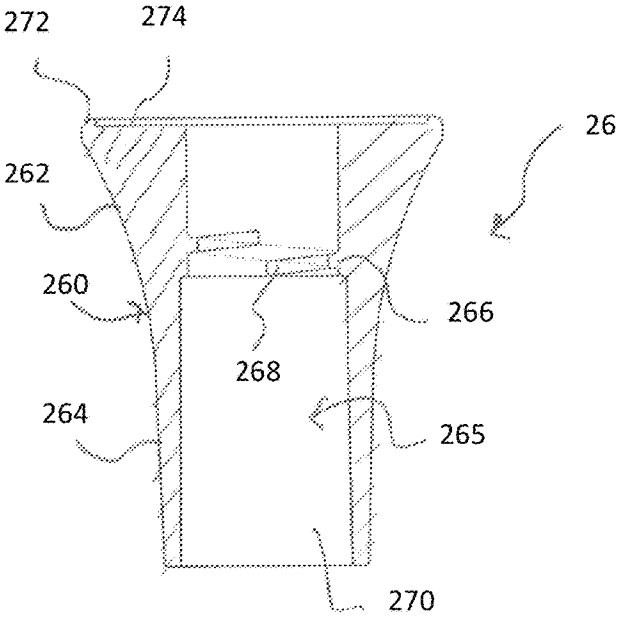
FIG. 18A is a cross-section view of a top end cap of the customizable shower caddy of FIG. 1 taken along line 18A-18A of FIG. 18B.
Figure 18B:
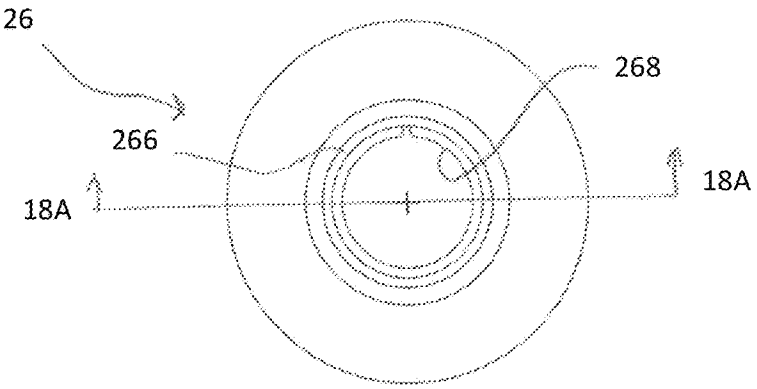
FIG. 18B is a bottom view of the top end cap of FIG. 18A.

With reference to FIGS. 18A-B, the top end cap 26 has a bell-shaped body 260 with an upper portion 262 and a lower portion 264 defining a hollow interior 265. An internal flange 266 includes internal threading 268 that mates with the external threading 256 of the connection insert 242 so that the secondary rod 20 (or the optional extension rod 22) and the top end cap 26 can be adjusted relative to one another. The adjustment can be used to apply pressure on the ceiling 30 to install the shower caddy 10 or release pressure on the ceiling 30 to uninstall the shower caddy 10. The lower portion 264 defines a cylindrical passage 270 that receives the end of the secondary rod 20 (or the optional extension rod 22) that is fitted with the connection insert 242 with a slight clearance to allow rotation of the secondary rod 20 (or the optional extension rod 22) relative to the top end cap 26. By way of example only, the top end cap 26 may have a length of 2.479 inches and a maximum diameter of 2.0 inches.

A terminal end 272 of the top end cap 26 defines a recess 274. The recess 274 receives a rubber pad or fits into the rubber pad 80 to provide increased frictional engagement with the ceiling 30. This aids to prevent the shower caddy 10 from walking and/or sliding on the ceiling 30 of the shower caddy 10 during installation and provides a secure installation. The rubber pad 80 may have the same structure as and be secured to the end cap 26 as the rubber pad 80 described above.

An end cap seal, such as end cap seal 90, may be fitted into the clearance between the secondary rod 20 (or the extension rod 22). The end cap seal 90 is not required at either the bottom end cap 24 or the top end cap 26 but can be used at either or both.

Figure 19:
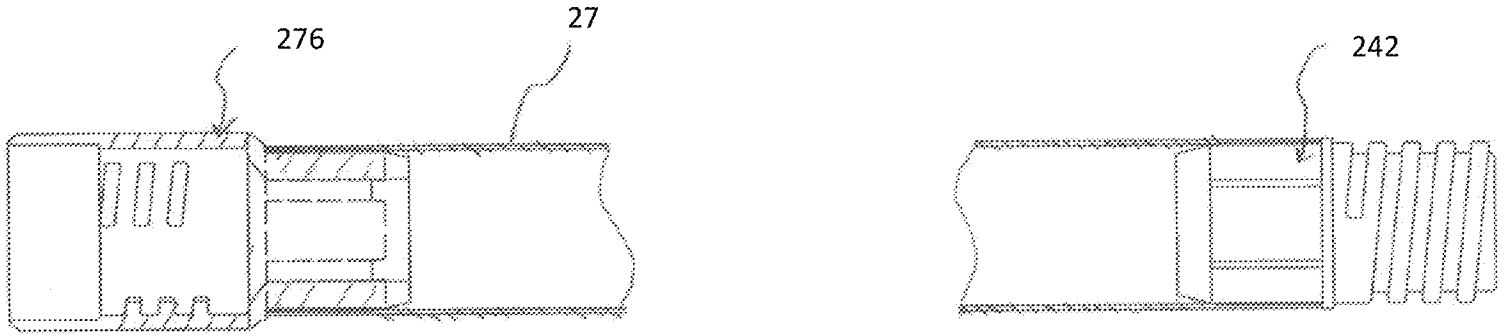
FIG. 19 is a cross-section view of an extension rod for use with the customizable shower caddy of FIG. 1.

As show in FIG. 19, ends of the optional extension rod 22 are fitted with the connection insert 242 and an extension rod insert 276. The connection inert 242 is the same as that described above and will not be described here again. The connection insert 242 fitted into the end of the optional extension rod 22 will mate with the top end cap 26. The extension rod insert 276 is designed to mate with the connection insert 242 fitted into the end of the secondary rod 20.

Figure 20B:
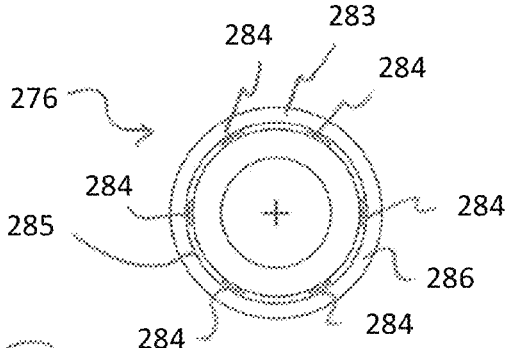
FIG. 20B is a top plan view of the extension rod insert of FIG. 20A.
Figure 20A:
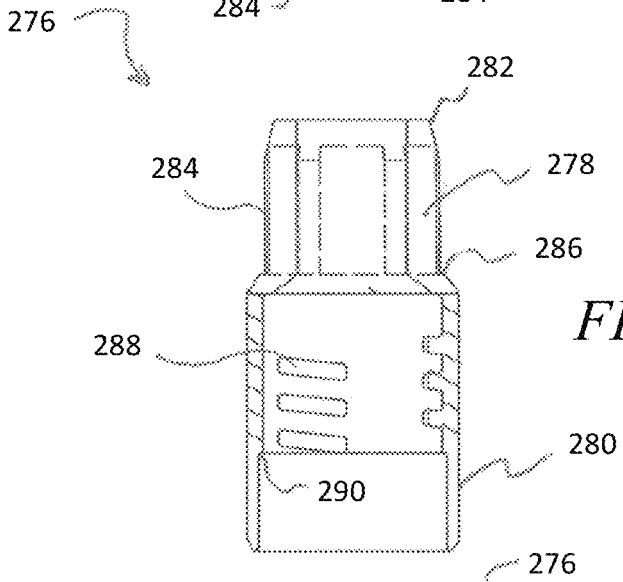
FIG. 20A is a cross-section view of an extension rod insert of the extension rod of FIG. 19 taken along line 20A-20A of FIG. 20C.
Figure 20C:
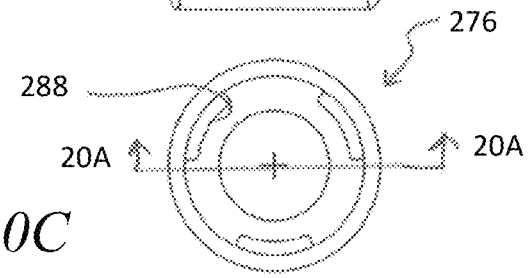
FIG. 20C is a bottom view of the extension rod insert of FIG. 20A.

With reference to FIGS. 20A-C, the extension rod insert 276 includes an insert portion 278 and a socket portion 280. The insert portion 278 includes a terminal end 282 with a chamfer to aid in inserting the extension rod insert 276 into the end of the extension rod 22. The insert portion 278 includes a cylindrical outer surface 283 with longitudinal ribs 284 extending from the outer surface 283. The ribs 284 engage the inner surface of the extension rod 22 with a friction fit to prevent unintentional removal of the insert 276 from the extension rod 22 and unintentional rotation of the insert 276 relative to the extension rod 22. An annular external step 286 is at the transition between the insert portion 278 and the socket portion 280. The step 286 engages the end of the extension rod 22 to prevent insertion of the insert 276 into the end of the extension rod 22 beyond the insert portion 278.

The socket portion 280 includes internal threads 288 that mate with the external threads 256 of the connection insert 242 this is fitted into the end of the secondary rod 20. The socket portion 280 further includes an annular internal stop 290 that engages the stop flange 258 of the connection insert 242 to prevent over insertion of the threaded portion 248 of the connection insert 242 into the socket portion 280.

By way of example only, the length of the extension rod insert 276 may be 2.087 inches, the length of the socket portion 280 may be 1.337 inches, the outer dimeter of the socket portion 280 may be 1.022 inches, and the inner diameter of the socket portion 280 may be 0.866 inches.

Turning to FIGS. 21A-21L, the barrels 32 each include a barrel body 292 with a top end portion 294 and a bottom end portion 296. The outside of the barrel body may have an hour-glass profile 298 or any other profile, such as a rectangular or cylindrical. The inside of the barrel body has a generally cylindrical profile 300.

The top end portion 294 includes an inner annular smooth portion 306, an interrupted threaded portion 308 and an annular landing 310 at the base of the interrupted threaded portion 308. The interrupted threaded portion 308 may include four arcuate projections 316 with external threads that form a threading for a top cap 318. The end portion 294 includes arcuate ledges 320 between the arcuate projections 316. A recess 322 defined by the end portion 294 extends longitudinally inward from each ledge 320. The ledges 320 and recesses 322 are used in mounting the baskets 34 and shelves 36. Thus, the illustrated barrel 32 can support up to four baskets 34 and/or shelves 36. The barrel can be scaled to support additional or less baskets and/or shelves. The bottom end portion 296 includes internal threading 324 that is used to mount a bottom cap 326.

By way of example only, the barrel body 292 may have a combined length of 3.282 inches. The maximum outer diameter of the insert 302 may be 1.46 inches.

The top cap 318 includes an annular sidewall 328 defining longitudinal channels 330 on the outside for gripping and turning the top cap 318. The inside of the sidewall defines internal threading 332 that cooperates with the threading on the arcuated threaded projections 316 to mount the top cap 318 and the barrel body 292. The top cap 318 also includes a top portion 334 extending from the annular sidewall 328 and an annular bead 336 about its terminal end.

By way of example only, the top cap 318 may have a maximum height of 0.760 inches and a maximum diameter at the annular bead 336 of 1.54 inches.

The bottom cap 326 includes an annular sidewall 337 with an externally threaded portion 338 that cooperates with the internal threads 324 of the barrel body 292 to mount the bottom cap 326 to the barrel body 292. The sidewall 337 also defines longitudinal channels 340 on the outside for gripping and turning the bottom cap 326. The bottom cap 326 also includes a top portion 342 extending from the annular sidewall 337. An annular bead 344 extends from the side wall 337 at a transition between the externally threaded portion 338 and the longitudinal channels 340. The inside of bottom cap 326 includes a cylindrical segment 346 and a conical segment 348.

By way of example only, the bottom cap 326 may have a maximum length of 1.102 inches and a maximum outer diameter at the annular bead 344 of 1.524 inches. The externally threaded portion 338 may have a length of 0.392 inches measured from the annular bead 344. The cylindrical segment may have a diameter of 1.025 inches. The conical segment 348 may have an outward taper angle of 20.1 degrees and a maximum diameter of 1.146 inches at a terminal end.

Each barrel 32 is used with either a large wedge insert 350 or a small wedge insert 352. The large wedge insert 350 is used to mount the barrel 32 to the main rod 18, and the small wedge insert 352 is used to mount the barrel 32 to the secondary rod 20 or the optional rod 22. The wedge inserts 350, 352 are disposed in a conical section 297 of the bottom end portion 296 of the barrel body 292 and the conical segment 348 of the bottom cap 326. As the bottom cap 326 is threaded onto the barrel body 292, the wedge inserts 350, 352 apply pressure to the main rod 18 or the secondary or optional rods 20, 22 to lock the barrel 32 in a desired position along the rods 18, 20, 22.

The large wedge insert 350 includes an annular ring 354. The ring 354 includes two ends 356 that define a gap 358 therebetween. The gap 358 allows the ring 354 to be tightened onto the main rod 18. An inner surface 360 of the ring 354 is cylindrical, and an outer surface 362 forms a taper from a center apex 364 to terminal edges 366. By way of example only, the large wedge insert 350 may have a height of 0.400 inches, an inner diameter of 0.5 inches and a maximum outer diameter of 0.580 at the apex 364. The angle of taper for the outer surface 362 extending from the apex 364 to the terminal edges 366 may be 20.1 degrees. The wedge insert 350 may be made of nylon.

The small wedge insert 352 includes an annular ring 368. The ring 368 includes two ends 370 that define a gap 372 therebetween. The gap 372 allows the ring 368 to be tightened onto the secondary rod 20 or the optional rod 22. An inner surface 360 of the ring 354 is formed with arcuate teeth 374 that extend radially inward. The teeth 374 can bite into the secondary rod 20 or the optional rod 22 to lock the barrel 32 in place. An outer surface 376 of the ring 368 forms a taper from a center apex 378 to terminal edges 380.

By way of example only, the small wedge insert 352 may have a height of 0.400 inches, an inner radius of 0.438 inches at the teeth 374, an inner radius of 0.500 in between the teeth 374, and an outer maximum radius of 0.580 at the apex 378. The angle of taper for the outer surface 376 extending from the apex 378 to the terminal edges 380 may be 20.1 degrees. The wedge insert 352 may be made of nylon.

Figure 22A:
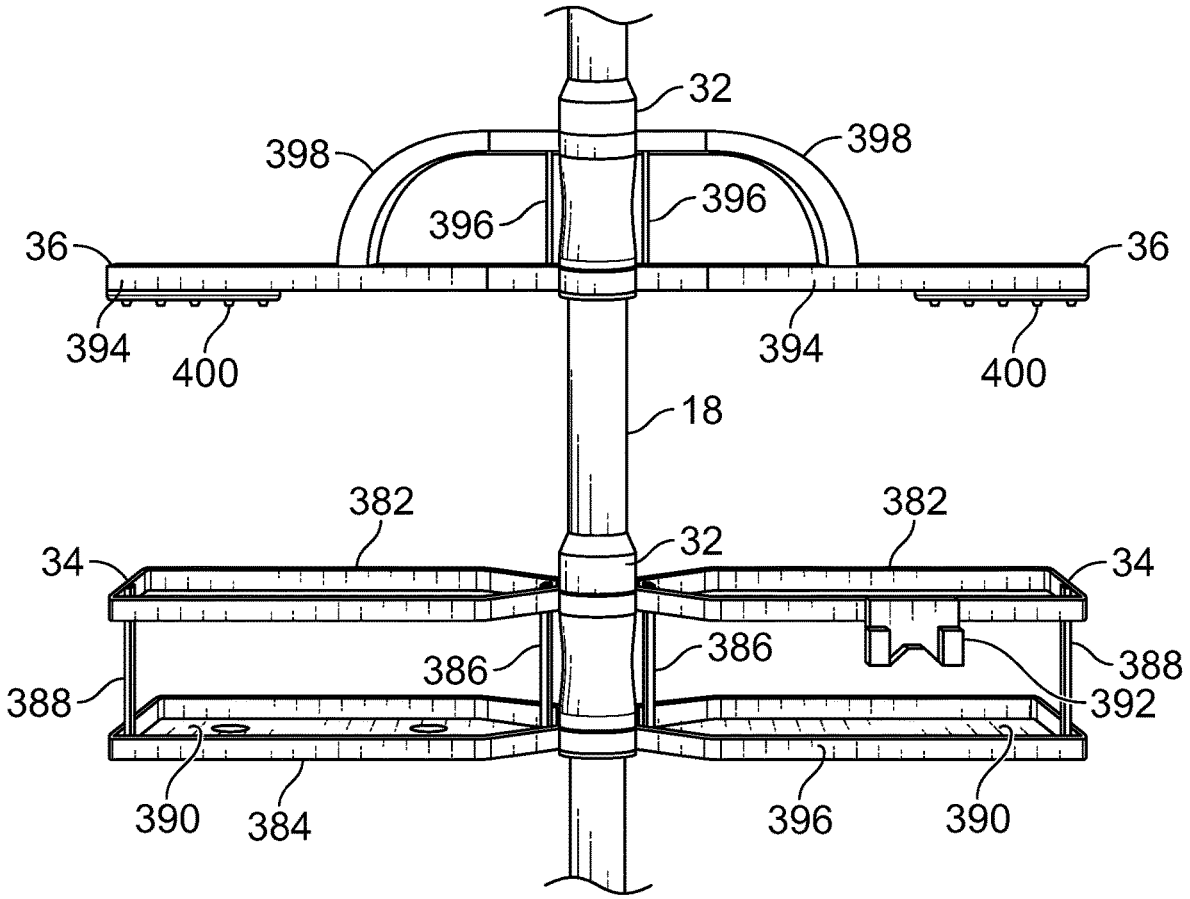
FIG. 22A is a front view of a portion of the customizable shower caddy of FIG. 1 including a pair of baskets and a pair of shelves.
Figure 22B:
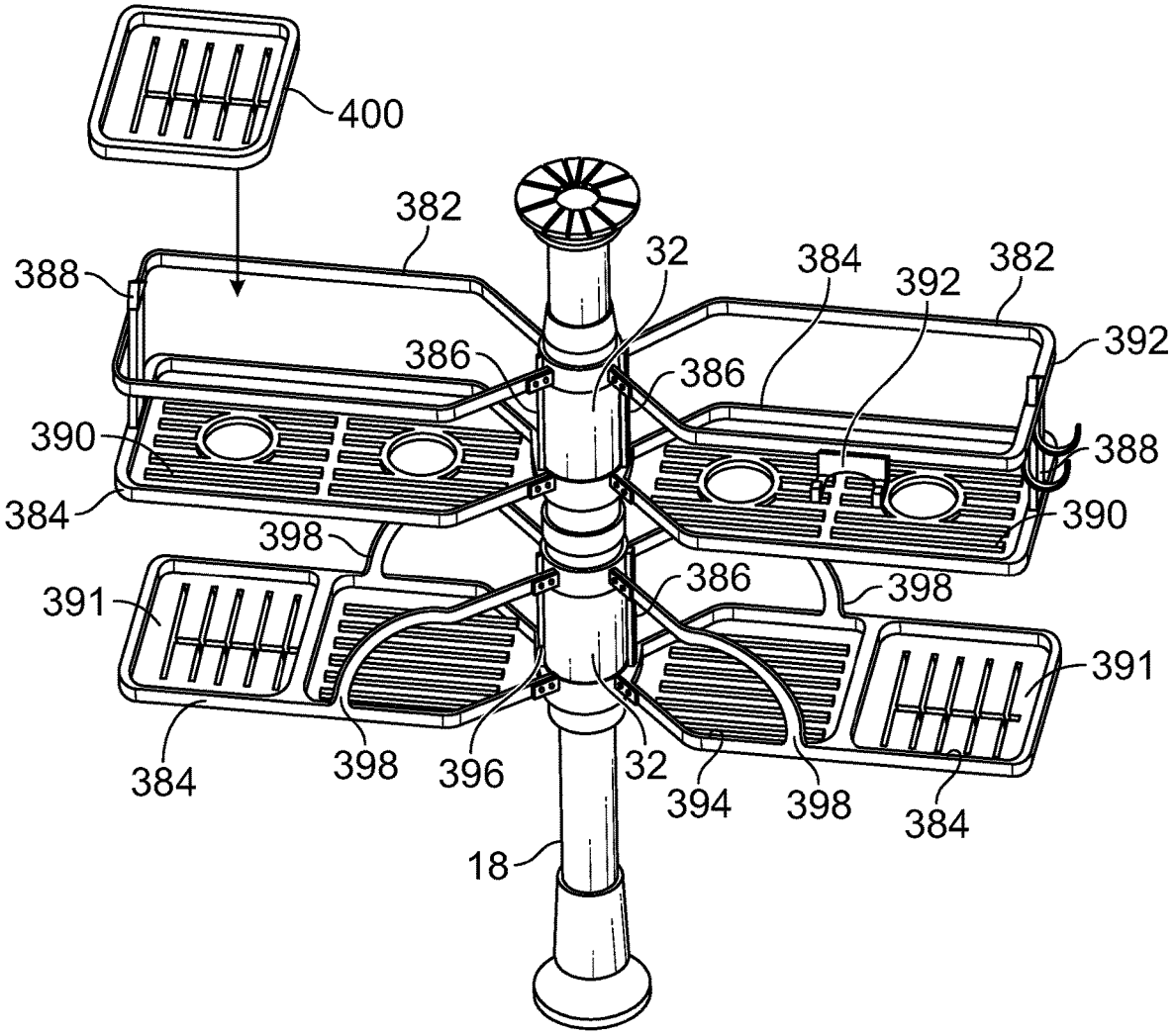
FIG. 22B is a top perspective view of a portion of the customizable shower caddy of FIG. 1.
Figure 23A:
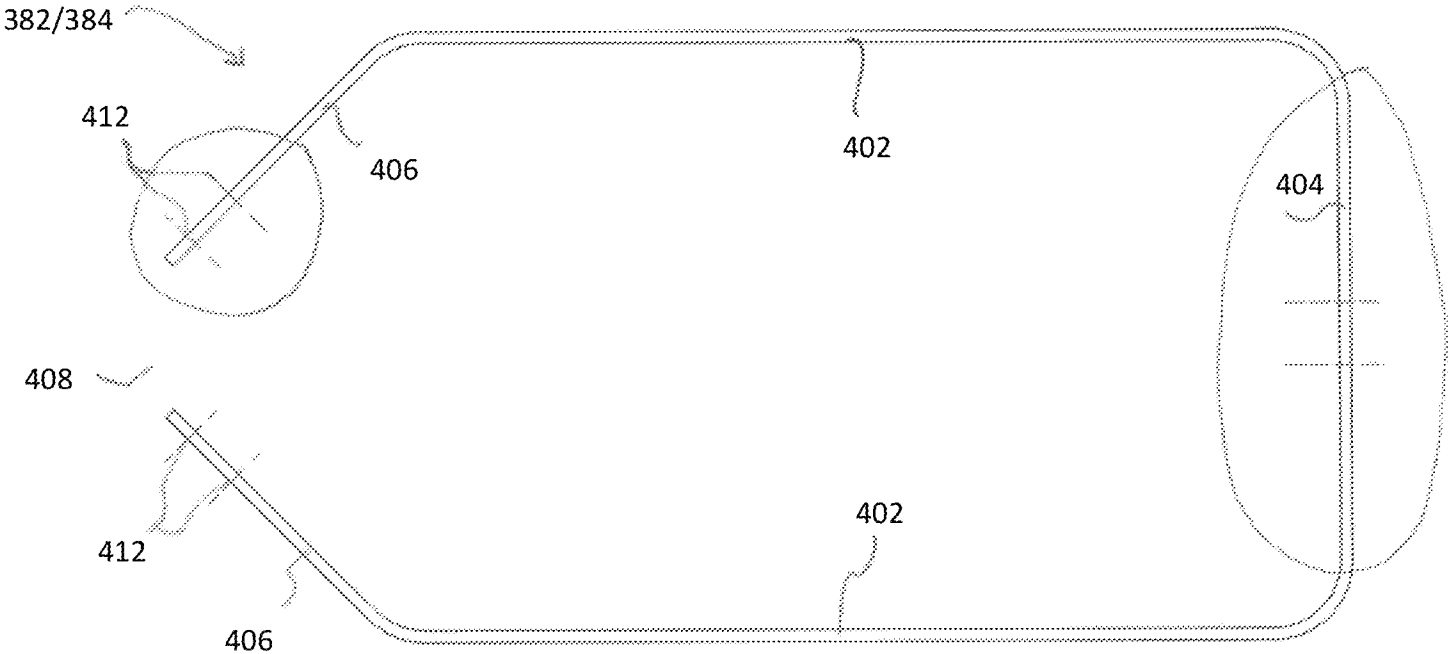
FIG. 23A is a top plan view of a frame of the basket of FIG. 22A-B.
Figure 23B:
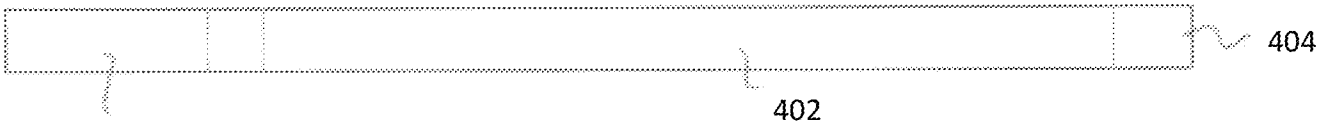
FIG. 23B is a front elevation view of the frame of FIG. 23A.
Figure 23C:
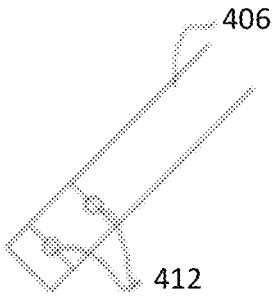
FIG. 23C is an elevation view of an end portion of the frame of FIG. 23A.
Figure 23D:
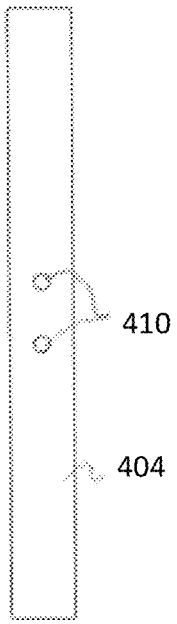
FIG. 23D is an elevation view of an end portion of the frame of FIG. 23A.
Figure 24A:
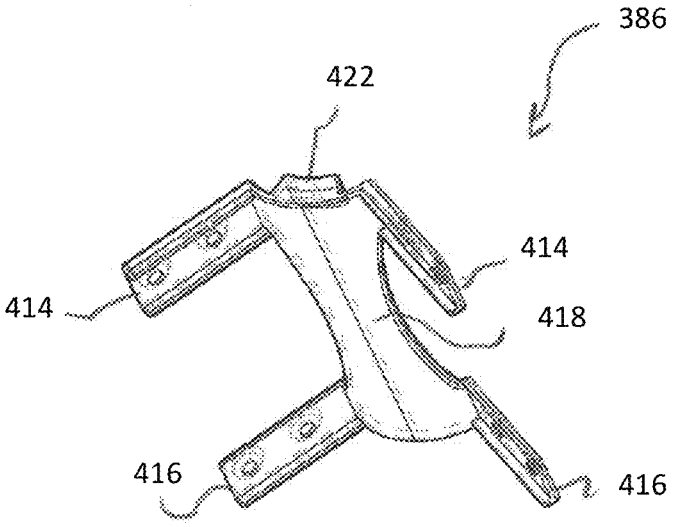
FIG. 24A is a perspective view of a barrel frame support of the customizable shower caddy of FIG. 1.
Figures 24B, 24D:
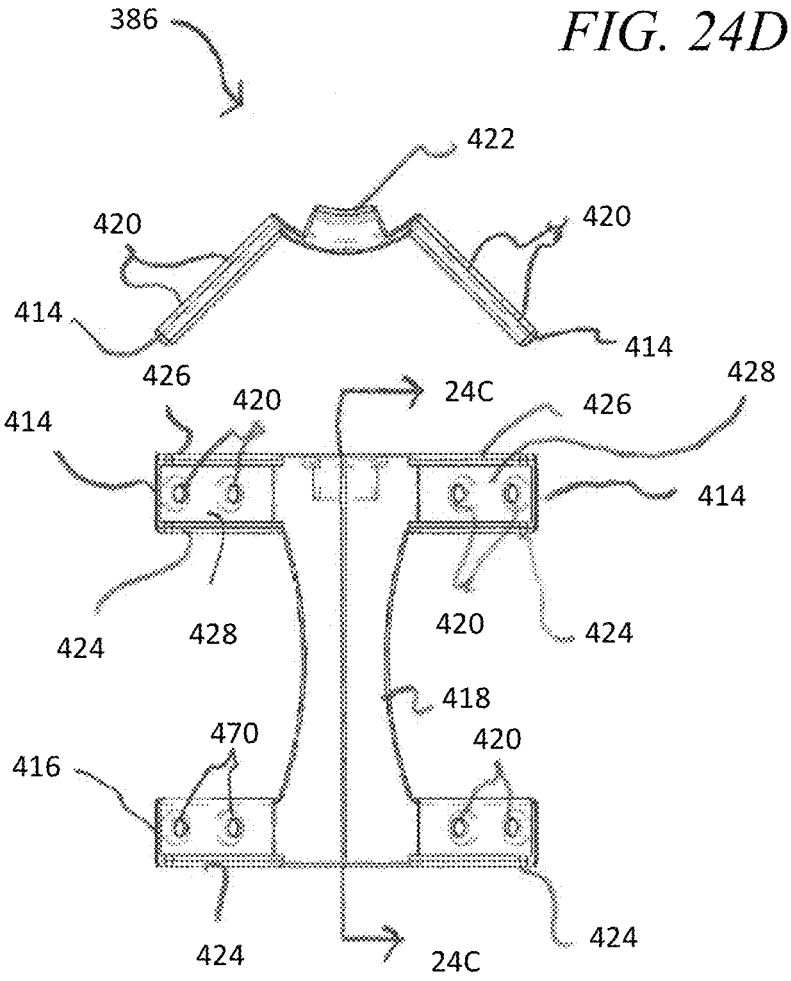
FIG. 24B is a front elevation view of the barrel frame support of FIG. 24A.
FIG. 24D is a side view of an upper wing of the barrel frame support of FIG. 24A.
Figure 24C:
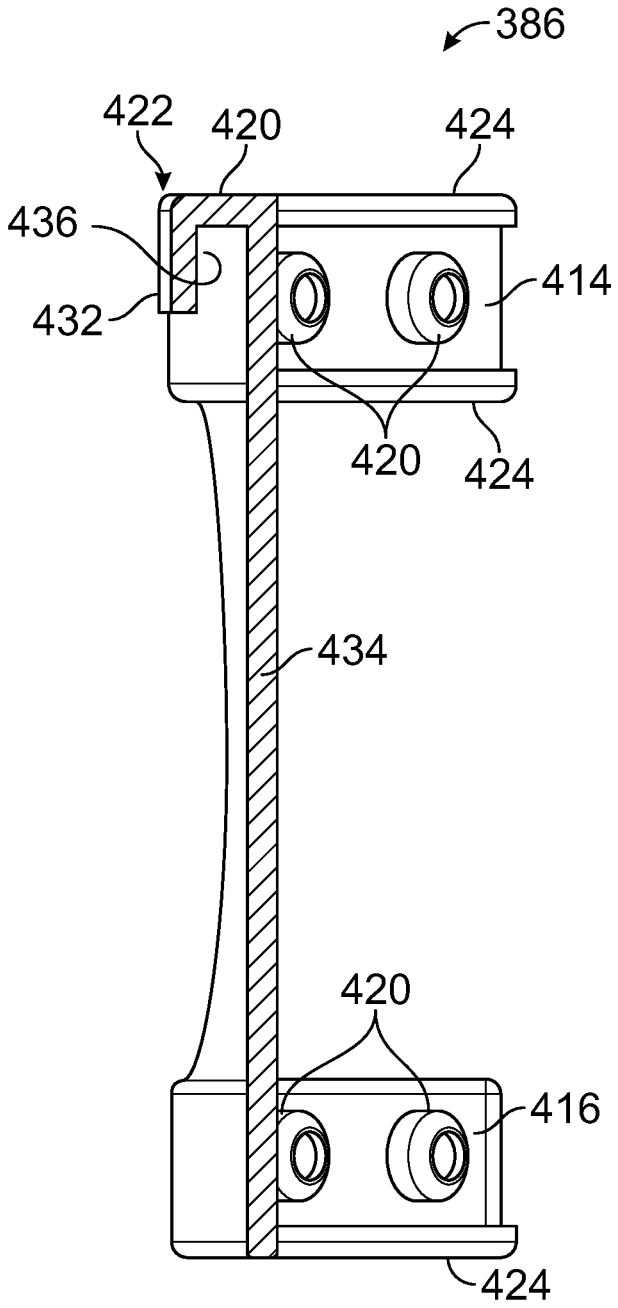
FIG. 24C is a cross-section view of the barrel frame support of FIG. 24A taken along line 24C-24C of FIG. 24B.

Turning to FIGS. 22A and 22B, there is illustrated the main rod 18 with two barrels 32, one holding a pair of baskets 34 and the other holding a pair of shelves 36. Each basket 34 includes an upper frame 382 and a lower frame 384. The frames 382, 384 are spaced from one another and interconnected to each other by a barrel frame support 386 and an end frame support 388. The barrel frame support 386 mounts the basket 34 to the barrel 32 as discussed further below. A large tray 390 may be by the lower frame member 384 and/or the upper frame 382, and a razor hanger 392 is suspended from the upper frame 382.

The shelves 36 each include a frame 394, a barrel support 396 and an arcuate frame support 398. The barrel support 396 mounts the frame 394 to the barrel 32. The arcuate frame 398 interconnects the frame 394 with the barrel support 396. The single frame 394 may support the large tray 390, another tray 391 or a small tray 400. The small tray 400 also may be supported by the upper frame 382 or the lower frame 384 of the basket 36.

With reference to FIGS. 23A-D, the upper frame 382 and the lower frame 384 are identical. The frames 382, 384 include a pair of opposed side members 402 interconnected by an end member 404. The other end of the side members include angled members 406 that from a gap 408 therebetween. The end member 404 defines a pair of holes 410 for mounting to the end frame support 388. The angled members includes a pair of holes 412 for mounting to the barrel frame support 386. The frame of the shelf 36 can have the same structure as the frames 382, 384 of the basket 34.

By way of example only, the frames 382, 384 may have a length of 7.583 inches, a width of 3.90 inches, a height of 0.400 inches. The material for the frames 382, 384 may be aluminum with a thickness of 0.075 inches.

With reference to FIGS. 24A-D, the barrel frame support 386 includes a pair of upper wings 414 and a pair of lower wings 416. A spacer 418 interconnects the wings 414, 416. The wings 414, 416 define a pair of holes 420. The holes 420 are spaced and the wings 414, 416 and are angled so that the holes 420 align with the holes 412 of the angled members 406 of the upper and lower frames 382, 384. Fasteners are used to connect the barrel frame support 386 to the frames 382, 384 using the holes 412, 420. The fasteners may be rivets. The wings 414, 416 include a lower ledge 424 for the frames 382, 384, 394 to sit on when mounted to the barrel frame support 386. The ledges 424 provide support for the frames 382, 384, 394. Further, the upper wings 414 may include an upper ledge 426 that forms a channel 428 with the lower ledge 424.

The hook 422 includes a lateral member 430 and a longitudinal member 432. When engaged with the barrel body 292, the lateral member 430 rests on the arcuate ledge 320, and the longitudinal member 432 inserts into the recess 322. The hook 422 enables the barrel frame support 386 to hang from the barrel 32 to support the basket 34 or shelf 36. The spacer 418 includes an outer surface 434 that engages the hour-glass profile 298 of the barrel body 292 when the barrel frame support 386 is mounted to the barrel 32. The channel 436 is formed by the spacer 418 and the lateral member 430 and the longitudinal member 432 of the hook 422. The top cap 318 may be screwed on to the barrel body 292 to trap the hook between the top cap 318 and the barrel body 292 so that the hook 422 cannot be unintentionally removed from the barrel body 292.

By way of example only, the barrel frame support 386 may have a height of 3.47 inches and wingspan of 2.7 inches at each pair of wings 414, 416. The wings may be angled at 90 degrees to one another. The channel 436 may have a width of 0.146 inches. The hook 422 may be a length of 0.060 inches and an arcuate span of 48 degrees. The barrel frame support 386 may be made from aluminum with a thickness of 0.080 inches.

Figure 25A:
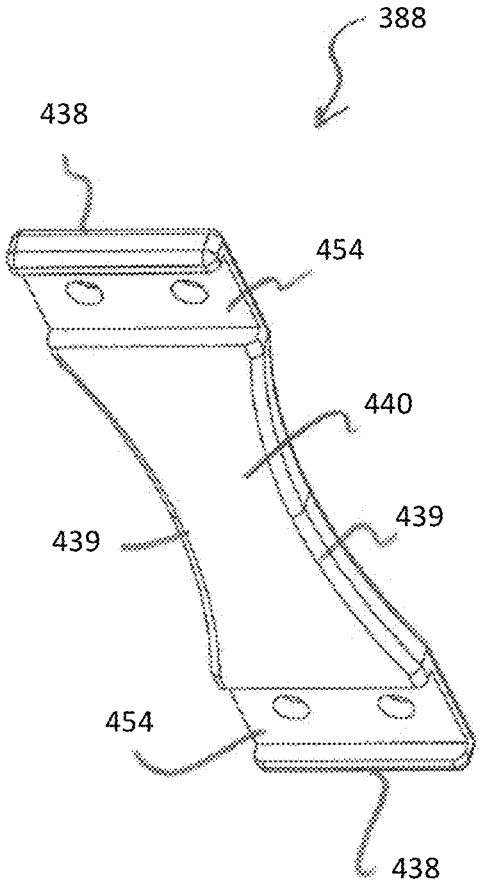
FIG. 25A is a perspective view of an end frame support of the basket of FIGS. 22A-B.
Figure 25B:
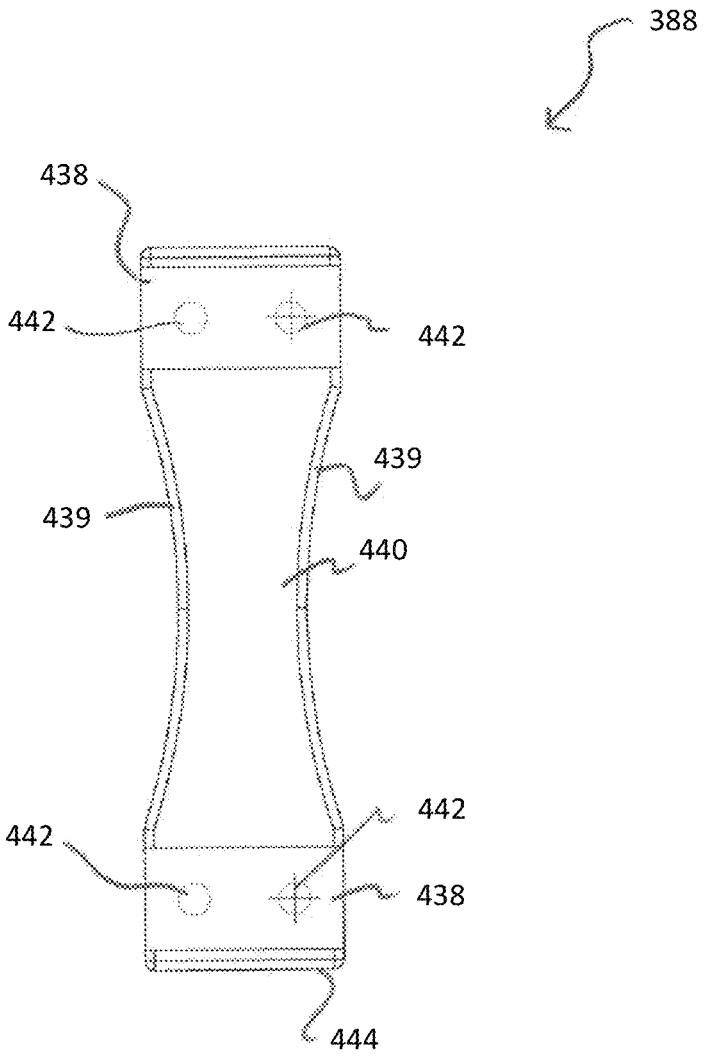
FIG. 25B is a right-side elevation view of the end frame support of FIG. 25A.
Figure 25C:
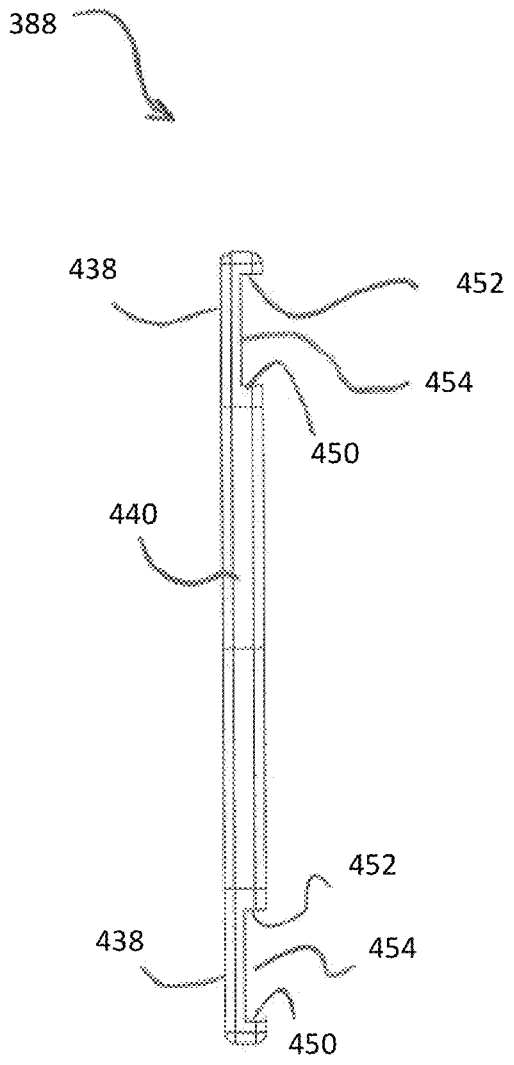
FIG. 25C is an elevation view the end frame support of FIG. 25A.
Figures 26A, 26B, 26C:
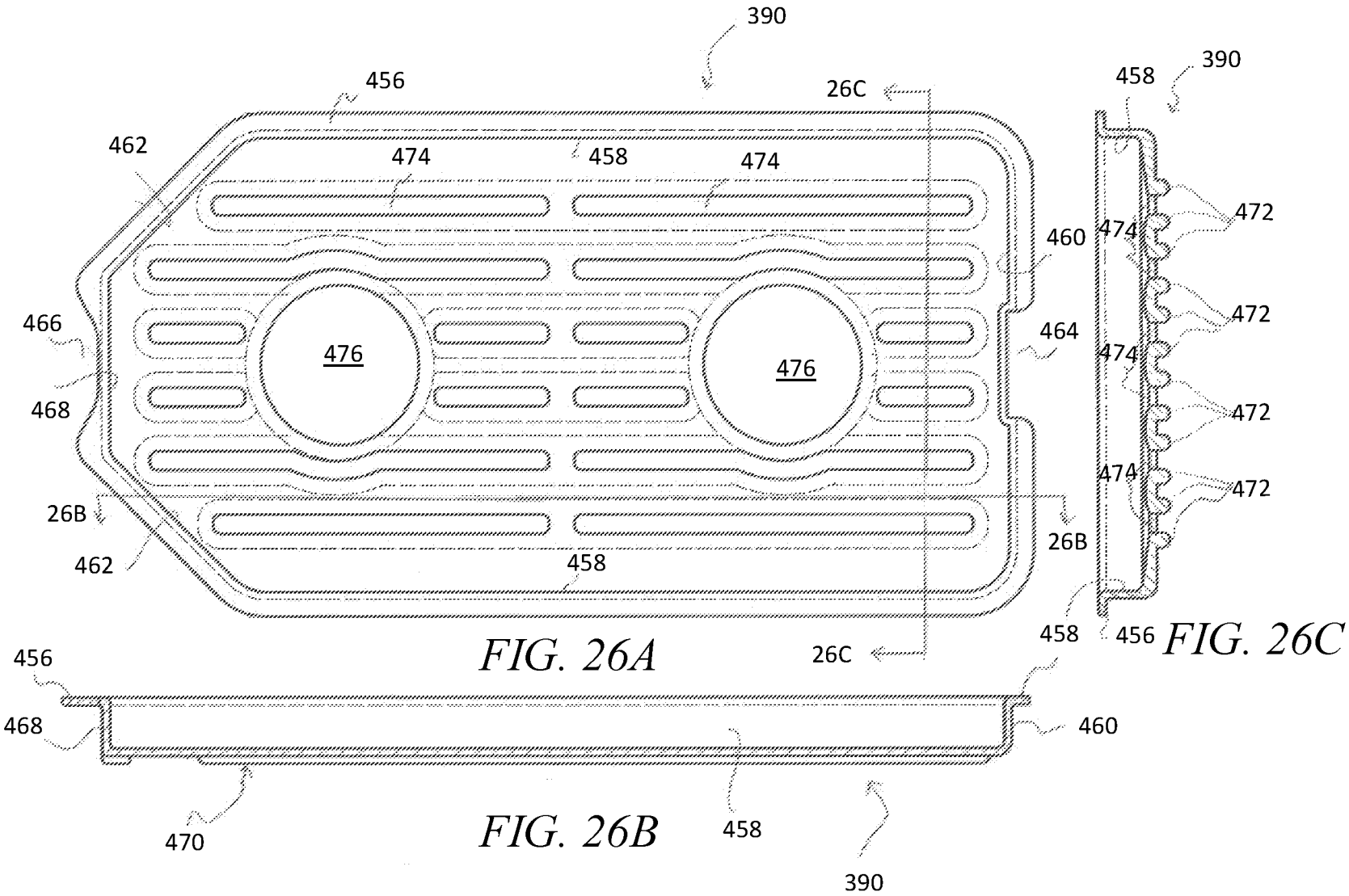
FIG. 26A is a top plan view of a shelf of the customizable shower caddy of FIG. 1.
FIG. 26B is a cross-section view of the shelf of FIG. 26A taken along 26B-26B of FIG. 26A.
FIG. 26C is a side cross-section view of the shelf of FIG. 26A taken along 26C-26C of FIG. 26A.
Figure 26D:
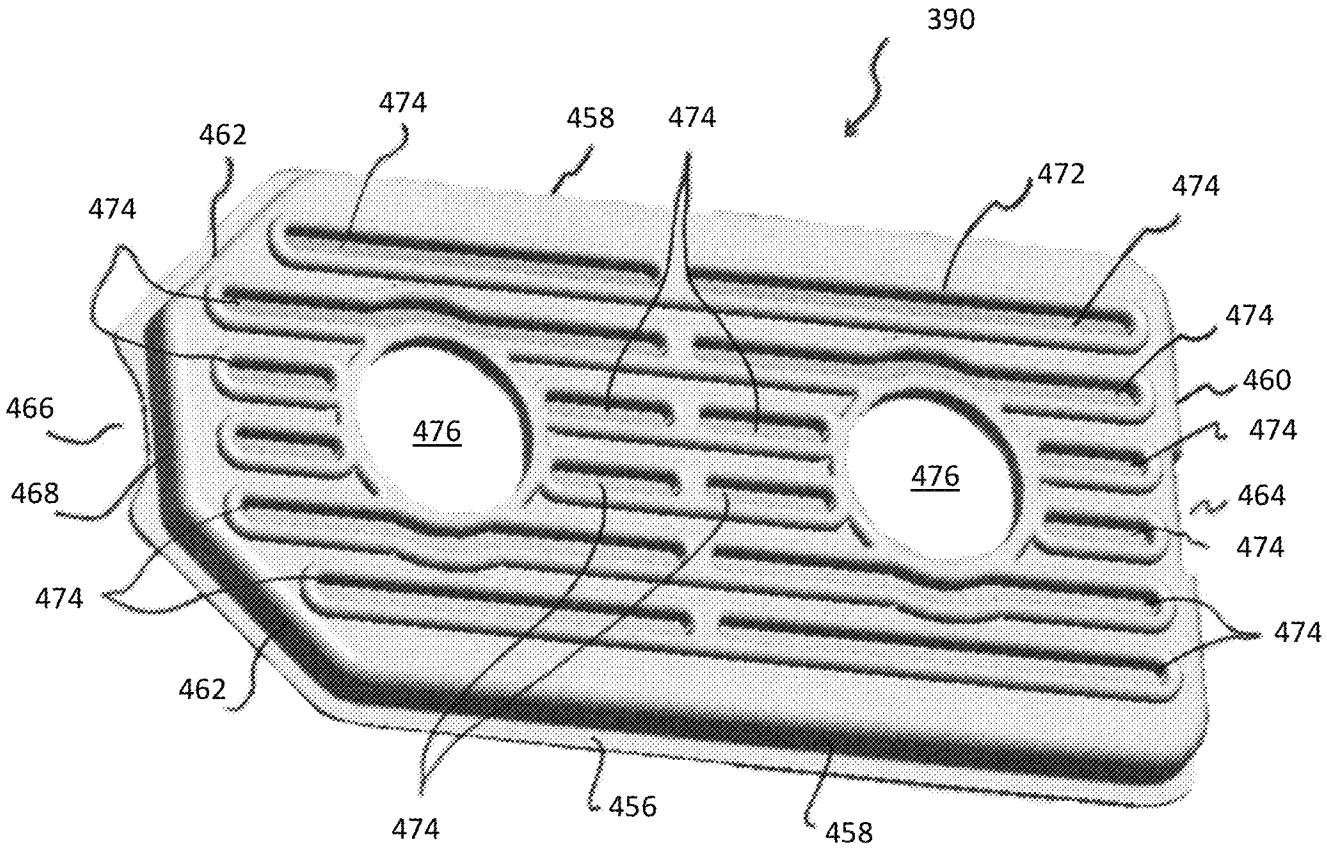
FIG. 26D is a perspective view of the shelf of FIG. 26A.

With reference to FIGS. 25A-C, the end frame support 388 includes mount portions 438 at each end of a central portion 440. The central portion 440 may be hourglass shaped with rolled edges 439 for additional strength. The mount potions 438 include holes 442 spaced to align with the holes 410 of the end member 404 of the upper and lower frames 382, 384. Fasteners extend through the holes 410, 442 to connect the end frame support 388 to the frames 382, 384. The fasteners may be rivets. The mount portions 438 include lower ledges 450 on which the frames 382, 384 may sit and be supported. The mount portions 438 may include a second ledge 452 that forms a channel 454 with the other ledge 450.

By way of example only, the end frame support 388 may be made from 0.08 inches thick aluminum. The end frame support may have a maximum width at the mount portions 438 of 0.80 inches and a length of 2.92 inches.

Regarding FIGS. 26A-26D, there is illustrated a large tray 390. The tray 390 includes an outer shape corresponding to the lower frame 384 or frame 394. The tray 390 includes a flange 456 that traces its perimeter. The flange 456 rests on the lower frame 384 or frame 394 to be supported by the frames 384, 394. The tray 390 includes side walls 458, an end wall 460 and a pair of angled walls 462. A recess 464 is centrally located in the flange 456 along the end wall 460. Another recess 466 in the flange 456 is located along a second end wall 468 that connects the angled walls 462. The tray 390 includes a bottom 470 consisting of a set of longitudinal ribs 472 defining longitudinal extending slots 474 and a pair of circular openings 476. The slots 474 and openings 476 enable water to drain from the tray 390.

By way of example only, the tray 390 may have a length of 7.58 inches, a width of 3.960 inches and a height of 0.520 inches. The tray 390 may be made from plastic.

Figures 27A, 27B, 27C:
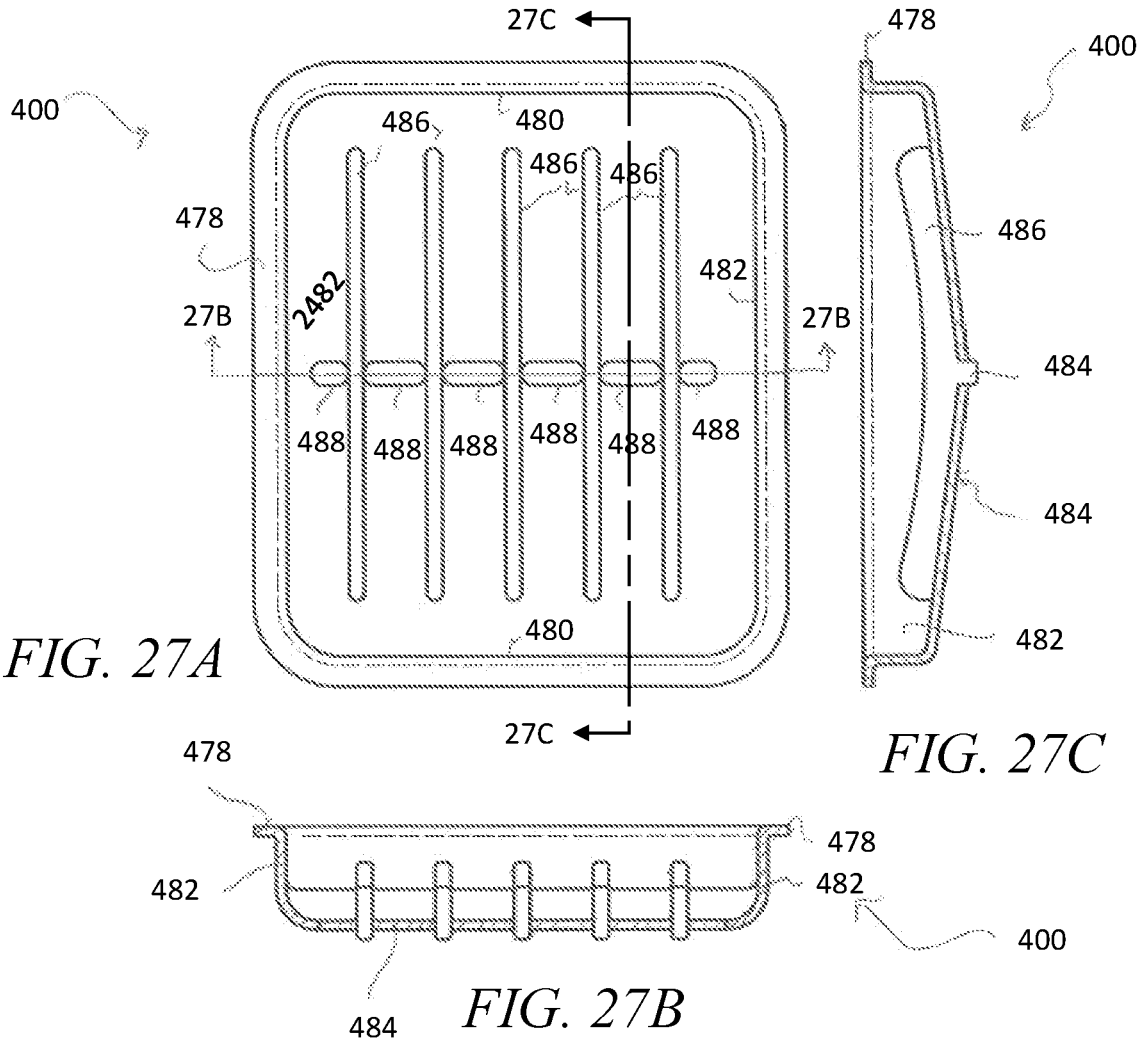
FIG. 27A is a top plan view of a small tray of the customizable shower caddy of FIG. 1.
FIG. 27B is a cross-section view of the small tray of FIG. 27A taken along line 27B-27B of FIG. 27A.
FIG. 27C is a cross-section view of the small tray of FIG. 27A taken along line 27C-27C of FIG. 27A.

Regarding FIGS. 27A-27C, there is illustrated a small tray 400. The tray 400 includes a flange 478 that traces its perimeter. The flange 478 rests a portion of the frames 382, 384 or frame 394 to be supported by the frames 382, 384, 394. The tray 400 includes side walls 480 and end walls 482. The tray includes a bottom 484 with a series of ribs 486 and openings 488 to drain water. The bottom 484 slopes toward the openings to assist in draining water from the tray 400.

By way of example only, the tray 400 may have a length of 3.390 inches, a width of 3.960 inches and a height of 0.720 inches. The tray 390 may be made from plastic.

Figure 28C:
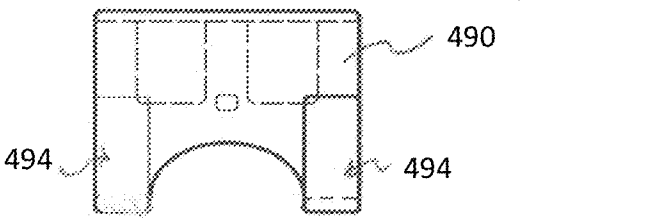
FIG. 28C is a front elevation view of the razor hanger of FIG. 28A.
Figure 28B:
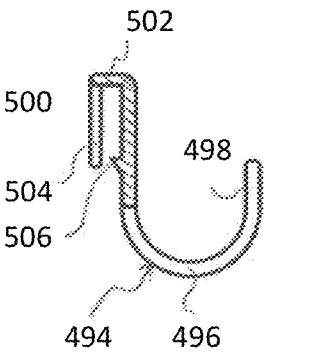
FIG. 28B is a cross-section view of the razor hanger of FIG. 28A taken along line 28B-28B.
Figure 28A:
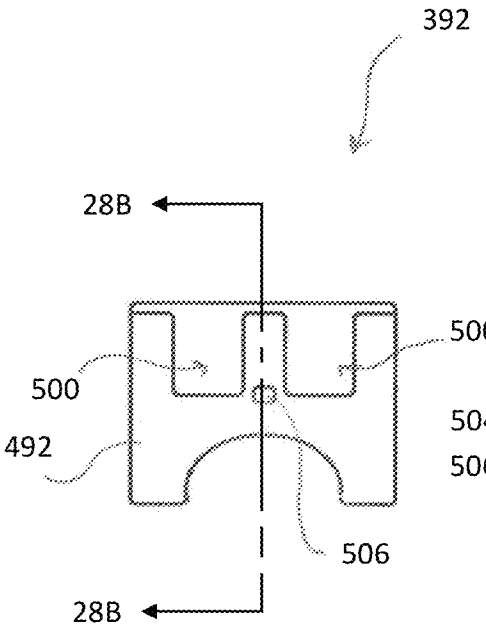
FIG. 28A is a back elevation view of a razor hanger of the customizable shower caddy of FIG. 1.

With reference to FIGS. 28A-28C, the razor hanger 392 hangs from one of the frames 382, 384, 394. The razor hanger 392 includes a frontside 490 and backside 492. Razor hooks 494 extend over the frontside 490 and are spaced so that the hooks 494 hold a cutting head of a razor while allowing a handle of the razor to extend down between the hooks 494. The razor hooks 494 include a curved section 496 and an upturned straight section 498. Mounting hooks 500 extend over the backside 492. The mounting hooks 500 include a lateral portion 502 that reaches over the frame 382, 384, 394 and a longitudinal portion 504 that extends down along the frame 382, 384, 394. A tab 506 projects from the backside 490 and extends over a bottom edge of the frame 382, 384, 394, while the lateral portion 502 of the mounting hooks extends over a top edge of the frame 382, 384, 394. This locks the razor hanger 392 onto the frame 382, 384, 394 against unintentional separation.

By way of example only, the razor hanger 392 may have a width of 1.50 inches and a height of 1.14 inches. The maximum depth of the razor hander 392, including the razor hooks 494 and the mounting hooks 500, may be 0.96 inches.

Figure 29A:
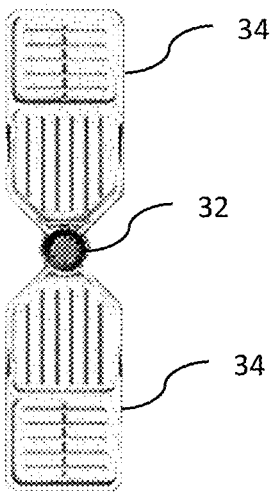
FIG. 29A is a two-basket arrangement where the baskets are 180 degrees to one another.
Figure 29B:
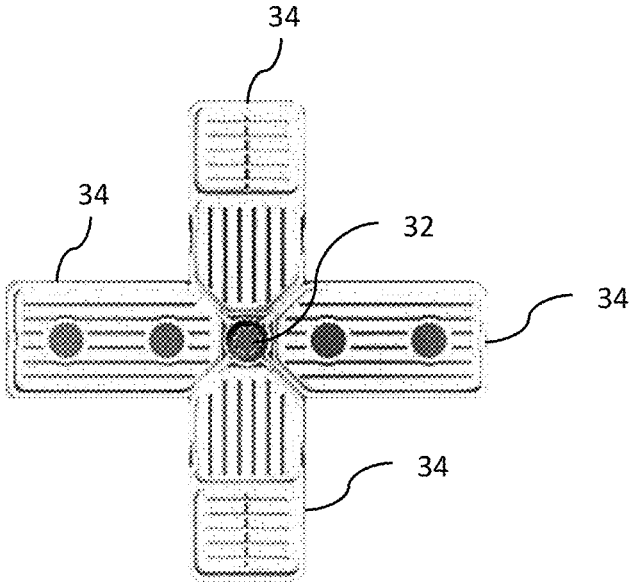
FIG. 29B is a four-basket arrangement where the baskets are 90 degrees to one another.
Figure 29C:
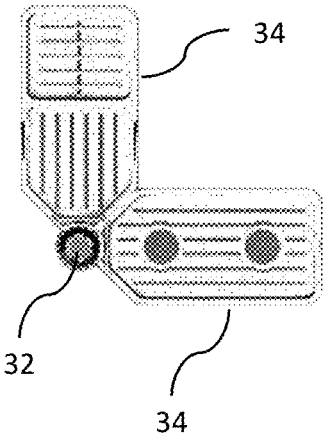
FIG. 29C is a three-basket arrangement where the baskets are 90 degrees to one another.
Figure 29D:
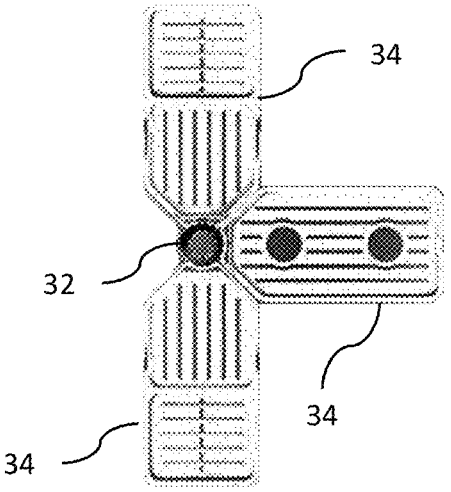
FIG. 29D is a two-basket arrangement where the baskets are 90 degrees to one another.
Figure 30A:
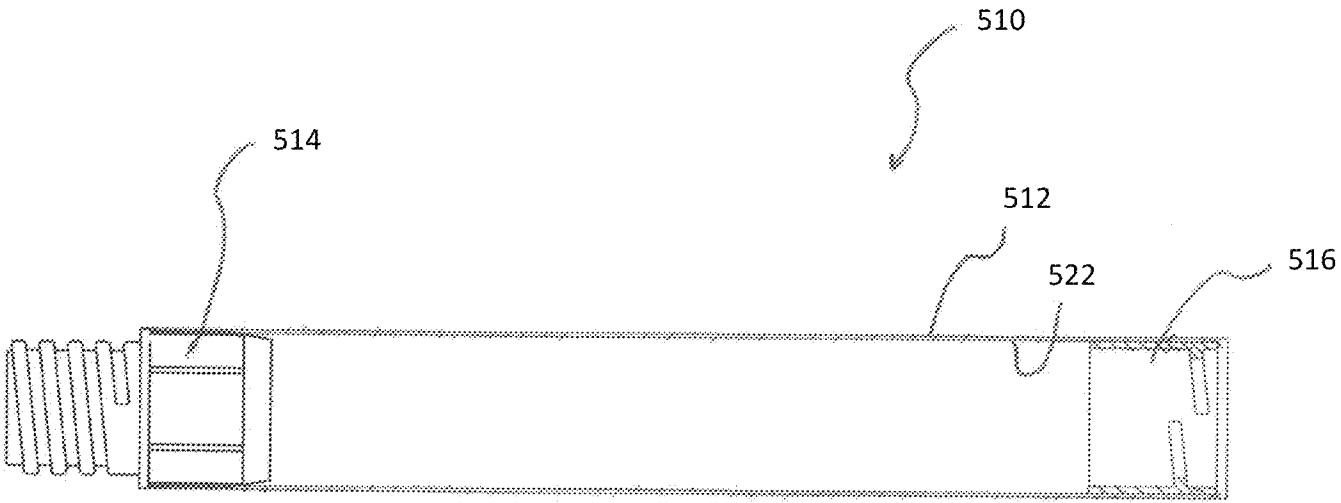
FIG. 30A is a cross-section view of an alternative extension rod.
Figure 30B:
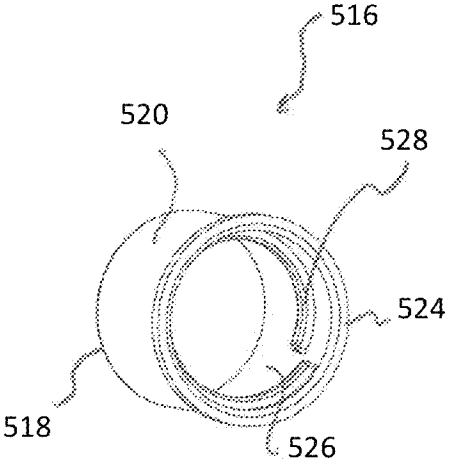
FIG. 30B is a perspective view of a main rod connection insert of the alternative extension rod of FIG. 30A.
Figure 30C:
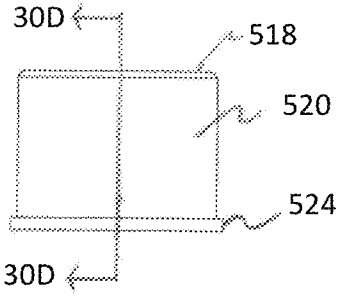
FIG. 30C is an elevational view of the main rod connection insert of FIG. 30B.
Figure 30D:
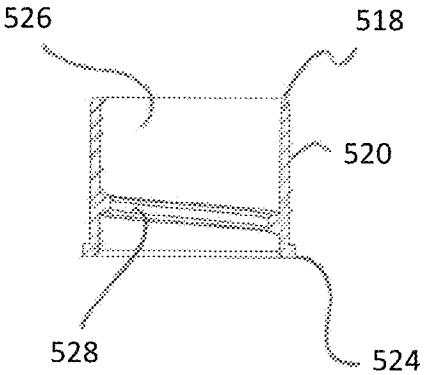
FIG. 30D is a cross-section view of the main rod connection insert of FIG. 30A taken along line 30D-30D of FIG. 30C.

With reference to FIGS. 29-29C, there is illustrated different, but not limiting, configurations of the baskets 34. For instance, FIG. 29 shows two baskets 34 mounted from the barrel 32 at 180 degrees apart. In FIG. 29B, there is shown four baskets 34 mounted to the barrel 32 at 90 degrees to another. FIG. 29C shows two baskets 34 mounted at 90 degrees to one another, while FIG. 29D shows three brackets 34 mounted at 90 degrees to one another.

As show in FIGS. 30A-30D, there is illustrated an alternative, optional extension rod 510. The extension rod 50 is configured to connect between the main rod 18 and the bottom end cap 24. The extension rod 510 includes a hollow tube 512. One end of the hollow tube 512 is fitted with an end cap connection insert 514, and the other end of the hollow tube 512 is fitted with a main rod connection insert 516. The end cap connection insert 514 is the same as insert 38 described above in connection with FIGS. 4A-4B and will not be described here again.

The main rod connection insert 516 is designed to receive and connect to insert 38 attached to the main rod 18. The insert 516 includes a first end 518 with a chamfer to aid in inserting the insert 516 into the end of the hollow tube 512. The insert 516 includes a cylindrical outer surface 520 that engages an inner surface 522 of the hollow tube 512 with a friction fit to prevent unintentional removal of the insert 516 from the hollow tube 512 and unintentional rotation of the insert 516 relative to the hollow tube 512. The insert 516 includes a second end with an annular flange 524 that engages an end of the hollow tube 512 to prevent complete insertion of the insert 516 into the hollow tube 512. An interior wall 526 of the insert 526 defines an interior helical groove 528 that engages the exterior thread of the insert 38.

By way of example only, the extension rod 510 may have a length of 12 inches and a diameter of one inch. The rod 510 may be made aluminum. The insert 516 may have a length of 0.75 inches, an outer diameter of 0.93 inches and an inner diameter of 0.85 inches. Ends of the internal groove 528 may have a circumferential spacing of 0.05 inches such that the groove does not make a complete helix turn. The insert 516 may be made from ABS plastic.

With reference to FIGS. 31A-31F, there is illustrated a rotatable end cap 600 for use with the customizable shower caddy 10. The rotatable end cap 600 is a free spinning end cap that differs from the adjustable top end cap 26 of FIGS. 18A-18B in that the end cap 600 is not capable of adjusting its axial position relative to the rod 18, 20, 22 to which the end cap 600 is attached by rotation. The end cap 600 will be described as connected to the main rod 18 (see FIG. 31E). The end cap 600, however, may similarly be connected to the secondary rod 20 or optional rod 22 or even to another other rod system, such as a shower curtain rod system. In some forms, the shower caddy includes a rod formed of additional rod segments, such as four, five, six, seven, or more rod segments. Increasing the number of rod segments used to form the rod system reduces the length of each rod segment which allows the rod system to be packaged in a smaller box which may decrease storage and shipping costs. The end cap 600 has a bell-shaped body 602 with an inner portion 604 and an outer portion 606. The end cap 600 includes a cylindrical inner wall 607 defining a cylindrical socket or cavity 608 for receiving the rod 18 of the shower caddy 10. The inner diameter of the inner wall 607 may be slightly larger than the diameter of the rod 18 such that the rod 18 may be inserted into the cavity 608 but allow that free rotation between the end cap 600 and the rod 18.

The end cap 600 includes an end wall 610 within the cavity 608 against which the rod 18 may abut when fully inserted into the end cap 600. The end wall 610 may include one or more retention prongs 612 (see FIGS. 31C-31E) that connect the end cap 600 to the rod 18. The retention prongs 612 are configured to engage a portion of the rod 18 when the rod 18 is inserted into the end cap 600 to hook the rod 18 and prevent the rod 18 from being unintentionally withdrawn from the cavity 608. In the embodiment shown in FIGS. 31A-31E, the end cap 600 includes three retention prongs 612. In other embodiments, one, two, four or more retention prongs 612 may be used.

Figure 31A:
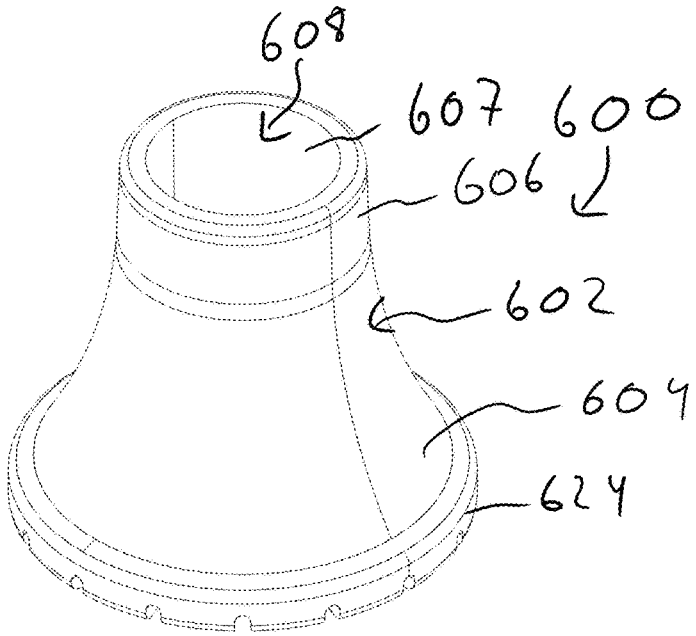
FIG. 31A is a bottom perspective view of an end cap and a rubber pad of the customizable shower caddy of FIG. 1 according to another embodiment.
Figure 31B:
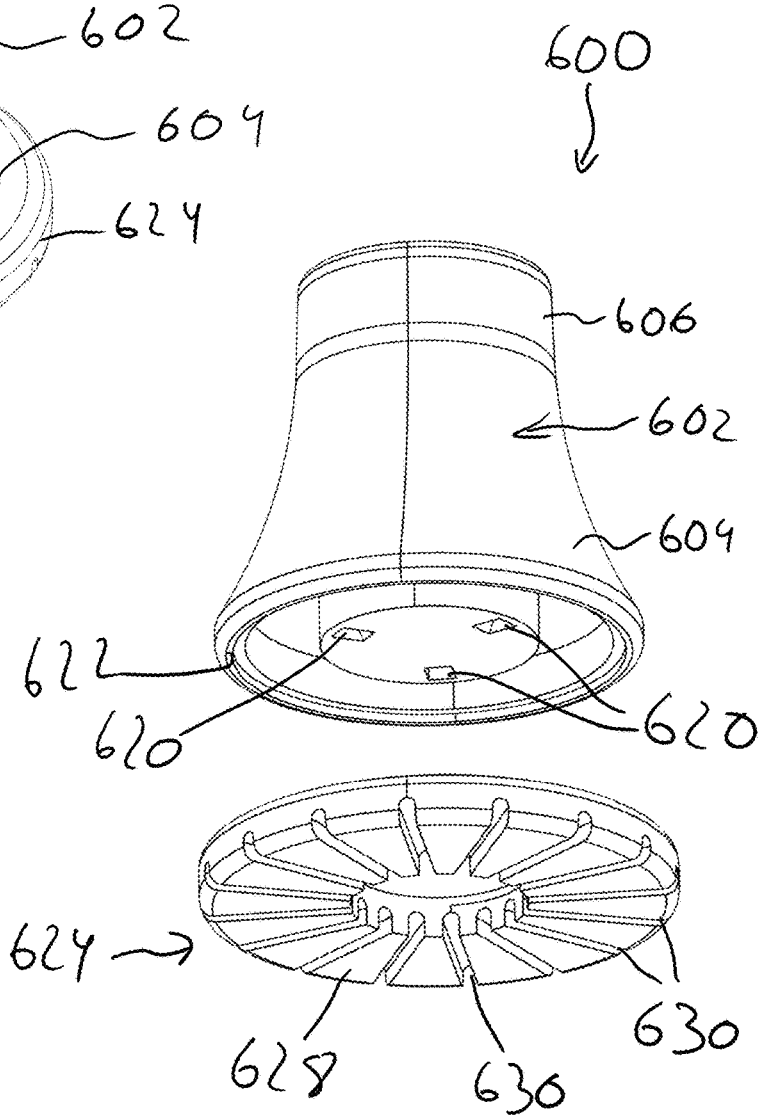
FIG. 31B is an exploded view of the end cap and the rubber pad of FIG. 31A.
Figure 31D:
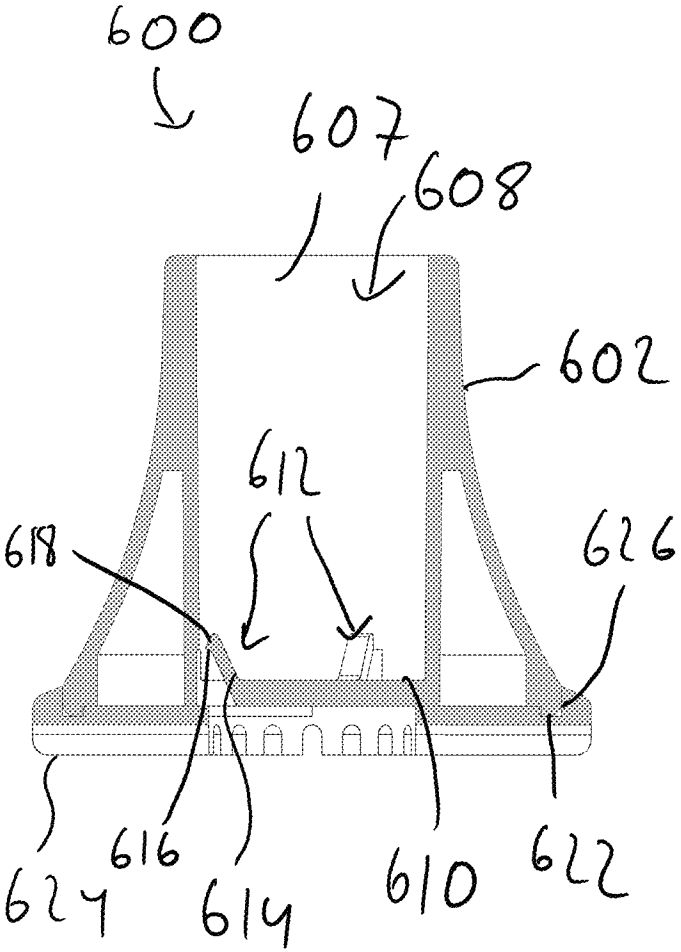
FIG. 31D is a cross-section view of the end cap of FIG. 31A taken along lines 31D-31D of FIG. 31C.
Figure 31C:
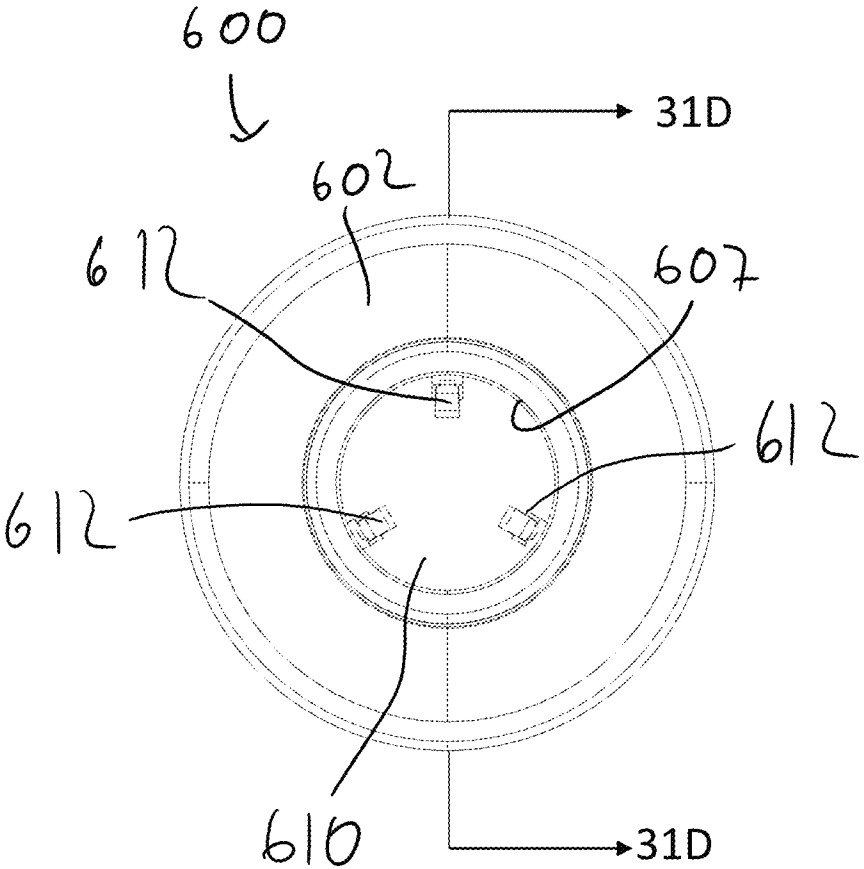
FIG. 31C is a bottom plan view of the end cap of FIG. 31A.
Figure 31E:
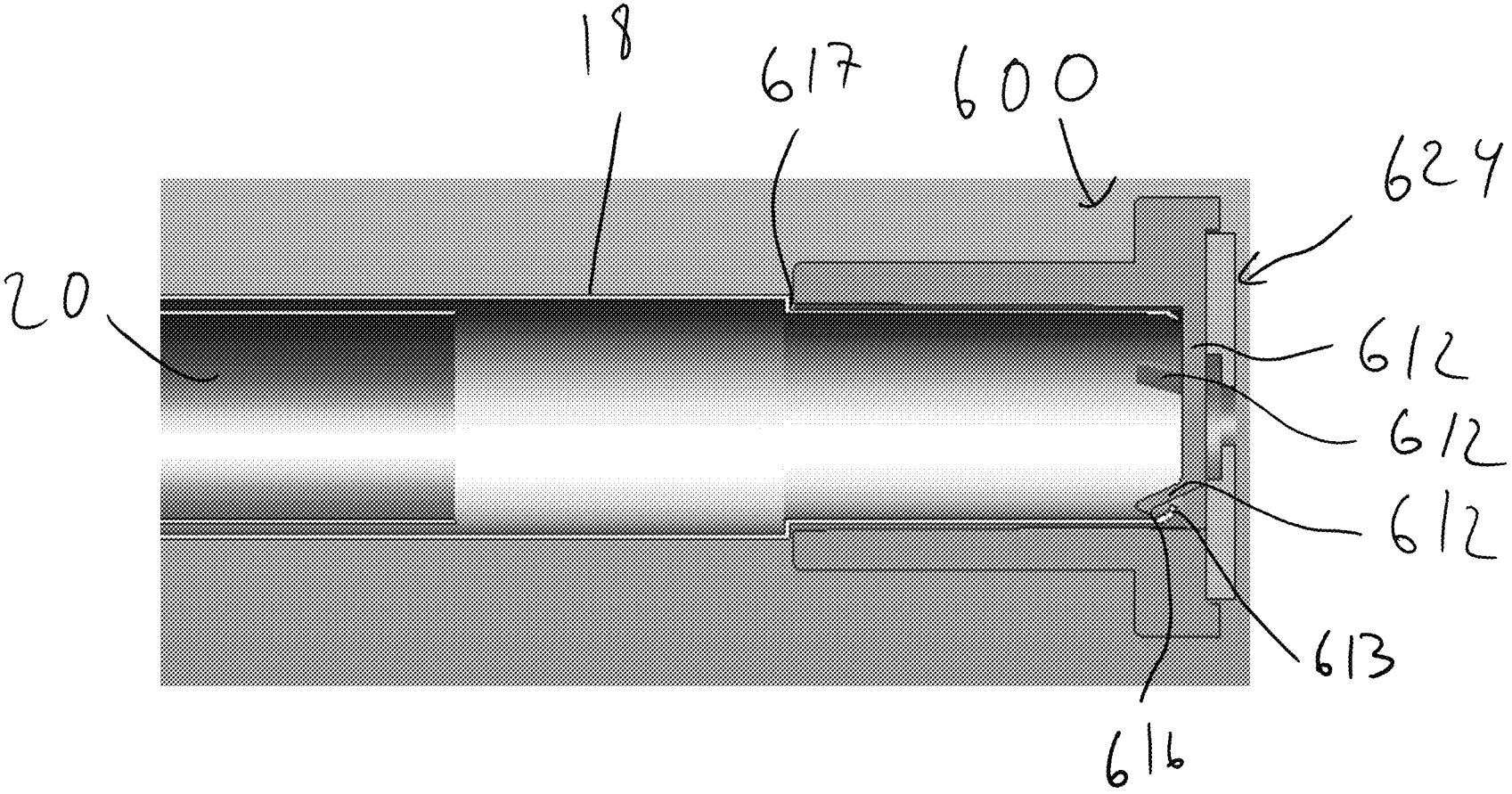
FIG. 31E is a side cross-section view of the end cap of FIG. 31A connected to the main rod.
Figure 31F:
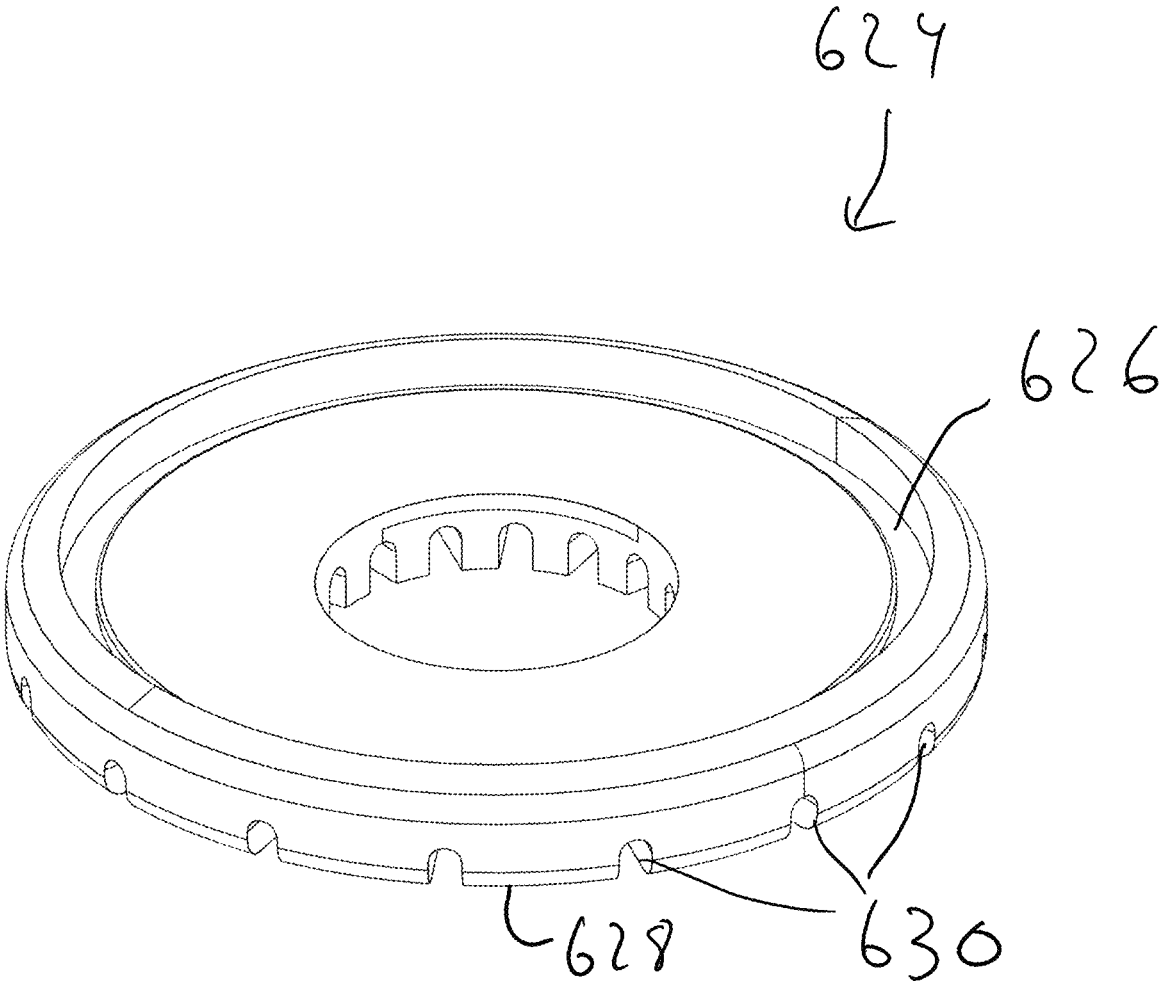
FIG. 31F is bottom perspective view of the rubber pad of FIG. 31A.

The retention prongs 612 include a deflectable arm 614 that extends from the end wall 610 and into the cavity 608. The arms 614 may extend at an angle from the end wall 610 radially outward toward the inner wall 607. The end of the arm 614 opposite the end attached to the end wall 610 includes a barb or hook 616 with a camming surface 618. The hooks 616 of the retention prongs 612 are positioned to engage the end of the rod 18 as the rod 18 is inserted toward the end wall 610. The hooks 616 of the retention prongs 612 are shaped to hook an interior lip, ridge, or ledge extending radially inward from an interior surface of the rod 20, 22. For instance, as shown in FIG. 31E, a terminal end 615 of the rod 18 may taper radially inward or be bent inward to form a lip 613 that the retention prongs 612 hook. Because the lip 613 extends continuously within the rod 18, the end cap 600 may be rotated relative to the rod 18 about its axis without becoming detached from the rod 18. More specifically, the hooks 616 may slide along the lip 613 to permit rotation but remain hooked to the lip 613 to prevent the end cap 600 from moving substantially in the axial direction relative to the rod 18 and becoming disconnected from the rod 18.

The rod 18 may include a step 617 transition to an end portion of the rod 18 having a decreased diameter that fits within the cavity 618 of the end cap 600 (e.g., to the diameter of the secondary rod 20). The step 617 may be configured to abut the end cap 600 when the rod 18 is inserted into the cavity 618 of the end cap 600 to prevent the rod 18 from being over inserted into the end cap 600. The step 617 may also provide a bearing surface that engages the end cap 600 to support rotation of the rod 18 relative to the end cap 600.

The end wall 610 may include access openings 620 corresponding to each retention prong 612. The access openings 620 provide a user with access to the retention prongs 612 when the end cap 600 is connected to the rod 18. A user may detach the rod 18 from the end cap 600 by deflecting one or more of the retention prongs 612 inward so that the hooks 616 no longer hook the lip 613 of the rod 13 and withdrawing the rod 18 from the end cap 600. For example, a user may extend a screwdriver through the access openings 620 to deflect the retention prongs 612 inward.

A rubber pad 624 may be attached to a terminal end 622 of the end cap 600. Similar to the rubber pad 80 of FIGS. 7A-7C, the rubber pad 624 provides increased frictional engagement with the shower basin 28 or ceiling to limit or prevent the shower caddy 10 from walking and/or sliding during installation and to provide a secure installation. The terminal end 622 of the end cap 600 may be sized to be inserted into a recess 626 (see FIG. 31F) of the rubber pad 624. The terminal end 622 may be inserted into the recess 626 of the rubber pad 624 to connect the rubber pad 624 to the end cap 600, for example, by a friction fit connection. The rubber pad 624 can be secured to the terminal end 622 by an adhesive such as glue. A bottom 628 of the rubber pad 80 includes radially extending channels 630 to enable water and/or air to escape during the installation process and after being installed.

In use, the rod 18 is inserted into the cavity 608 of the end cap 600 toward the end wall 610. The lip 613 of the end of the rod 18 is brought into engagement with the camming surfaces 618 of the retention prongs 612 causing the retention prongs 612 to deflect radially inward. The rod 18 is inserted into the end cap 600 between the retention prongs 612 and the inner wall 607 until the hooks 616 of the retention prongs 612 pass over the interior lip 613 of the rod 18. Once the retention prongs 612 pass over the interior lip 613 of the rod 18, the retention prongs 612 elastically return toward their original shapes with the hooks 616 hooking the interior lip 613 of the rod 18. The retention prongs 612 may be deflected inward via the access openings 620 to disconnect the end cap 600 from the rod 18.

The retention prongs 612 connect the end cap 600 to the end of the rod 18 while permitting the end cap 600 to rotate freely relative to the rod 18. This configuration enables the main rod 18 and secondary rod 20 (and optional rod 22) to be rotated during installation to adjust the adjustable end cap 24 at the bottom of the shower caddy 10 with minimal frictional resistance from the top end cap 600 (e.g., the rod 18 rotates relative to the end cap 600 which remains stationary relative to the ceiling). While the end cap 600 has been described as replacing the top end cap 26, those having skill in the art will appreciate that the end cap 600 may similarly replace the bottom end cap 24. Also, as mentioned above, the end cap 600 can be used with any type of rod system, including, for example, a curtain rod system.

Figure 32:
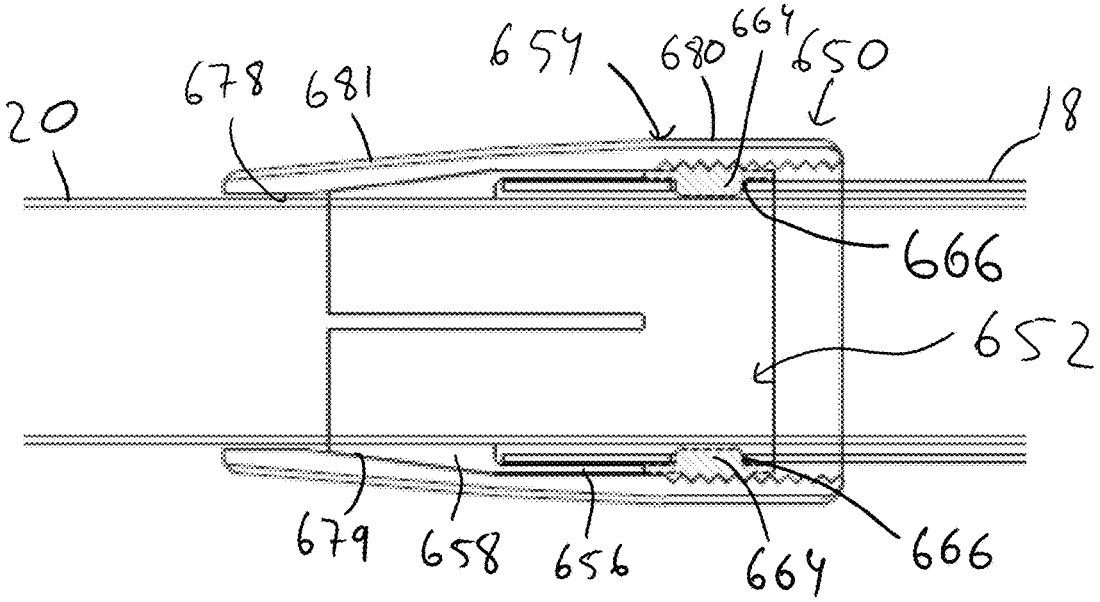
FIG. 32 is a cross-section view of a lock assembly of a second alternative embodiment for use with the customizable shower caddy of FIG. 1.
Figure 33A:
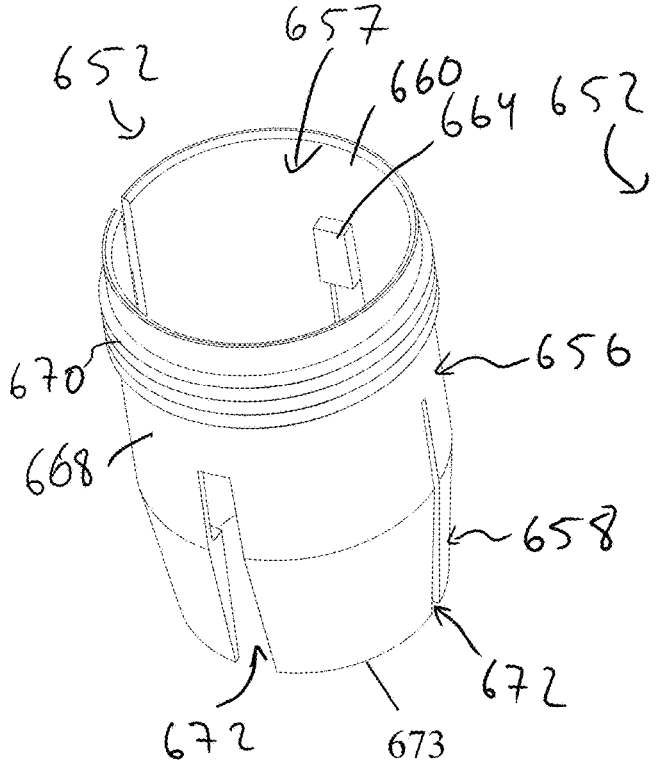
FIG. 33A is a bottom perspective view of an inner sleeve of the rod connector of FIG. 32.
Figure 33B:
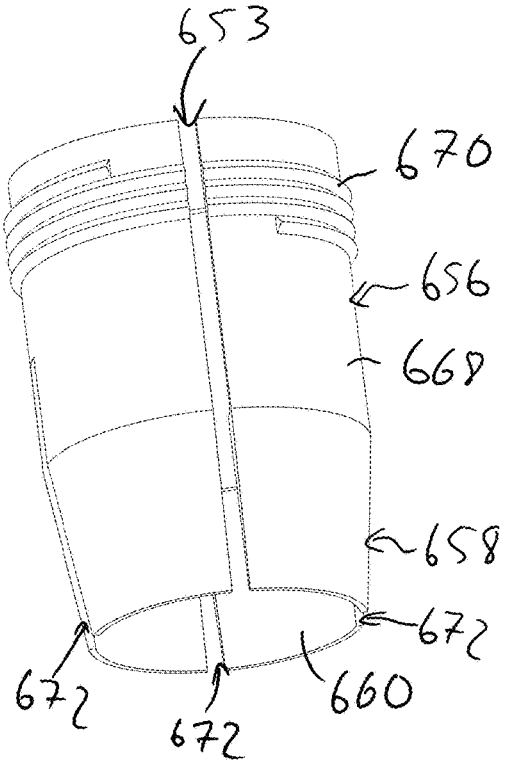
FIG. 33B is a top perspective view of the inner sleeve of FIG. 33A.
Figure 33C:
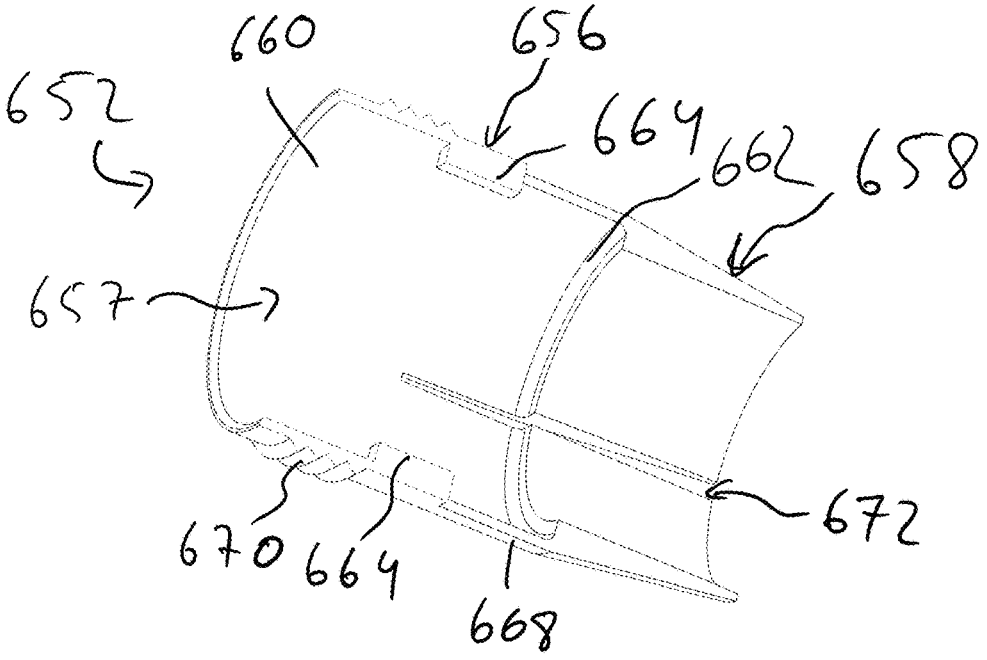
FIG. 33C is a perspective cross-section view of the inner sleeve of FIG. 33A.
Figure 34:
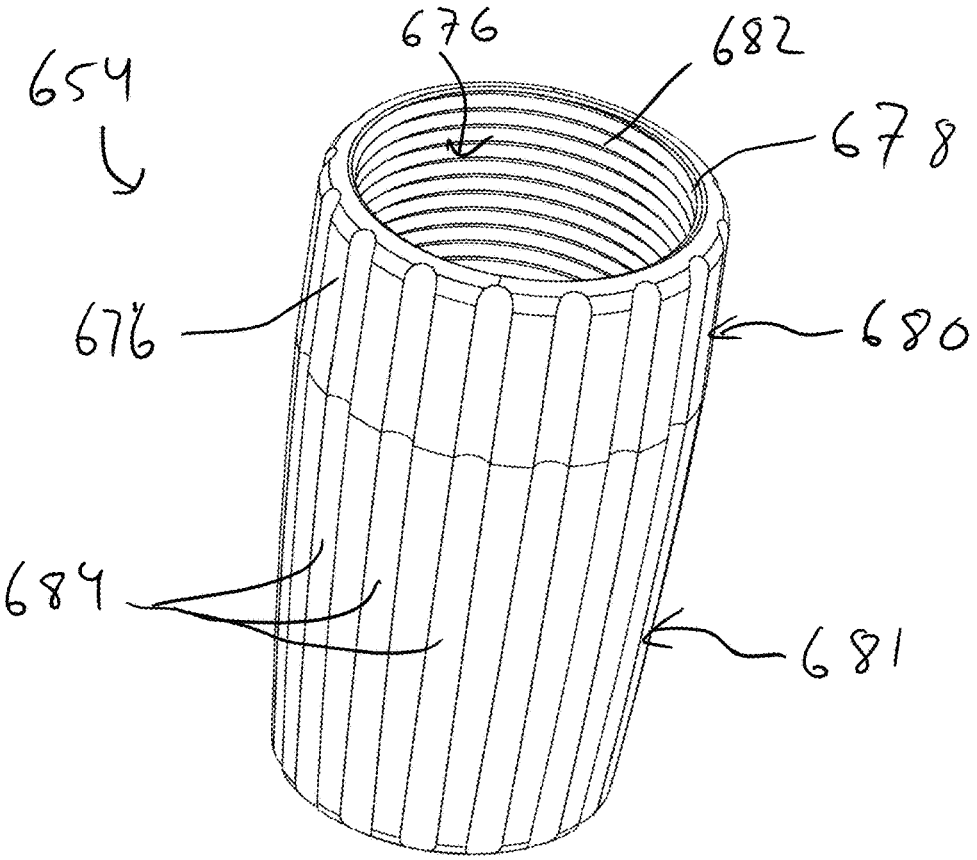
FIG. 34 is a bottom perspective view of an outer sleeve of the rod connector of FIG. 32.

With reference to FIGS. 32-34, a lock assembly 650 for use with the shower caddy 10 is provided according to an alternate embodiment. The lock assembly 650 may be used in place of the lock assemblies 102, 180 provided above to lock rods 18, 20 from moving axially relative to one another. The lock assembly 650 mounts on the outside of the main and secondary rods 18, 20. The lock assembly also may be used to lock the rods in any type of rod system, including, for example, a curtain rod system.

The lock assembly 650 includes an inner sleeve 652 and an outer sleeve 654. With respect to FIGS. 33A-33C, the inner sleeve 652 has a receiving portion 656 and a wedge portion 658. The inner sleeve 652 has a slit configuration with an axially extending gap 653 extending along the length of the inner sleeve 652. The inner sleeve 652 defines a longitudinally extending passage 657 therethrough. An inner surface 660 of the inner sleeve includes step 662 between the receiving portion 656 and the wedge portion 658 such that the wedge portion 658 has a smaller diameter than the receiving portion 656. The diameter of the inner surface 660 at the receiving portion 656 is sized to receive an end of the main rod 18. The diameter of the inner surface 660 at the wedge portion 658 is sized to receive the secondary rod 20. The step 662 may serve as a stop to prevent the main rod 18 from being inserted through the receiving portion 656 and into the wedge portion 658.

The receiving portion 656 includes locking protrusions 664 extending radially inward from the inner surface 660. The main rod 18 includes corresponding holes 666 extending through the side of the rod 18 on the end that is inserted into the receiving portion 656. The locking protrusions 664 are aligned with and inserted into the corresponding holes 666 of the main rod 18 to connect the inner sleeve 652 to the main rod 18 so to prevent unintentional axial and rotational movement between the two components.

An outer surface 668 of the inner sleeve 652 at the receiving portion 656 is substantially cylindrical and includes threads 670 disposed thereon for engaging corresponding threads 682 of the outer sleeve 654. The outer surface 668 of the wedge portion 658 has a conical shape that tapers inward as the wedge portion 658 extends from the receiving portion 656.

The inner sleeve 652 includes gaps 672 that extend axially through the wedge portion 658 and partially through the receiving portion 656. The gaps 672 define four arcuate fingers 673 of the wedge portion 658. The arcuate fingers 673 may move or flex independently of one another and may be forced toward one another to close or partially close the gaps 672 to change the diameter of the wedge portion 658. The gaps 672 thus permit the diameter of the wedge portion 658 to change size more significantly when force is applied to the wedge portion 658. For example, the gaps 672 aid in decreasing the diameter of the wedge portion 658 when a compressive force is applied to the wedge portion 658 as described in further detail below. The inner sleeve 652 may be made from ABS plastic.

With respect to FIGS. 32 and 34, the outer sleeve 654 is substantially cylindrical and has an outer surface 676 and an inner surface 678. The inner surface 678 defines a longitudinally extending passage 676. The outer sleeve 654 has cylindrical portion 680 and a tapered portion 681. The inner surface 678 of the cylindrical portion 680 includes threads 682 that cooperate with the threads 670 of the inner sleeve 652. The inner surface 678 of the tapered portion 681 is conical and tapers inward as the tapered portion 681 extends away from the cylindrical portion 680 (see FIG. 32). The tapered portion of the inner surface 678 is a camming surface 679 that engages the wedge portion 658 of the inner sleeve 652 to force the wedge portion 658 against the secondary rod 20. An outer surface 682 of the outer sleeve 654 includes longitudinally extending ribs 684 about the outer sleeve 654. The ribs 684 aid in gripping the outer sleeve 654 to manually rotate the outer sleeve 654 relative to the inner sleeve 652.

With reference to FIG. 32, the inner sleeve 652 is connected to the main rod 18 by inserting the end of the main rod 18 into the receiving portion 656. The main rod 18 may be rotated relative to the inner sleeve 652 until the locking protrusions 664 of the inner sleeve 652 snap into and/or are inserted into the holes 666 of the main rod 18. The outer sleeve 654 is threaded onto the inner sleeve 652. The wedge portion 658 of the inner sleeve 652 may be inserted into the passage 676 of the outer sleeve 654 through the cylindrical portion 680 to bring the threads 682 of the outer sleeve 654 into engagement with the threads 670 of the inner sleeve 652. The secondary rod 20 is inserted into the main rod 18 and through the inner sleeve 652 and outer sleeve 654. The secondary rod 20 may be moved axially to the desired position relative to the main rod 18 to set a combined length of the main rod 18 and secondary rod 20 to a desired amount. The outer sleeve 654 is rotated to thread the outer sleeve 654 onto the inner sleeve 652 and to force the camming surface 679 of the outer sleeve 654 into engagement with the wedge portion 658 of the inner sleeve 652. As outer sleeve 654 is threaded onto the inner sleeve 652, the conical camming surface 679 travels axially toward the main rod 18 applying a compressive or inward force to the wedge portion 658 of the inner sleeve 652. The wedge portion 658 of the inner sleeve 652 is thereby forced against the secondary rod 20 and applies a pressure to the secondary rod 20 to prevent the secondary rod 20 from moving axially relative to the main rod 18. This prevents the rods 18, 20 from unintentionally moving or slipping relative to one another. In some configurations, the inner sleeve 652 is formed of or includes a high friction material, such as a rubber, that increases the frictional engagement between the inner sleeve 652 and the secondary rod 20.

The locking assembly 650 may thus be used to set the combined axial length of the shower caddy 10 by moving the secondary rod 20 to a desired position relative to the main rod 18 and locking the rods from axial movement relative to one another via the locking assembly 650.

Figure 35A:
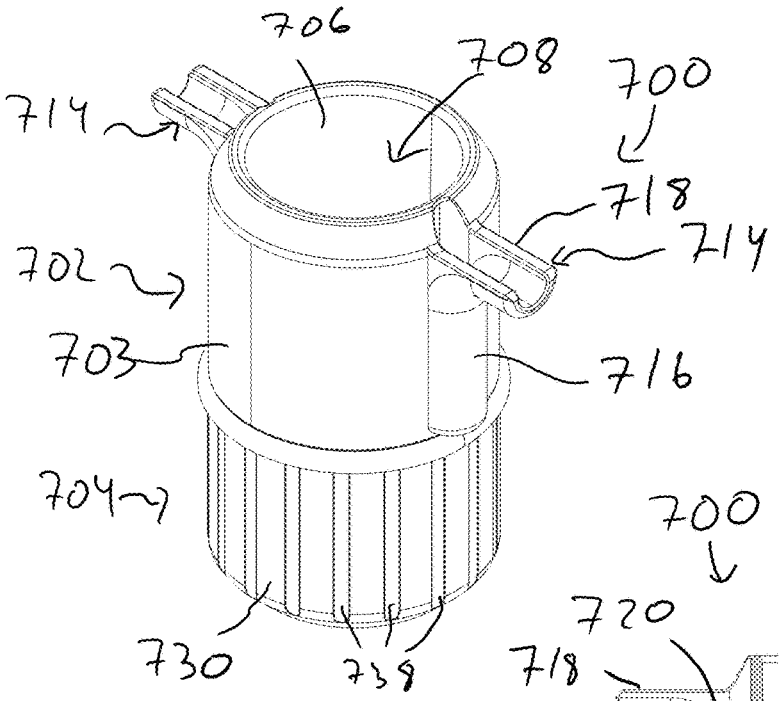
FIG. 35A is a top perspective view of a barrel connector of the customizable shower caddy of FIG. 1 according to a first alternative embodiment.
Figure 35B:
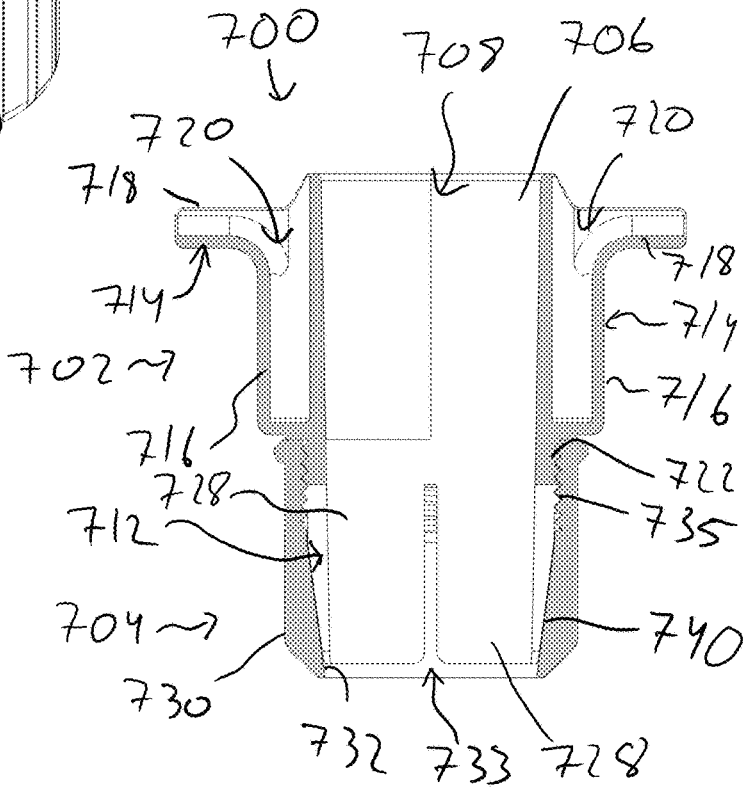
FIG. 35B is a cross-section view of the barrel connector of FIG. 35A.
Figure 35C:
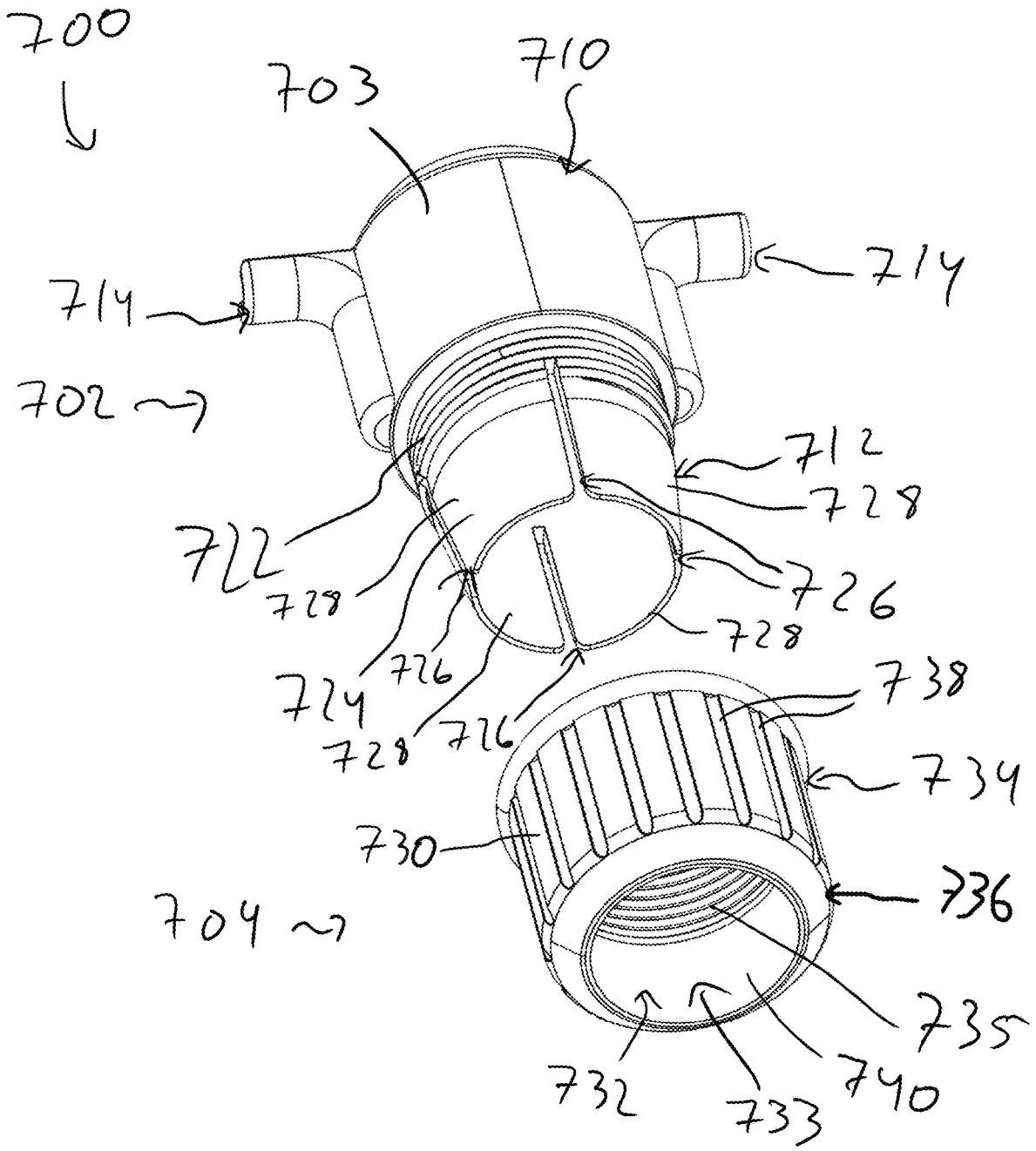
FIG. 35C is an exploded view of the barrel connector of FIG. 35A.

With reference to FIGS. 35A-35C, a barrel 700 for supporting shelves or baskets along the rods 18, 20 is provided according to an alternate embodiment. The barrel 700 is similar to the barrel 32 described above with respect to FIGS. 21A-21L in that the barrel 700 supports shelves and baskets and the position of the barrel 700 is adjustable. One or more barrels 700 may be mounted along the rods 18, 20, 22 at locations where a shelf or basket is desired.

The barrel 700 includes a barrel body 702 and a cap 704. The barrel body 702 includes an inner surface 706 that defines a central passage 708 therethrough. The barrel body 702 has a cylindrical portion 710 and a wedge portion 712 (see FIG. 35C). The central passage 708 has a diameter sized to receive the main rod 18 and/or the secondary rod 20.

The top portion of the barrel body 702 includes a pair of supports 714 extending along an outer surface 703 of the cylindrical portion 710. The supports 714 include a longitudinal portion 716 extending longitudinally along the cylindrical portion 710 that curves to a radial portion 718 extending radially outward of the cylindrical portion 710. The supports 714 may define a channel 720 for receiving L-shaped attachment wires 852 of a shelf 850 to secure the shelf 850 to the barrel 700, as described in further detail below. The channel 720 of the radial portion 718 may be semi-circular to prevent the shelf from pivoting relative to the barrel 700 once the attachment wire ends 852 are within the channel 720. The radial portion 718 further supports the shelf 850 and aids to keep the shelf 850 substantially level if not level.

The outer surface 703 of the barrel body 702 further includes threads 722 thereon between the supports 714 and the wedge portion 712. The wedge portion 712 includes an outer surface 724 that is conical shaped and tapers inwardly as the wedge portion 712 extends from the cylindrical portion 710. The wedge portion 712 includes gaps 726 that extend longitudinally through the wedge portion 712 to define four arcuate fingers 728. The arcuate fingers 728 may move or flex independently of one another and may be forced toward one another to close or partially close the gaps 726 to change the diameter of the wedge portion 712. The gaps 726 thus permit the diameter of the wedge portion 712 to change size more significantly when force is applied to the wedge portion 712. For example, the gaps 726 aid in decreasing the diameter of the wedge portion 712 when a compressive force is applied to the wedge portion 712, as described in further detail below. The barrel body 702 may be made from ABS plastic. By way of example only, the length of the cylindrical portion 710 of the barrel body 702 may be is 1.032 inches.

The cap 704 is substantially cylindrical and includes an outer surface 730 and an inner surface 732. The inner surface 732 defines a central passage 733 therethrough sized to receive the main rod 18 and/or the secondary rod 20 therethrough. The inner surface 732 includes threads 735 disposed at an upper end portion 734 that correspond to the threads 722 of the barrel body 702 for attaching the cap 704 to the barrel body 702. A camming surface 740 extends from the threads 735 to the lower end 736 of the cap 704. The camming surface 740 is conical and tapers inward as the camming surface 740 extends toward the lower end 736. The camming surface 740 engages the wedge portion 712 of the barrel body 702 as the cap 704 is threaded to the barrel body 702 forcing the wedge portion 712 radially inward to apply a compressive force to main rod 18 or secondary rod 20 extending therethrough. The cap 704 may be formed of a plastic material, such as acetal and ABS as examples. By way of example only, the length of the cap 704 may be 1.168 inches.

The outer surface 730 of the cap 704 includes longitudinal ribs 738 about the cap 704. The ribs 738 aid in gripping the cap 704 to manually rotate the cap 704 relative to the barrel body 702.

To attach the barrel 700 to the rods 18, 20, the main rod 18 and/or secondary rod 20 may be inserted through the passages 708, 733 of the barrel body 702 and the cap 704. The barrel 700 is positioned along the rods 18, 20 at the desired location. The cap 704 is threaded on the barrel body 702 to bring the camming surface 740 into engagement with the outer surface 724 of the wedge portion 712 of the barrel body 702. As the cap 704 is threaded toward the barrel body 702, the camming surface 740 forces the wedge portion 712 radially inward against the rod 18, 20. The cap 704 is rotated until the wedge portion 712 applies a force to the rod 18, 20 sufficient to hold the barrel 700 from sliding axially along the rod 18, 20 This prevents the barrel 700 from unintentionally moving or slipping relative to the rods 18, 20.

A user may thus set the barrel 700 at the desired position along the length of the shower caddy 10 by moving the barrel 700 to a desired position along the rods 18, 20 and locking the barrel 700 to the rods 18, 20 by threading the cap 704 on the barrel body 702.

Figure 36A:
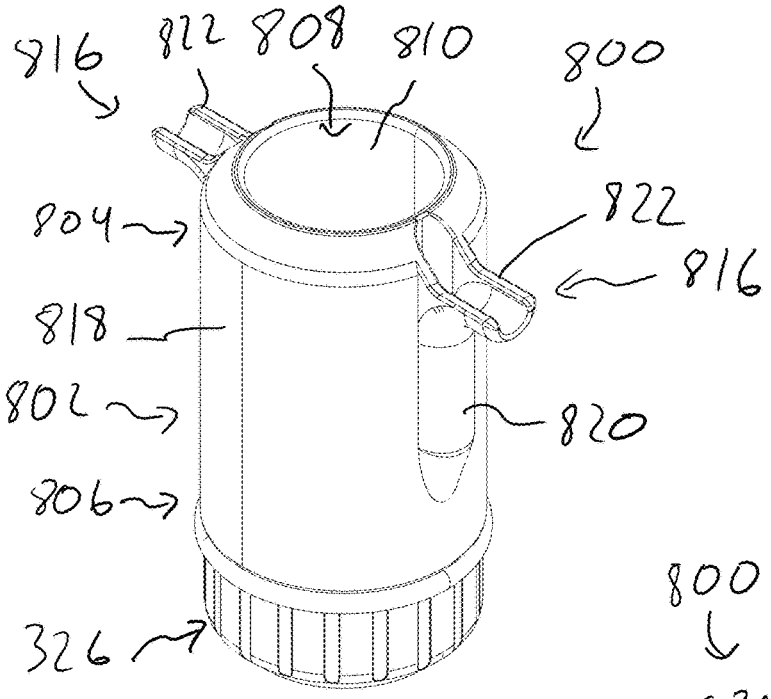
FIG. 36A is a top perspective view of a barrel connector of the customizable shower caddy of FIG. 1 according to a second alternative embodiment.
Figure 36B:
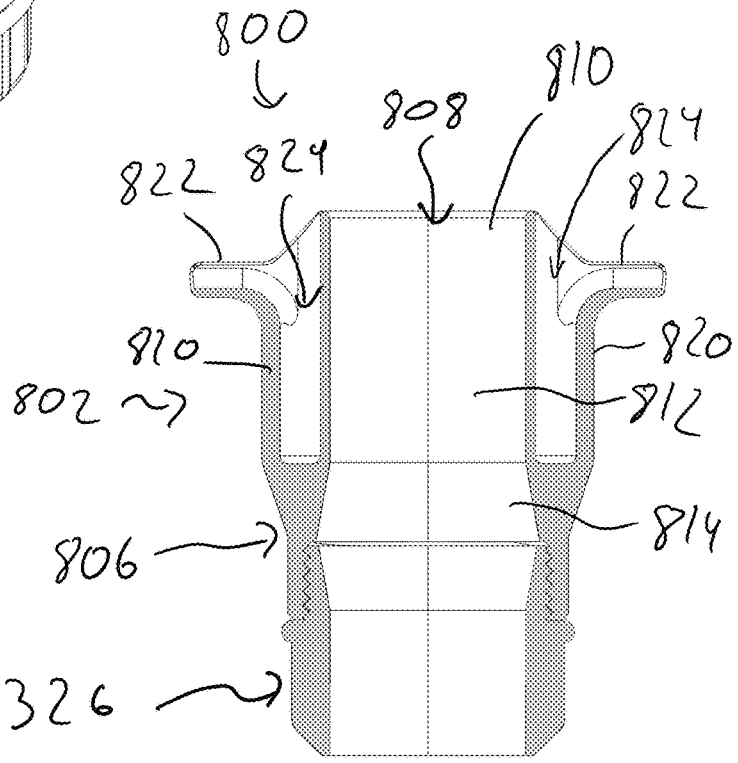
FIG. 36B is a cross-section view of the barrel connector of FIG. 36A.
Figure 36C:
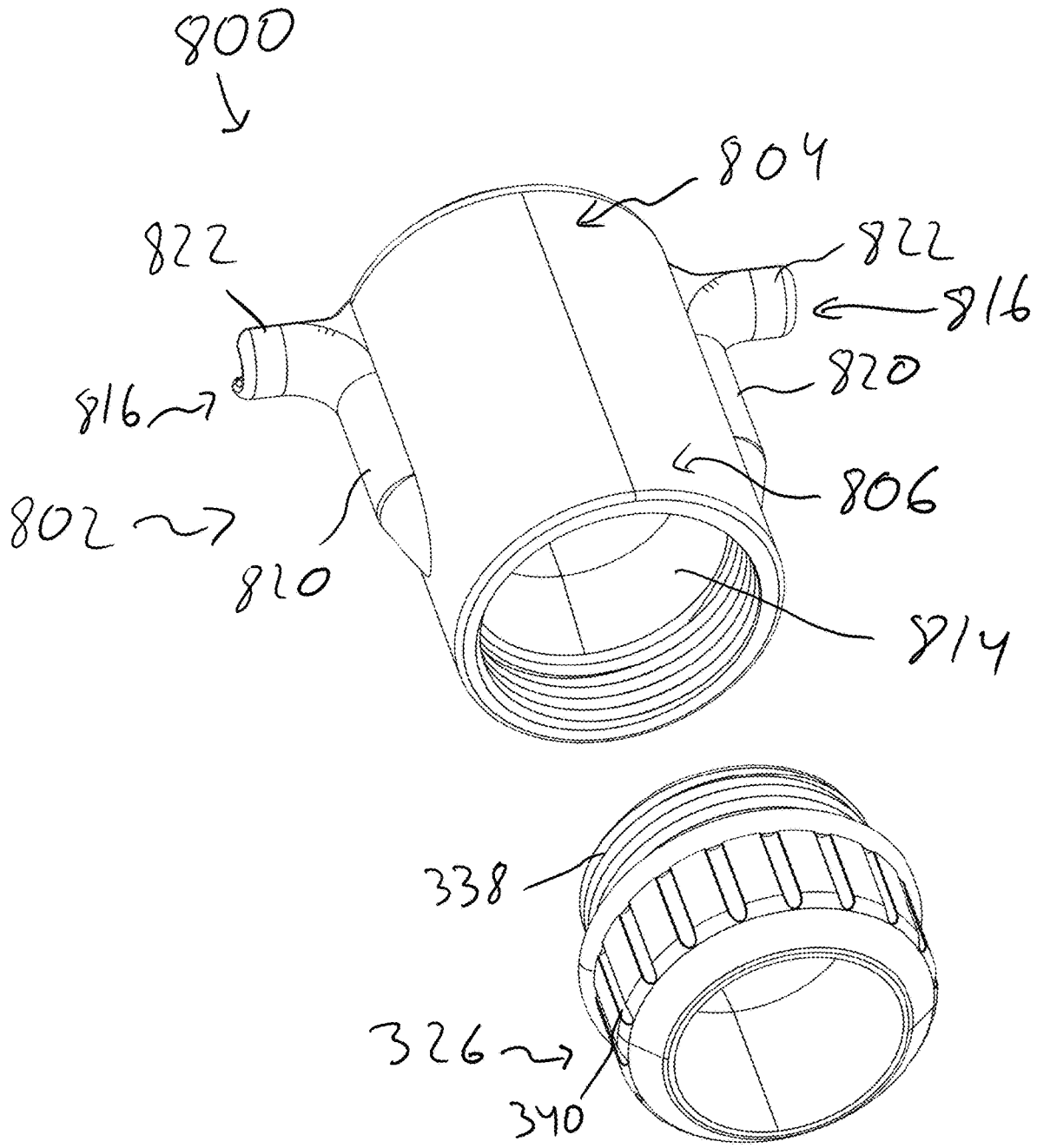
FIG. 36C is an exploded view of the barrel connector of FIG. 36A.

With reference to FIGS. 36A-36C, a barrel 800 for supporting shelves along the rods 18, 20 is provided according to another embodiment. The barrel 800 is similar to the barrel 32 described above with respect to FIGS. 21A-21L in that the position of the barrel 800 along the rods 18, 20 is adjustable and the barrel 800 may be used to support shelves and/or baskets.

The barrel 800 includes a barrel body 802 with a top end portion 804 and a bottom end portion 806. The top end portion 804 of the barrel 800 has an inner surface 810 that defines a central passage 808 therethrough. The inner surface 810 includes a cylindrical section 812 and a conical section 814 within the central passage 808. The conical portion 814 increases in diameter as the inner surface extends from the cylindrical portion 812 toward the bottom end portion 806.

The top end portion 804 is similar to that of the barrel 700 of FIGS. 35A-35C, including a pair of supports 816 extending along an outer surface 818 of the top end portion 804. The supports 816 include a longitudinal portion 820 extending longitudinally along the top end portion 804 that curve outward to a radial portion 822 extending radially outward of the top end portion 804. The support members 816 define a channel 824 for receiving L-shaped attachment wire ends 852 of a shelf 850 to secure the shelf 850 to the barrel 800, as described in further detail below with respect to FIGS. 38A-39. The radial portion 822 of the support members 816 may form a semi-circular channel for the attachment wire ends 852 of the shelf 850 to rest within when a shelf 850 is attached to the barrel 800. The semi-circular channel may aid to prevent the attachment wires 852 or shelf 850 from pivoting relative to the barrel 800 once the attachment wire ends 850 are within the channel 824. The radial portion 822 further supports the shelf 850 and aids to keep the shelf 850 substantially level if not level.

By way of example only, the length of the barrel body 802 may be 2.151 inches. The span of the radial portions 822 of the support members 816 may be 2.5 inches.

Figure 21D:
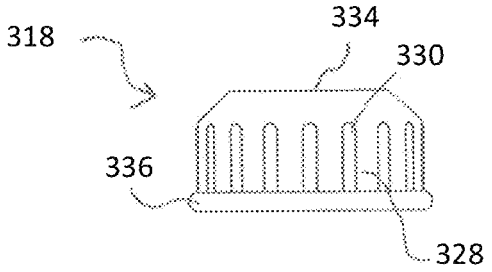
FIG. 21D is a side elevation view of a top cap of the barrel body of FIG. 21A.
Figure 21E:
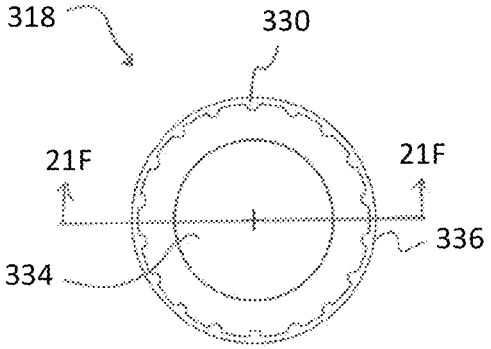
FIG. 21E is a top plan view of the top cap of FIG. 21D.
Figure 21F:
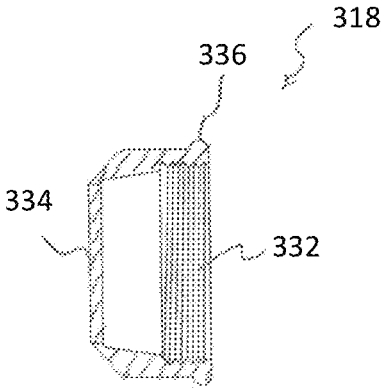
FIG. 21F is a cross-section view of the top cap of FIG. 21D taken along line 21F-21F of FIG. 21E.
Figure 21I:
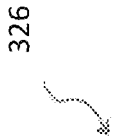
FIG. 21I is a cross-section view of the bottom cap of FIG. 21G taken along line 21I-21I of FIG. 21H.
Figure 21I:
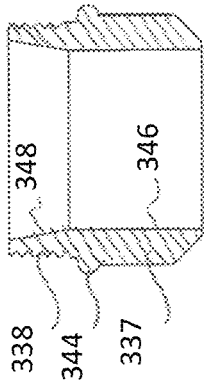
Figure 21G:
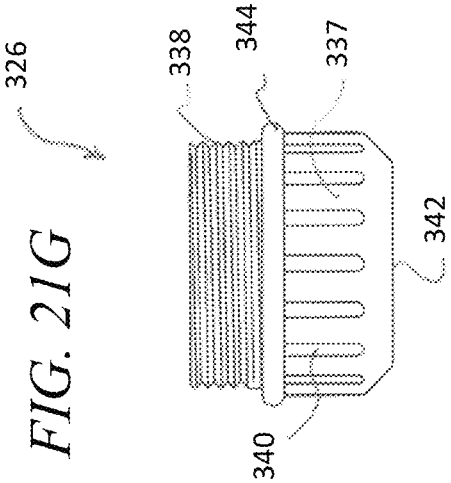
FIG. 21G is a side elevation view of a bottom cap of the barrel body of FIG. 21A.
Figure 21H:
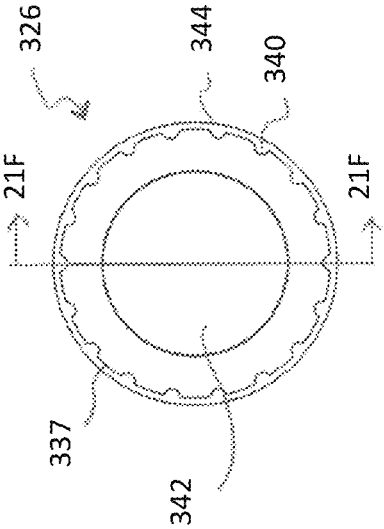
FIG. 21H is a top plan view of the bottom cap of FIG. 21G.
Figure 21J:
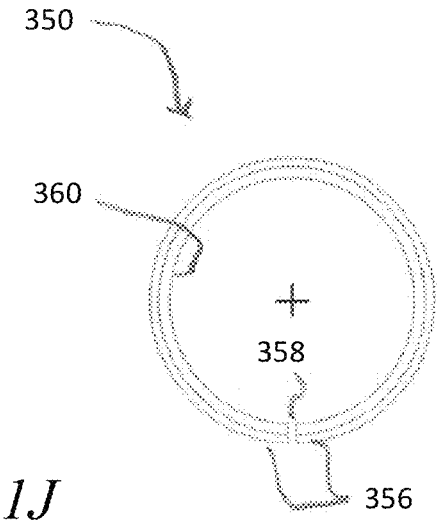
FIG. 21J is a top plan view of a large wedge insert of the customizable shower caddy of FIG. 1.
Figure 21K:
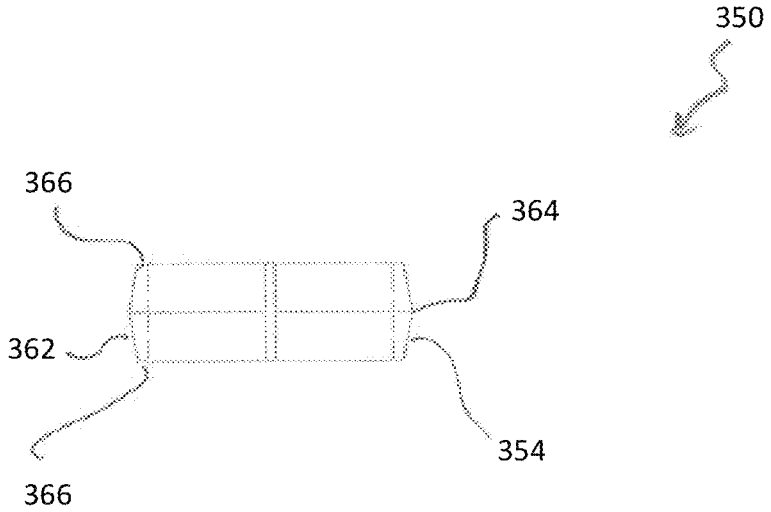
FIG. 21K is a side elevation view of the large wedge insert of FIG. 21J.
Figure 21L:
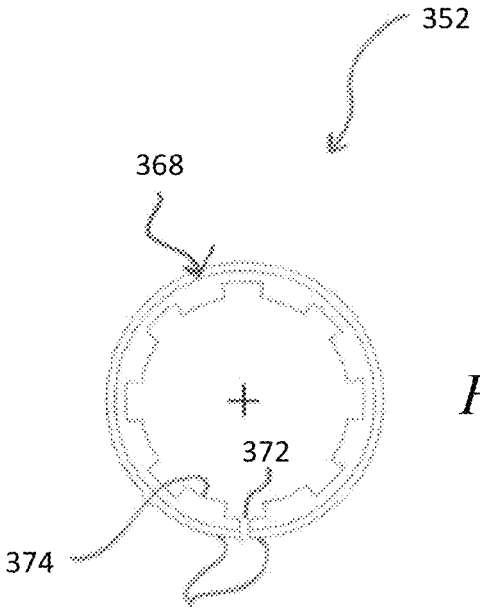
FIG. 21L is a top plan view of a small wedge insert of the customizable shower caddy of FIG. 1.
Figure 21M:
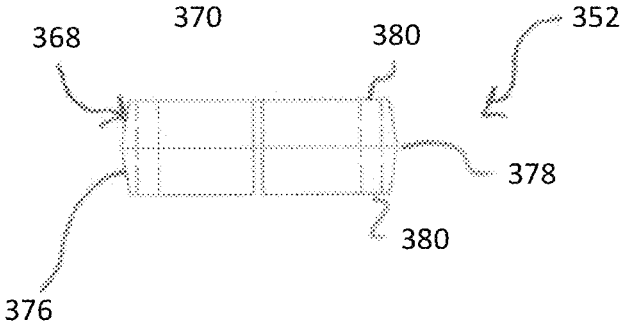
FIG. 21M is a side elevation view of the small wedge insert of FIG. 21L.

The bottom end portion 806 is similar in many respects to the bottom end portion 296 of the barrel 292 of FIGS. 21G-21I and includes the conical section 814 and internal threading 828. The barrel body 802 may be made from ABS plastic.

The bottom cap 326 described above may be threaded to the bottom end portion 806 of the barrel 800 used with a wedge insert 350, 352 therebetween to apply a pressure to the main rod 18 or secondary rod 20 or optional rod 22 as described above.

To attach the barrel 800 to the rods 18, 20, the main rod 18 and/or secondary rod 20 may be inserted through the barrel body 702, the cap 326, and the wedge insert 350, 352. The barrel 800 is positioned along the rods 18, 20 at the desired location. The cap 326 is threaded on the barrel body 802 to force the conical section 814 of the barrel body 802 and the conical segment 348 of the cap 326 against the wedge insert 350, 352 forcing the wedge insert 350, 352 radially inward. The wedge insert 350, 352 thus applies pressure against the rod 18, 20. This prevents the barrel 800 from unintentionally moving or slipping relative to the rods 18, 20.

Figure 37A:
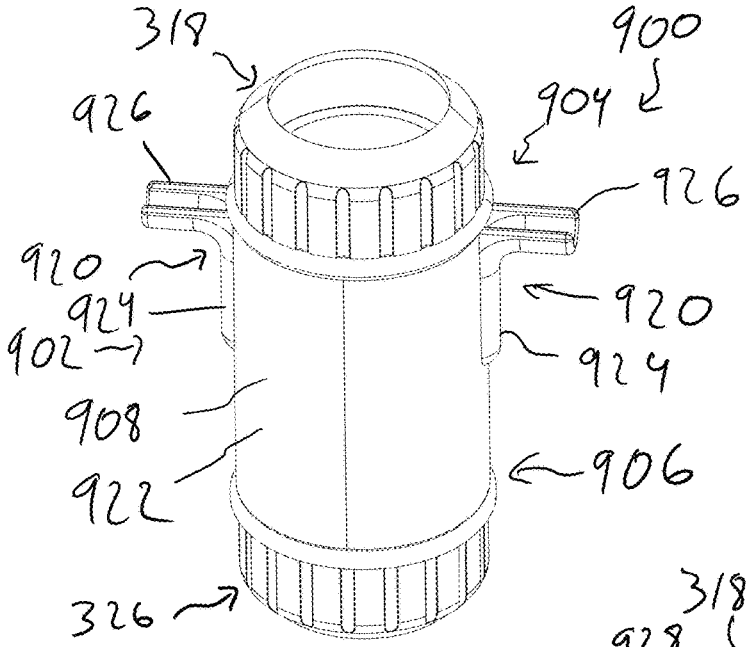
FIG. 37A is a top perspective view of a barrel connector of the customizable shower caddy of FIG. 1 according to a third alternative embodiment.
Figure 37B:
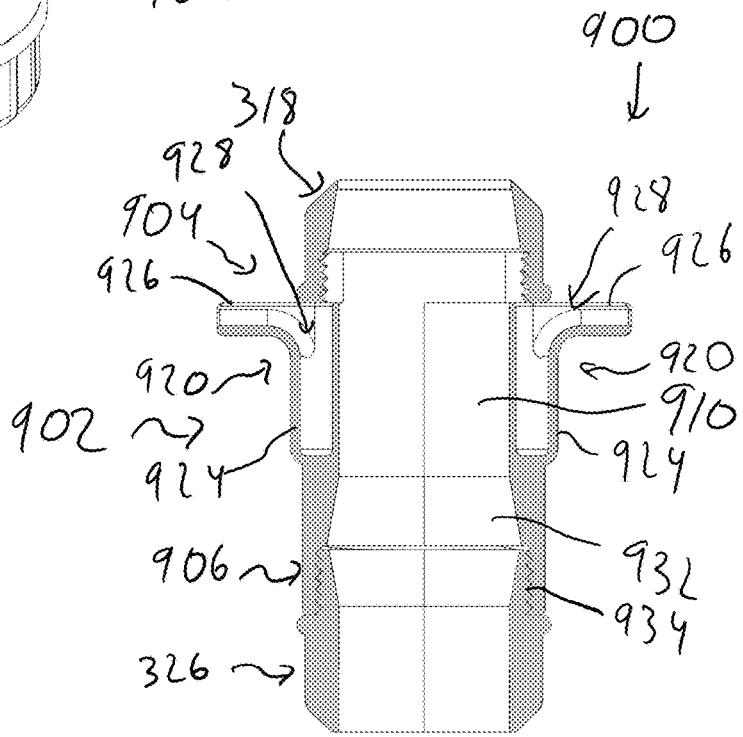
FIG. 37B is a cross-section view of the barrel connector of FIG. 37A.
Figure 37C:
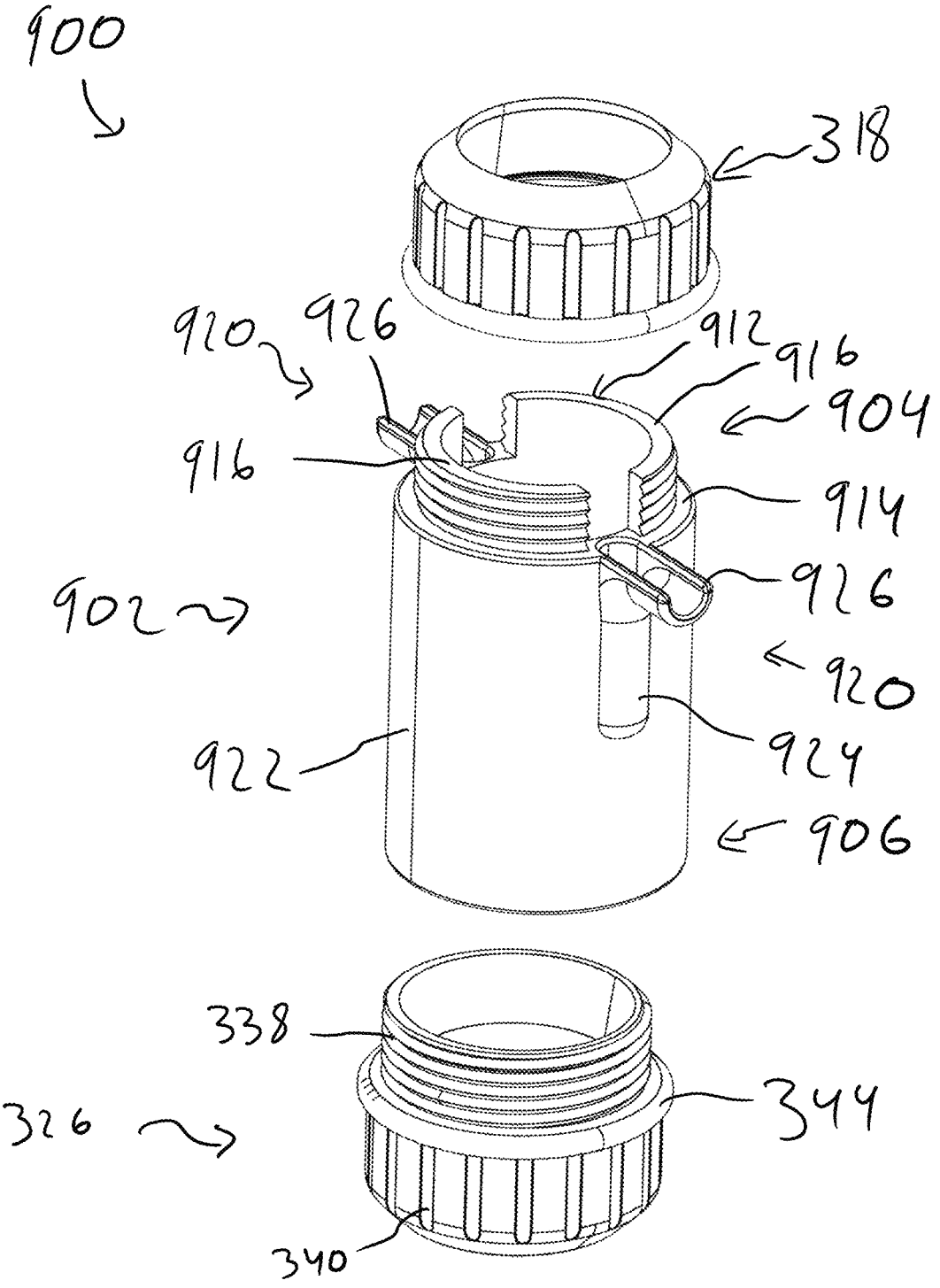
FIG. 37C is an exploded view of the barrel connector of FIG. 37A.

With reference to FIGS. 37A-37C, a barrel 900 for supporting shelves or baskets along the rods 18, 20 is provided according to yet another alternative embodiment. The barrel 900 is similar to the barrel 32 described above with respect to FIGS. 21A-21L in many respects. The barrel 900 includes a barrel body 902 with a top end portion 904 and a bottom end portion 906. The outside of the barrel body 902 may have a cylindrical profile 908 or any other profile, such as a rectangular or hour-glass. The inside of the barrel body has a generally cylindrical profile 910.

The top end portion 904 includes an interrupted threaded portion 912 and an annular landing 914 at the base of the interrupted threaded portion 912 (see FIG. 37C). The interrupted threaded portion 912 may include two arcuate projections 916 with external threads that form a threading for a top cap 318 described above.

The top end portion 904 further includes a pair of supports 920 extending along an outer surface 922 of the top end portion 904. The supports 920 are used in mounting the baskets and/or shelves. The supports 920 include a longitudinal portion 924 extending longitudinally along the outer surface 922 of the top end portion 904 that curves to a radial portion 926 extending radially outward of the top end portion 804. The support members 920 are aligned with the gaps between the two arcuate projections 916.

The supports 920 may define a channel 928 for receiving L-shaped attachment wire ends 952 of a shelf 950 to secure the shelf 950 to the barrel 900 as described below with respect to FIGS. 38A-38C. The radial portion 926 may include a semi-circular profile for the attachment wire ends 952 of the shelf 950 to rest upon when a shelf 950 is attached to the barrel 800. The semi-circular profile of the channel 928 may aid to prevent the shelf 950 from pivoting relative to the barrel 900 once the attachment wire ends 952 are within the channel 928. The radial portion 926 provides support to the shelf 950 and aids to keep the shelf 950 substantially level if not level.

The top cap 318 of FIGS. 21D-21F defines internal threading 332 that cooperates with the threading on the arcuate threaded projections 916 to mount the top cap 318 to the barrel body 902. The top cap 318 may be threaded to the barrel body 902 to secure the attachment wires ends 952 of the shelves 950 inserted into the channels 928 of the supports 920 to prevent the shelves 950 from unintentionally being removed from the barrel 900.

The bottom end portion 906 is similar in many respects to the bottom end portion 296 of the barrel 292 of FIGS. 21G-21I and includes the conical section 932 and internal threading 934. The barrel body 902 may be made from ABS plastic. By way of example only, the length of the barrel body 902 is 2.19 inches. The span of the radial portions 926 of the supports 920 may be 2.5 inches.

The bottom cap 326 described above may be threaded to the bottom end portion 906 of the barrel 900 and used with a wedge insert 350, 352 therebetween to apply pressure to the main rod 18 or secondary rod 20 or optional rod 22 as described above.

To attach the barrel 900 to the rods 18, 20, the main rod 18 and/or secondary rod 20 may be inserted through the barrel body 902, the cap 326, and the wedge insert 350, 352. The barrel 900 is positioned along the rods 18, 20 at the desired location. The cap 326 is threaded on the barrel body 902 to force the conical section 932 of the barrel body 802 and the conical segment 348 of the cap 326 against the wedge insert 350, 352 forcing the wedge insert 350, 352 radially inward. The wedge insert 350, 352 thus applies a pressure against the rod 18, 20. This prevents the barrel 900 from unintentionally moving or slipping relative to the rods 18, 20.

Figure 38A:
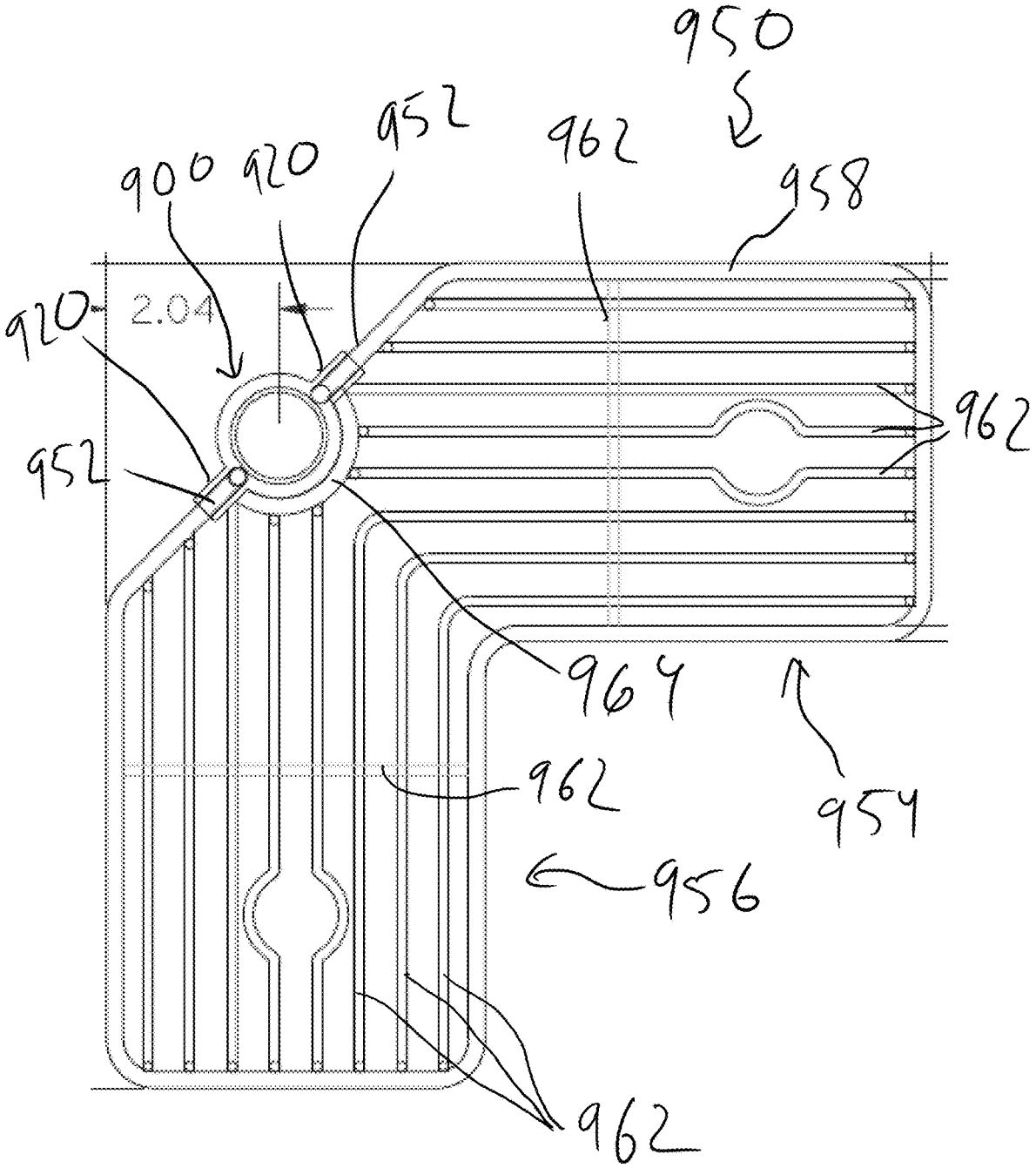
FIG. 38A is a top plan view of a shelf attached to a barrel body of the barrel connector of FIG. 37A.
Figure 38B:
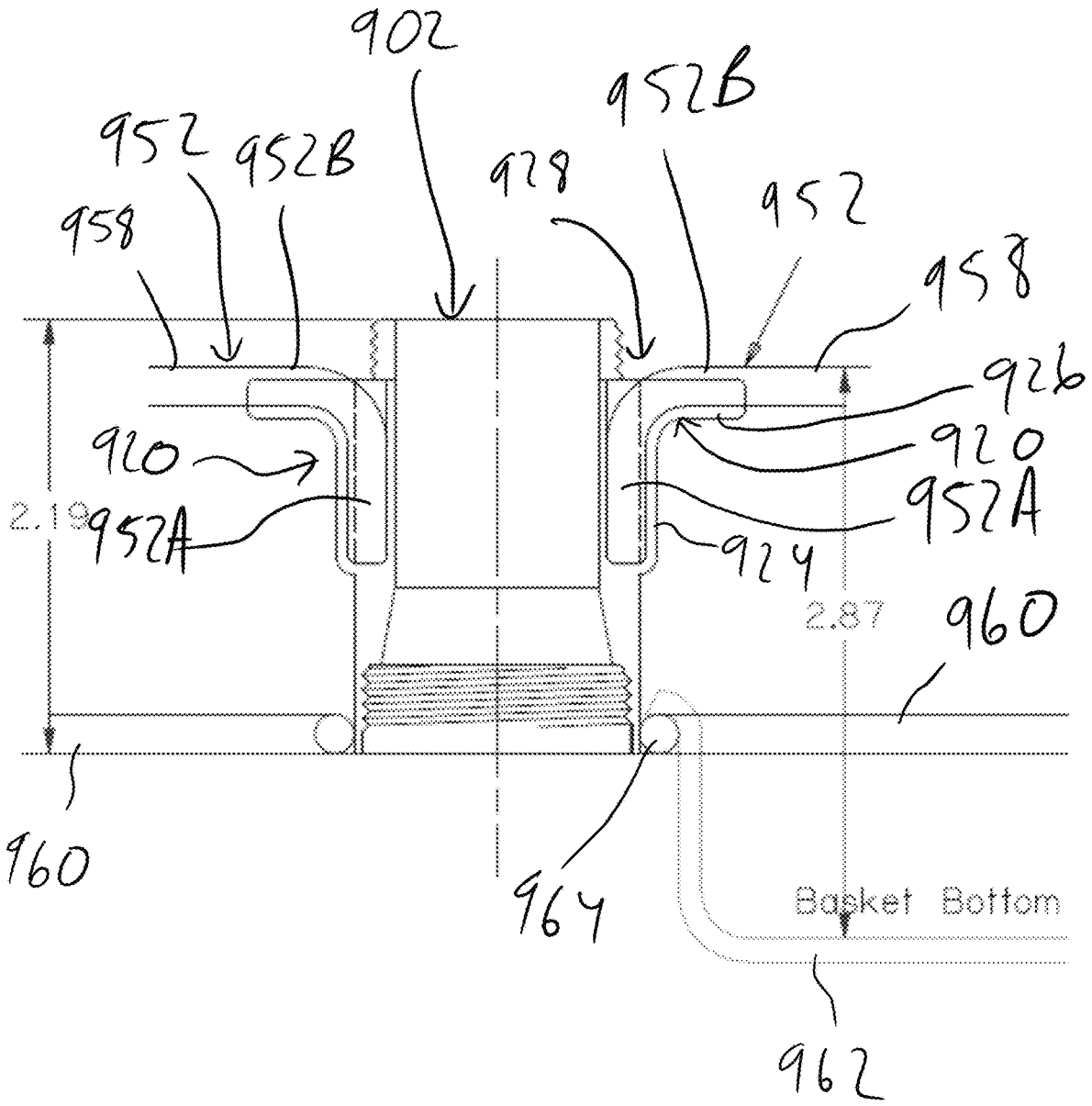
FIG. 38B is a side partial cross-section view of the shelf of FIG. 38A attached to the barrel body of the barrel connector of FIG. 37A.
Figure 38C:
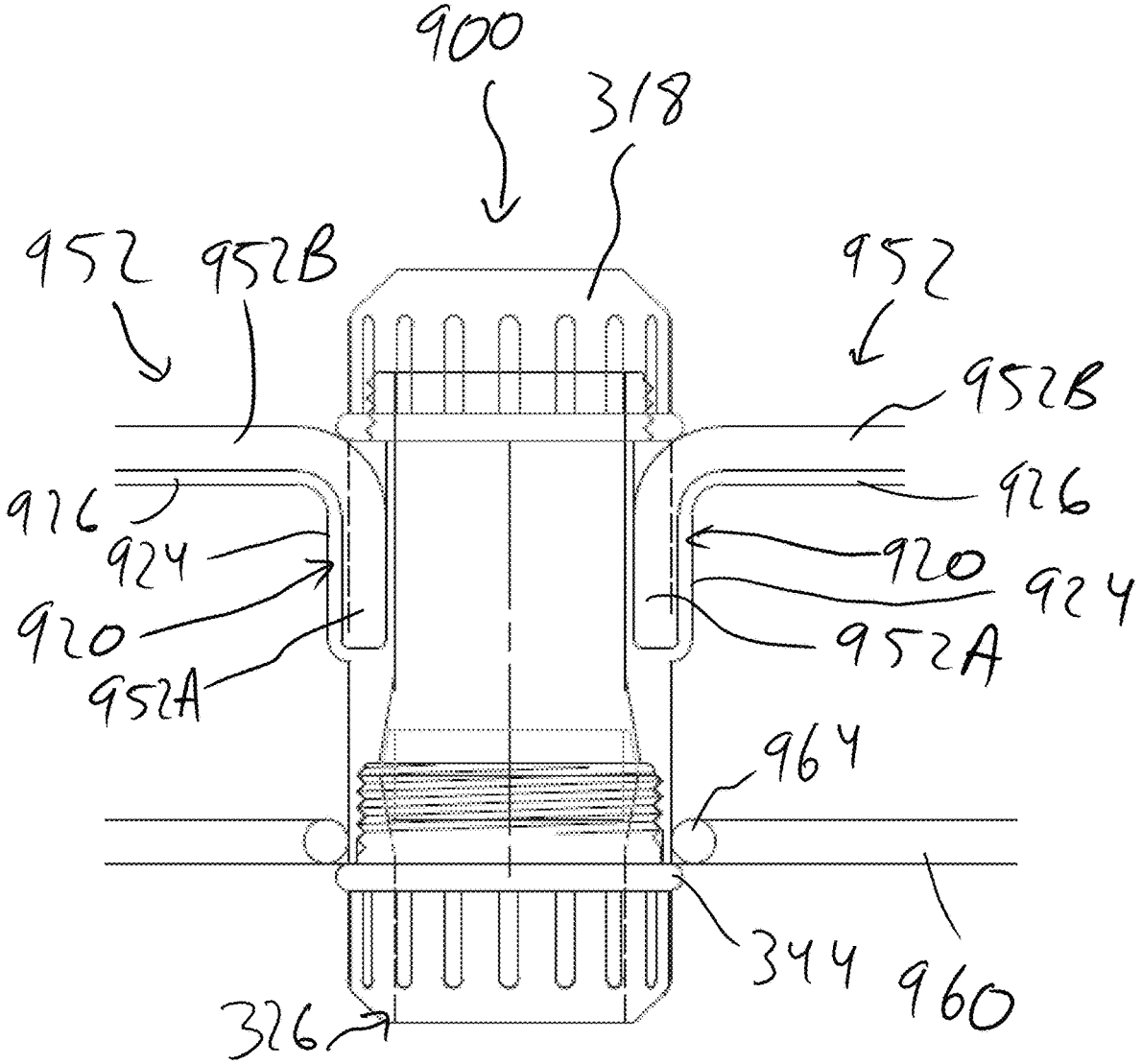
FIG. 38C is a side partial cross-section view of the shelf of FIG. 38A attached to the barrel connector of FIG. 37A.

With respect to FIGS. 38A-C, the shelf 950 is a wire basket shelf formed of a plurality of wires secured together. While the shelf 950 is shown and described as being attached to the barrel 900 of FIGS. 37A-37C, the shelf 950 may be similarly attached to the other barrel embodiments described herein, such as the barrel 700 of FIGS. 35A-35C and barrel 800 of FIGS. 36A-36C. The shelf 950 includes a first portion 954 and a second portion 956 that extend perpendicular to one another. This configuration enables the rods 18, 20 to be positioned in a corner of a shower with the shelf 950 extending along the walls from the corner. The shelf 950 includes an upper wire 958 and a lower wire 960 tracing the perimeter of the shelf 950. The ends of the upper wire 958 form the L-shaped attachment ends 952 that are inserted into the supports 920 to secure the shelf 950 to the barrel 900. As shown in FIG. 38B, the attachment wire ends 952 include a longitudinal portion 952A and a radial portion 952B. The longitudinal portion 952A of the attachment wire ends 952 are inserted into the portion of the channels 928 of the supports 920 formed by the longitudinal portion 924 of the supports 920 until the radial portions 952B of the attachment wire ends 952 are seated in the radial portion 926 of the support member 920.

The shelf 950 further includes a plurality of basket wires 962 forming the basket bottom of the shelf 950. The wires 962 are spaced apart from one another to permit fluid (e.g., water, soap, etc.) to flow through the shelf 950 to the drain of the shower while supporting personal hygiene products (e.g., soap, shampoo, conditioner, body wash, etc.) thereon. Each end of the basket wires 962 are secured to the lower wire 960 such that the basket wires 962 form a mesh configuration within the perimeter of the lower wire 960 for supporting the personal hygiene products. The ends of the basket wires 962 may be secured to the lower wire 960 by a weld. The basket wires 962 may be bent to extend below the lower wire 960 to provide increased depth to the shelf 950.

The lower wire 962 includes a curved support portion 964 having a shape that corresponds to the outer profile of the barrel body 902. When the shelf 950 is attached to the barrel 900, the support portion 964 contacts the barrel body 902 to aid in supporting the shelf 950 and to prevent the shelf 950 from bending, pivoting, or tipping downward about the attachment wire ends 952. With reference to FIG. 38C, the support portion 964 may contact the barrel body 902 at its lower end and rest on the annular bead 344 of the bottom cap 326. This may provide increase support and prevent the lower wire 960 from sliding along the barrel body 902. The top cap 318 may be threaded to the barrel body 902 upon attaching the shelf 950 to the barrel body 902 to further secure the shelf 950 to the barrel 900 and prevent the shelf 950 from becoming unintentionally removed from the barrel 900.

Figure 39A:
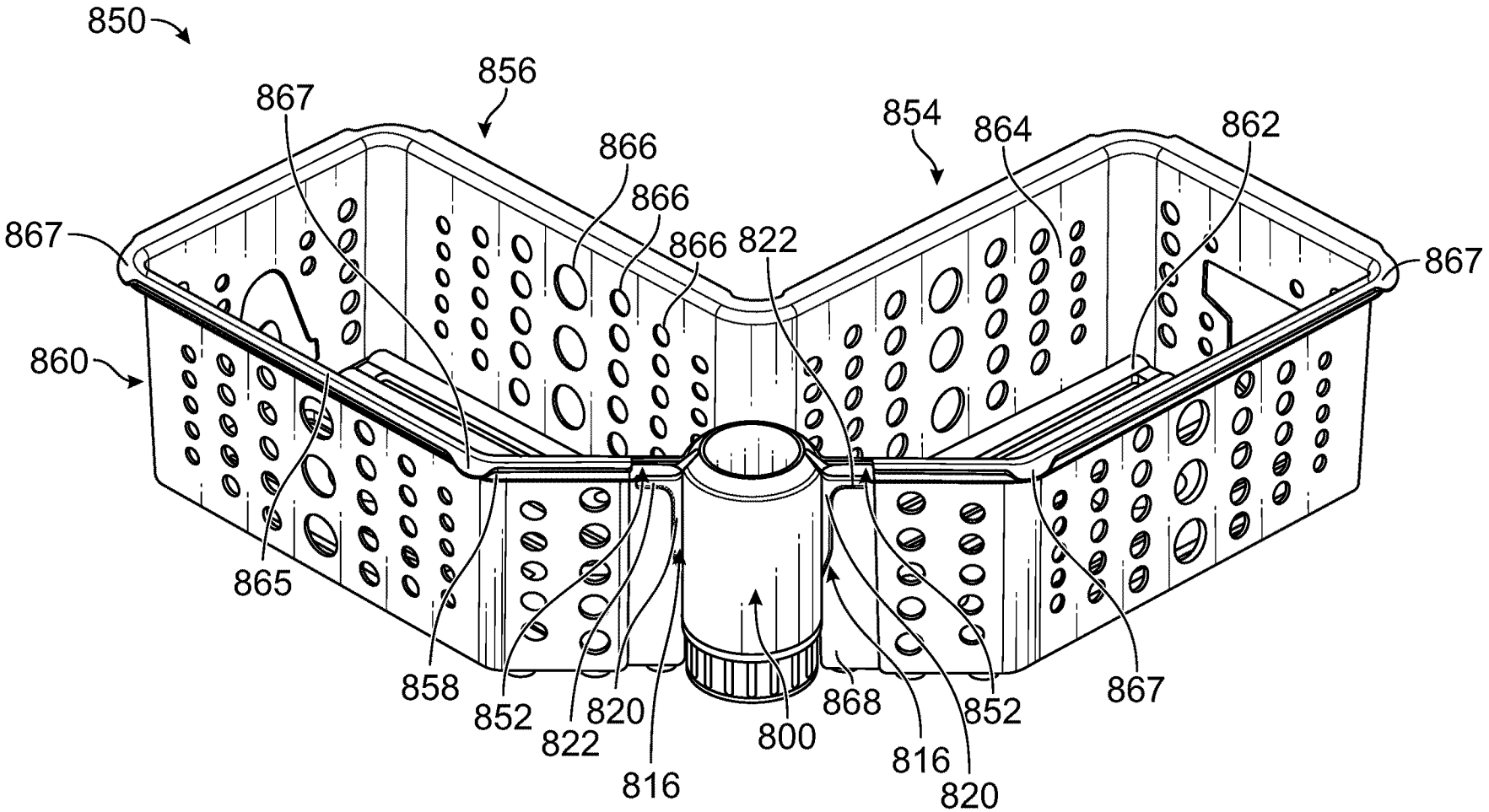
Figure 39B:
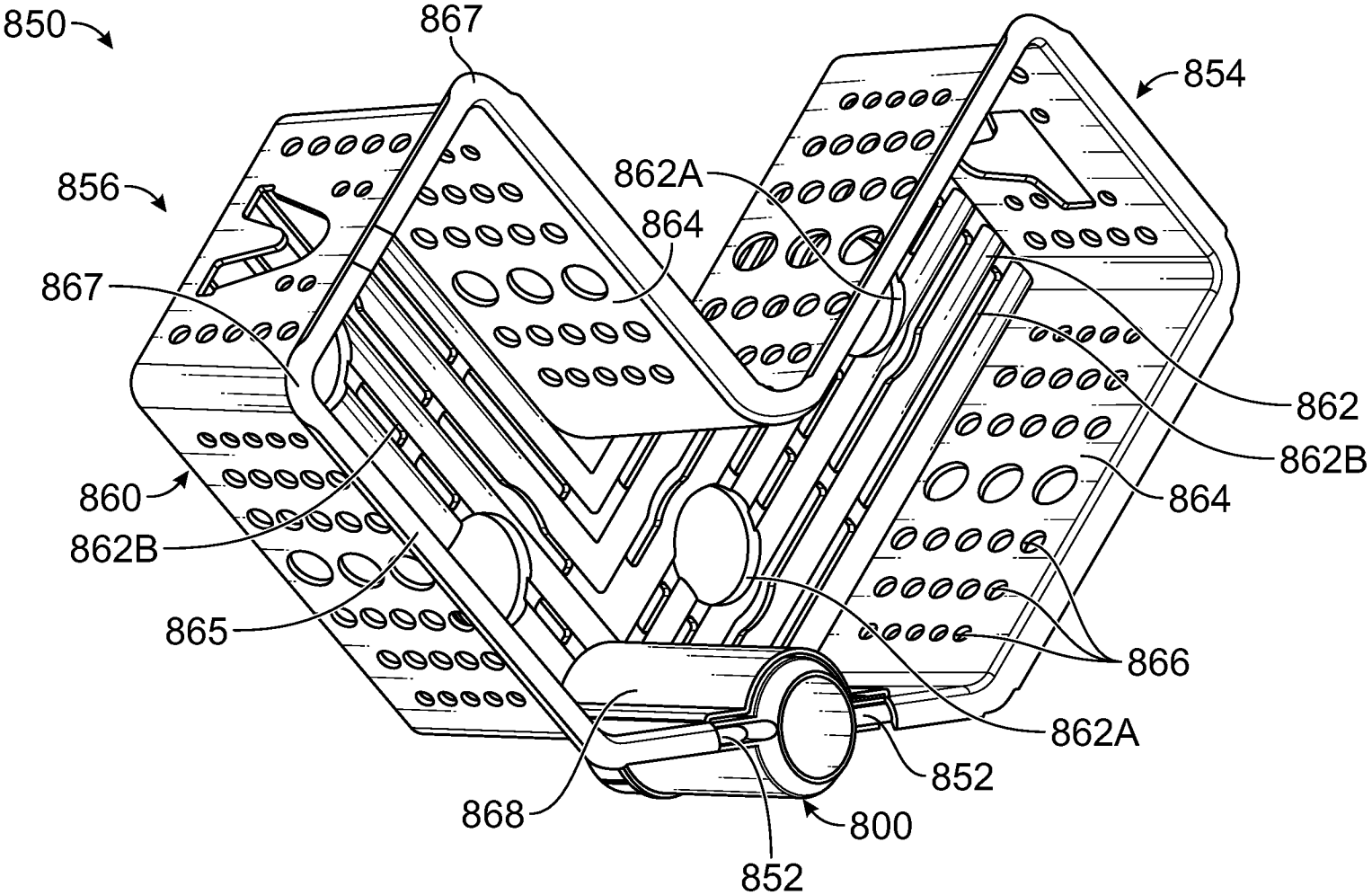
FIG. 39B is a side perspective view of the shelf of FIG. 39A attached to the barrel connector of FIG. 36A.

With respect to FIGS. 39A-39B, a shelf 850 is shown according to another embodiment attached to the barrel 800 of FIGS. 36A-36C. While the shelf 850 is shown attached to the barrel 800, the shelf 850 may be similarly attached to the other barrel embodiments described herein. The shelf 850 is similar in shape to the shelf 950 described above having a first portion 854 and a second portion 856 extending perpendicular to one another and enabling the shelf 850 to be positioned within a corner of the shower.

The shelf 850 includes an upper wire 858 that extends about the perimeter of the shelf 850. The ends of the upper wire 858 form the L-shaped attachment wire ends 852 for hooking or attaching the shelf 850 on the supports 816 of the barrel 800. The attachment wire ends 852 may be similar to those of the shelf 950 described above including a longitudinal portion for insertion into the longitudinal portion 820 of the supports 816 of the barrel 800 and a radial portion that rests on the radial portion 822 of the supports 816.

The shelf 850 includes a basket 860 for supporting personal hygiene products. The basket 860 may be formed of a plastic material such as ABS. In some configurations, the basket 860 may be formed from or coated with a hydrophobic material to aid in draining fluid from the basket 860. The basket 860 includes a base 862 with sidewalls 864 extending from the base 862. The basket 860 further includes an upper flange 865 at the upper end of the sidewalls 864 extending about the perimeter of the basket 860. The perimeter of the sidewalls 864 of the basket 860 may be sized to be inserted through the opening formed by the upper wire 858 with the upper flange 865 sized to rest on the upper wire 858. The upper flange 865 may include hook portions 867 that wrap partially around a portion of the upper wire 858 to prevent the basket 860 from moving substantially relative to the upper wire 858. In some forms, the hook portions 867 are clips for snapping or clipping the basket 860 to the upper wire 858 to secure the basket 860 to the upper wire 858.

The base 862 may include a plurality of holes 862A and slots 862B (similar to the tray 390 described above) enabling fluid to drain from the shelf 850. The sidewalls 864 include a plurality of holes 866 to enable fluid to drain from the shelf 850 and to permit the shelf 850 to dry more quickly. The sidewalls 864 may further include a support wall 868 having a shape that corresponds to the outer profile of the barrel body 802. The support wall 868 contacts the outer surface of the barrel 800 when the shelf 850 is attached to the barrel 800 to provide increased support. The support wall 868 aids to prevent the shelf 850 from tilting, pivoting, or rotating downward from the rods 18, 20, for example, due to the weight of the personal hygiene products supported by the shelf 850. The support wall 868 provides increased support to keep the shelf 850 substantially level.

While the embodiments of the shelves 850, 950 shown are for positioning within a corner of the shower, in other forms, the shelves 850, 950 may be positioned along a wall or in the center of the shower (away from a wall). The shelves 850, 950 may have configurations similar to those shown in FIGS. 29A-29D. For example, the first portion 954 and second portion 956 of shelf 950 may extend opposite one another or 180 degrees from one another.

Figure 40A:
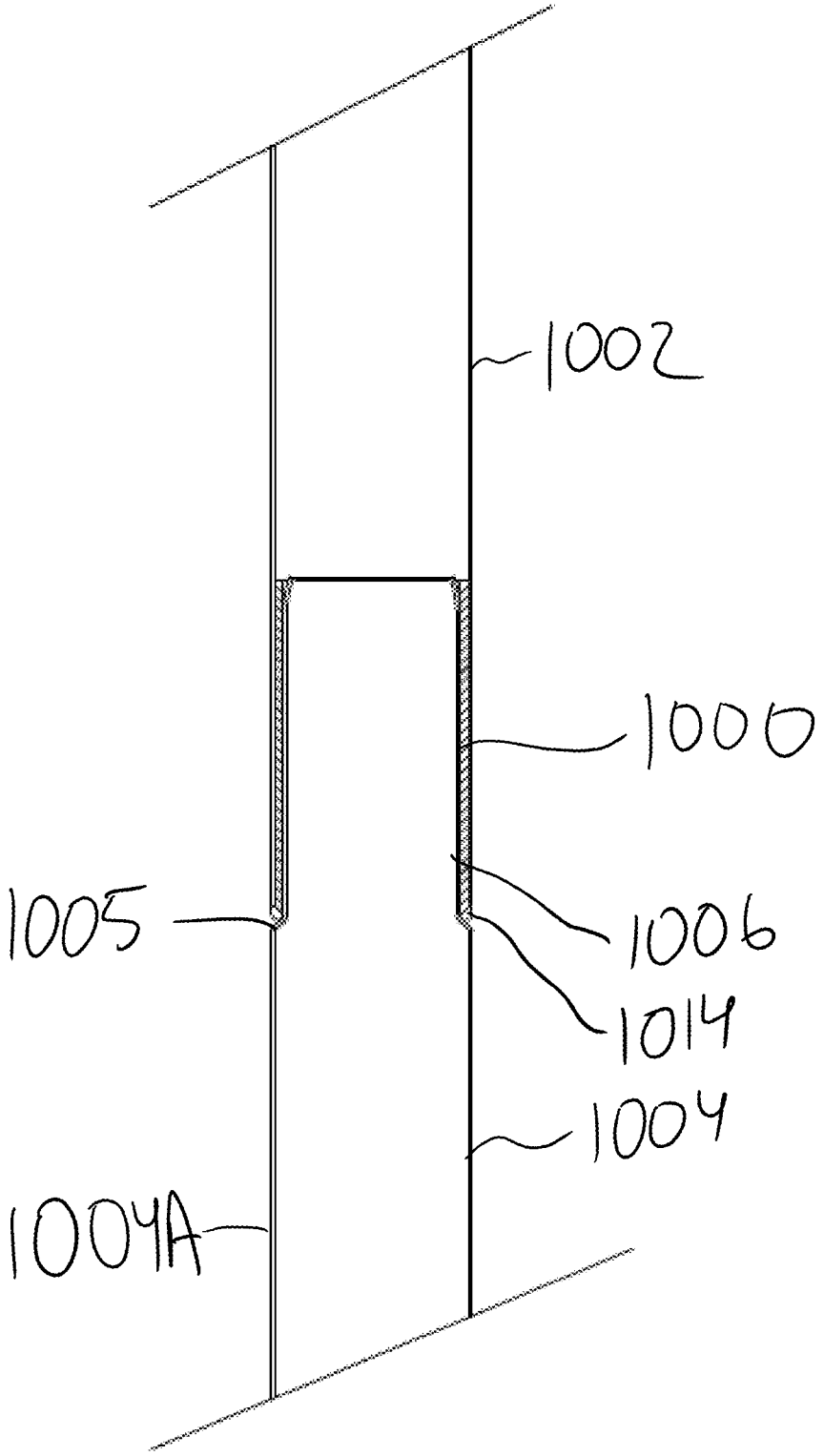
FIG. 40A is a cross-section view of a sleeve connecting rods.
Figure 40B:
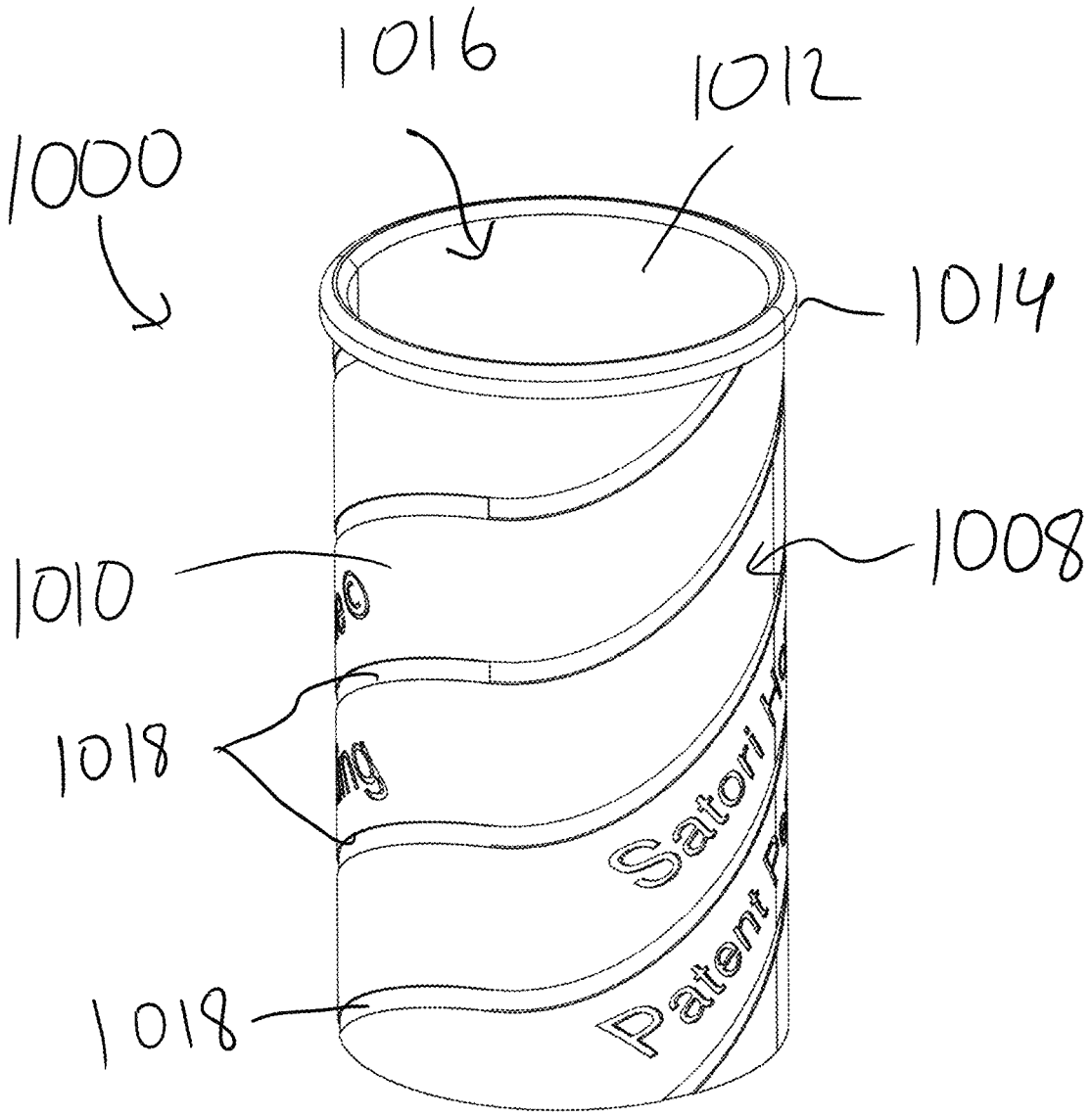
FIG. 40B is a perspective view of the sleeve of FIG. 40A.

With respect to FIGS. 40A-40B, a sleeve 1000 is provided for connecting a main rod 1002 and a secondary rod 1004. The main rod 1002 and secondary rod 1004 may be the rods of a shower caddy system, for example. The rods 1002, 1004 may be rod segments forming the main rod 18, secondary rod 20, or optional rod 22 described above. For example, the rods 1002, 1004 may be joined together to form the main rod 18, secondary rod 20, and/or optional rod 22. The secondary rod 1004 includes a central portion 1004A and an end portion 1006 having a reduced or smaller diameter compared to the central portion 1004A. The central portion 1004A of the secondary rod 1004 may include a diameter that is similar or the same as the diameter of the main rod 1002. The secondary rod 1004 includes a step 1005 between the end portion 1006 and the central portion 1004A of the secondary rod 1004. The end of the secondary rod 1004 may be swedged to form the narrowed end portion 1006.

With respect to FIG. 40B, the sleeve 1000 has a substantially cylindrical body 1008 having an outer surface 1010 and an inner surface 1012. The sleeve 1000 may be flexible and/or formed of or coated with a high-friction material such as, for example, a rubber or polyethylene. The outer surface 1010 of the sleeve 1000 is sized such that the body 1008 of the sleeve 1000 is able to be inserted into an end of the main rod 1002. The outer surface 1010 may have a diameter that is similar to or even larger than the inner diameter of the main rod 1002 such that substantial force is required to insert the sleeve 1000 into the main rod 1002. The sleeve 1000 may be held in place within the main rod 1002 by a friction fit between the inner surface of the main rod 1002 and the outer surface 1010 of the sleeve 1000. The sleeve 1000 includes a flange 1014 at one end of the cylindrical body 1008. The flange 1014 may have a diameter greater than the internal diameter of the main rod 1002 such that the flange 1014 serves as a stop to prevent the entire sleeve 1000 from being inserted into the main rod 1002.

The inner surface 1012 of the body 1008 defines a central passage 1016 for receiving the narrow end portion 1006 of a secondary rod 1004. The end portion 1006 of the secondary rod 1004 may be inserted into the end of the sleeve 1000 having the flange 1014 until the step 1005 of the secondary rod 1004 contacts or abuts the flange 1014. The end portion 1006 may be sized to engage the inner surface 1012 of the sleeve 1000 when inserted therein to form a friction fit connection between the sleeve 1000 and the secondary rod 1004. Insertion of the end portion 1006 of the secondary rod 1004 into the sleeve 1000 may force the sleeve 1000 radially outward and increase the frictional engagement of the sleeve 1000 with the main rod 1002. The sleeve 1000 can thus be positioned between the main rod 1002 and the secondary rod 1004 to connect the main rod 1002 to the secondary rod 1002 by a friction fit.

The sleeve 1000 may include a pattern 1018 embossed on the outer surface 1010 of the cylindrical body 1008. For example, the pattern 1018 may be a recessed pattern formed on the outer surface 1010 of the body 1008 by molding, stamping, or etching or another conventional technique. In the configuration shown, the pattern 1018 is a helical or corkscrew pattern extending along the outer surface 1008 of the cylindrical body 1008. While a helical pattern is shown, in other forms, other patterns may be formed on the outer surface 1010 of the sleeve 1000 including dimples, longitudinal channels, stippling patterns, other recessed formations. The pattern 1018 of the outer surface 1010 aids to ease installation of the sleeve 1000 into the main rod 1002 while providing a tighter fit between the sleeve 1000 and the main rod 1002 once the sleeve 1000 has been inserted into the main rod 1002. For instance, the pattern 1018 permits the body 1008 of the sleeve 1000 to be deformed or compressed into the recesses of the pattern 1018 as the sleeve 1000 is forced radially outward against the main rod 1002, e.g., upon insertion of the secondary rod 1004 into the sleeve 1000. Compression of the outer body 1008 of the sleeve 1000 increases the coefficient of friction between the main rod 1002 and the sleeve 1000 and may increase the surface area of the main rod 1002 contacted by the sleeve 1000. The increased surface area between the sleeve 1000 and the main rod 1002 may also increase the frictional engagement therebetween.

The main rod 1002 and the secondary rod 1004 may be connected to one another using the sleeve 1000 and used as a rod system for a shower caddy or curtain rod as examples. For instance, the main and secondary rods 1002, 1004 may be used to form the vertical rod of a shower caddy, such as shower caddy embodiments described above. The main and/or secondary rods 1002, 1004 may be used to support shelves and baskets within a shower. For example, a barrel connector of the embodiments described above may be attached to the main rod 1002 or secondary rod 1004. A shelf or basket may be attached to the barrel connector. The shower caddy including the main and secondary rods 1002, 1004 may be positioned within a shower and extend between the basin 28 of the shower and the ceiling 30 to support the shelves and/or baskets within the shower.

The matter set forth in the foregoing description and accompanying drawings is offered by way of illustration only and not as a limitation. While particular embodiments have been shown and described, it will be apparent to those skilled in the art that modifications may be made without departing from the broader aspects of the technological contribution. The actual scope of the protection sought is intended to be defined in the following claims.

What is claimed is:

1. A rod system comprising:

a first rod and a second rod adjustably interfaced with the first rod;

an adjustable end cap connected to one end of the first rod such that rotation of the adjustable end cap relative to at least one of the first rod and the second rod moves the rod system axially relative to the adjustable end cap;

a rotatable end cap connected to one end of the second rod such that the first and the second rods are free to rotate relative to the rotatable end cap without the rotatable end cap moving axially relative to the first rod and the second rod;

a first connector having a rotational lock to secure the first connector along at least one of the first rod and the second rod; and a product holder sized to be suspended from the first connector;

wherein the rotatable end cap includes one or more retention projections to connect the rotatable end cap to the second rod; the retention projections positioned to hook onto an interior surface of a terminal end of the second rod.

2. The rod system of claim 1 wherein the retention projections deflect radially inwardly to hook onto the interior surface of the second rod when the second rod is inserted into the rotatable end cap.

3. The rod system of claim 1 wherein the retention projections include a hook and deflectable arms.

4. The rod system of claim 1 wherein the second rod includes an inner lip on the interior surface and the projections being sized to hook the inner lip to limit axial movement of the rotatable end cap relative to the second rod but enable rotational movement relative to the second rod.

5. A rod system comprising: a first rod;

a second rod; and a sleeve being disposed in an end of the first rod, the sleeve having a pattern recessed into the sleeve from an outer surface of the sleeve and defining a socket sized to receive an end portion of the second rod such that that the sleeve frictionally engages the first rod and the second rod to at least limit the first rod from moving relative to the second rod;

wherein the sleeve includes a flange extending radially outward of the outer surface of the sleeve that limits insertion of the sleeve into the first rod; and wherein the end portion of the second rod has a smaller diameter than a central portion of the second rod and a step defined between the end portion and the central portion that limits insertion of the central portion into the sleeve.

6. The rod system of claim 5 wherein a portion of the sleeve is compressed into at least a portion of the pattern.

7. The rod system of claim 5 further comprising:

a first connector having a lock to secure the first connector along at last one of the first rod and the second rod; and a product holder sized to be suspended from the first connector.

8. The rod system of claim 5 wherein insertion of the end portion of the second rod into the sleeve compresses the sleeve between the first and second rods.

9. The rod system of claim 5 wherein the pattern is a helical pattern.

10. The rod system of claim 5 wherein the pattern is a dimpling pattern.

11. The rod system of claim 5 wherein the pattern is a stippling pattern.

* * * * *